US008978822B2

(12) United States Patent
Kreller

(10) Patent No.: US 8,978,822 B2
(45) Date of Patent: Mar. 17, 2015

(54) VERTICAL FRAME OF METAL

(75) Inventor: Helmut Kreller, Bad Rappenau (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 1031 days.

(21) Appl. No.: 12/311,628

(22) PCT Filed: Oct. 5, 2007

(86) PCT No.: PCT/DE2007/001780

§ 371 (c)(1),
(2), (4) Date: Apr. 7, 2009

(87) PCT Pub. No.: WO2008/043339

PCT Pub. Date: Apr. 17, 2008

(65) Prior Publication Data

US 2010/0078263 A1 Apr. 1, 2010

(30) Foreign Application Priority Data

Oct. 11, 2006 (DE) ..... 20 2006 015 586 U

(51) Int. Cl.
*E04G 1/00* (2006.01)
*E04G 1/14* (2006.01)

(52) U.S. Cl.
CPC ..... *E04G 1/14* (2013.01)
USPC ..... 182/113; 182/178.1; 182/178.5; 403/49

(58) Field of Classification Search
USPC ..... 182/178.1, 178.5, 178.6, 186.7, 186.8; 403/49
See application file for complete search history.

(56) References Cited

U.S. PATENT DOCUMENTS 2,305,563 A * 12/1942 Uecker et al. ..... 52/693
2,546,676 A 3/1951 North (Continued)

FOREIGN PATENT DOCUMENTS

CA 2 263 302 A1 9/2000
CH 439 679 7/1967

(Continued)

OTHER PUBLICATIONS

European Office Action dated May 7, 2010 along with an English translation of the relevant parts.

(Continued)

*Primary Examiner* — Katherine Mitchell
*Assistant Examiner* — Candace L Bradford
(74) *Attorney, Agent, or Firm* — Collard & Roe, P.C.

(57) ABSTRACT

The invention relates to a vertical frame made of metal, particularly a scaffolding frame, having at least one first vertical shaft (21) and a bar-shaped, horizontal transversal arm (23) extending away from the same, the shaft and arm being permanently connected to each other, having the following characteristics: a first perforated disk having a plurality of openings is permanently mounted to the shaft (21), wherein the perforated disk is disposed concentrically to the shaft (21) and surrounds the shaft (21) in a flange manner; at least one first mounting device is provided on the shaft (21) at a distance to the perforated disk for mounting a fall-protection means; the transversal arm (23) on one end thereof has a first connecting head, and on the second end thereof facing away from the first end has a second connecting head by which the transversal arm (23) can be secured, or is secured, on a second vertical shaft (21) via a second perforated disk equipped with a plurality of openings by forming a vertical frame; each connecting head is delimited by side wall parts having vertical exterior surfaces that are tapered toward a center in a wedge manner; the vertical exterior surfaces form a wedge angle of preferably about 45 degrees; each connecting head has an upper head part and a lower head part.

27 Claims, 53 Drawing Sheets

(56) References Cited

U.S. PATENT DOCUMENTS

| | | | | | |
|---|---|---|---|---|---|
| 3,270,997 | A * | 9/1966 | Gethmann | 248/235 |
| 3,490,189 | A * | 1/1970 | Gostling | 52/655.1 |
| 3,656,580 | A | 4/1972 | Gostling | |
| 4,044,523 | A * | 8/1977 | Layher | 52/638 |
| 4,273,463 | A * | 6/1981 | Dobersch | 403/246 |
| 4,603,756 | A * | 8/1986 | Layher | 182/186.8 |
| 4,840,513 | A * | 6/1989 | Hackett | 403/49 |
| 4,867,274 | A | 9/1989 | Langer | |
| 5,024,037 | A * | 6/1991 | Ono | 52/646 |
| 5,046,879 | A | 9/1991 | Langer nee Layher | |
| 5,127,757 | A | 7/1992 | Langer | |
| 5,145,030 | A * | 9/1992 | Pavlescak et al. | 182/113 |
| 5,207,527 | A * | 5/1993 | Duncan et al. | 403/246 |
| 5,560,730 | A * | 10/1996 | Gillard et al. | 403/294 |
| 5,961,240 | A * | 10/1999 | Bobrovniczky | 403/49 |
| 6,027,276 | A * | 2/2000 | Schworer | 403/49 |
| 7,975,803 | B2 * | 7/2011 | Schwoerer | 182/178.1 |
| 2001/0013446 | A1 | 8/2001 | Krause | |
| 2002/0036118 | A1 * | 3/2002 | Ono | 182/178.1 |
| 2004/0231922 | A1 * | 11/2004 | Schwoerer | 182/178.1 |
| 2006/0039746 | A1 * | 2/2006 | Stringer | 403/49 |
| 2006/0153631 | A1 * | 7/2006 | Stringer | 403/49 |
| 2007/0045048 | A1 * | 3/2007 | Wyse | 182/178.1 |
| 2009/0301815 | A1 * | 12/2009 | Rogers | 182/178.1 |
| 2013/0043095 | A1 * | 2/2013 | Thacker | 182/186.7 |

FOREIGN PATENT DOCUMENTS

| | | | |
|---|---|---|---|
| CH | 457 803 | | 6/1968 |
| DE | 1 677 836 | | 6/1954 |
| DE | 1 434 369 | | 10/1969 |
| DE | 24 49 124 | | 4/1976 |
| DE | 31 39 980 | | 4/1983 |
| DE | 34 07 425 | | 9/1985 |
| DE | 36 11 431 | | 10/1987 |
| DE | 87 11 664 | | 12/1987 |
| DE | 37 02 057 | | 8/1988 |
| DE | 38 07 631 | | 11/1989 |
| DE | 39 09 809 | | 9/1990 |
| DE | 39 34 857 | | 4/1991 |
| DE | 196 48 988 | | 5/1998 |
| DE | 198 06 094 | | 8/1999 |
| DE | 198 27 284 | | 12/1999 |
| DE | 200 02 371 | | 5/2000 |
| DE | 100 090 885 | A1 | 9/2000 |
| DE | 200 12 598 | | 11/2000 |
| DE | 101 12 370 | | 9/2002 |
| DE | 102 25 403 | | 3/2003 |
| DE | 20 2004 007 550 | | 7/2004 |
| EP | 0 276 487 | | 8/1988 |
| EP | 0 376 430 | | 7/1990 |
| EP | 0 389 933 | | 10/1990 |
| EP | 0 423 516 | | 4/1991 |
| EP | 0 936 327 | | 8/1999 |
| EP | 1 016 766 | | 7/2000 |
| EP | 1 301 673 | | 4/2003 |
| EP | 1 362 151 | | 11/2003 |
| EP | 1 452 667 | | 9/2004 |
| EP | 1 544 375 | | 6/2005 |
| EP | 1 672 140 | | 6/2006 |
| EP | 1672140 | A2 * | 6/2006 |
| EP | 1 691 007 | A2 | 8/2006 |
| EP | 1 698 745 | | 9/2006 |
| FR | 1 561 476 | | 3/1969 |
| FR | 2 288 199 | | 5/1976 |
| FR | 2 448 013 | | 8/1980 |
| FR | 2 516 141 | | 5/1983 |
| RU | 1 808 078 | | 4/1993 |
| RU | 2 160 813 | | 12/2000 |
| WO | WO 02/06610 | | 1/2002 |
| WO | WO 02/066768 | | 8/2002 |

OTHER PUBLICATIONS

International Search Report, Jan. 7, 2008.
Written Report of the International Searching Authority with English translation of relevant portions.
European Patent Office Examination Report dated Sep. 10, 2013 in EP 0 621 346.9 with English translation of relevant parts.
German Examination Report dated Oct. 15, 2014 in German Application No. 11 2007 003 152.2 with English translation.
Deutsches Institut für Bautechnik (DIBt): Z-8, 1-175—Layher AllroundGerüst, Dec. 15, 1982, ZA R 1, 2, 7, 8—Zulassung.

* cited by examiner

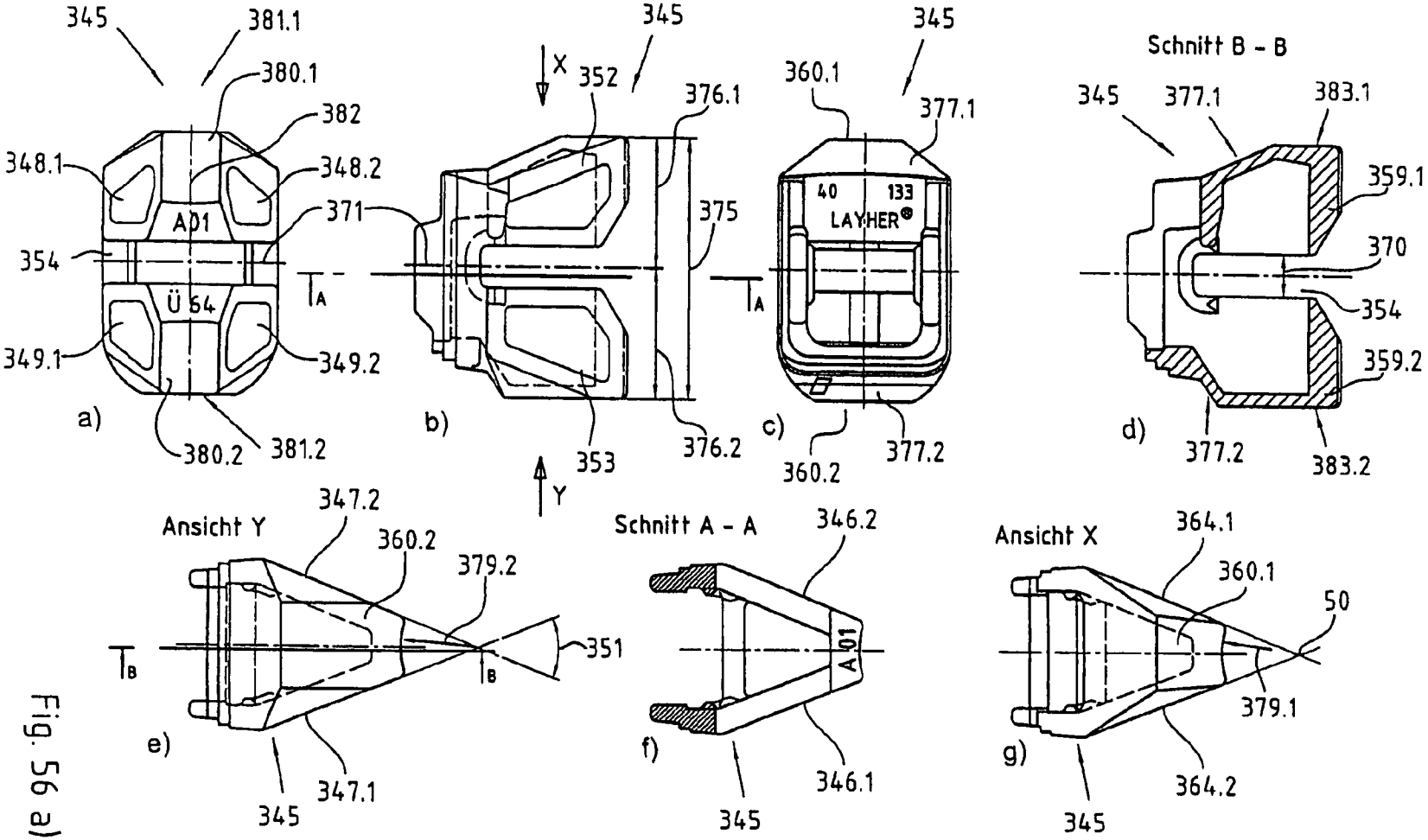
Fig. 56 a)-g)

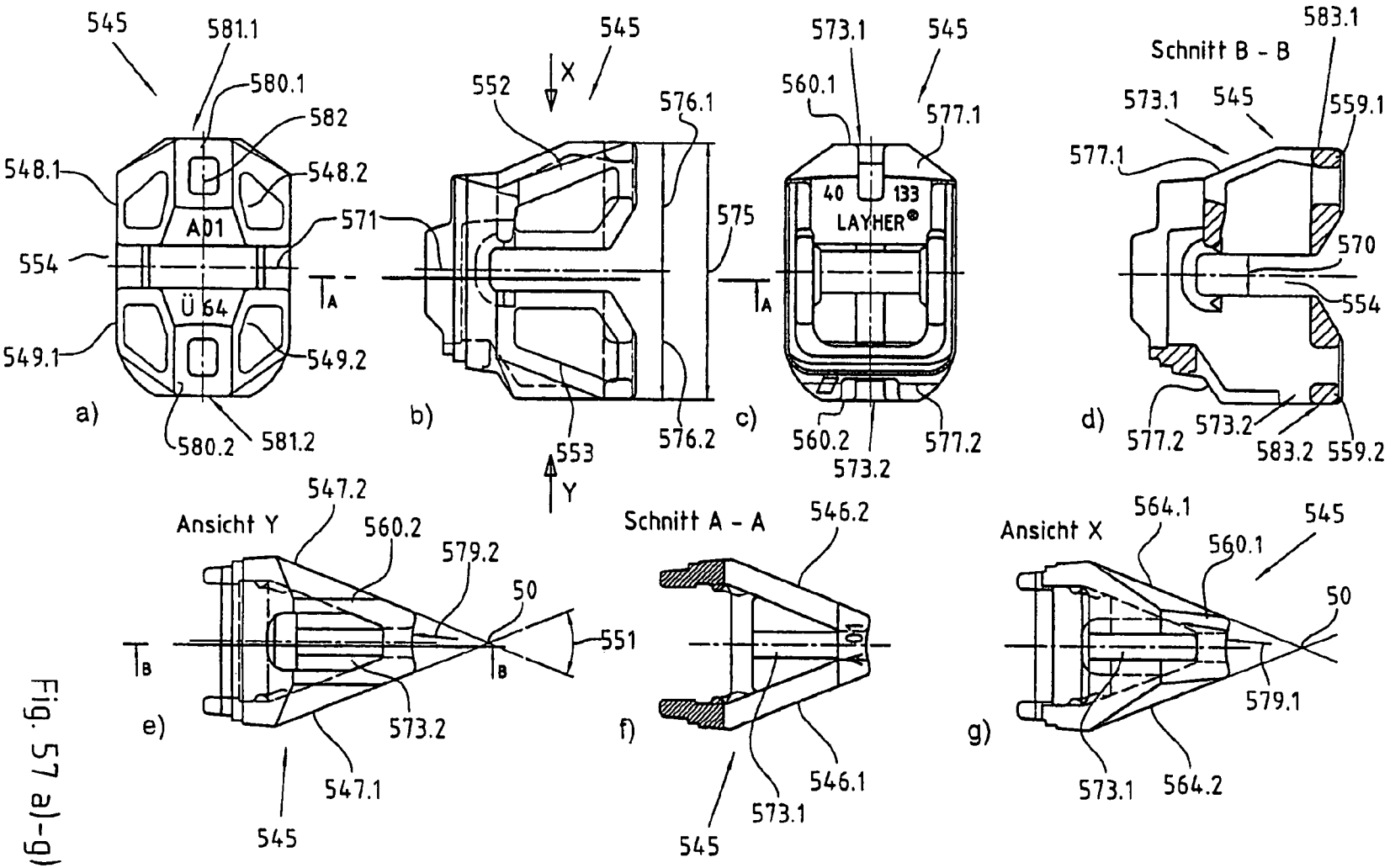
Fig. 57 a)-g)

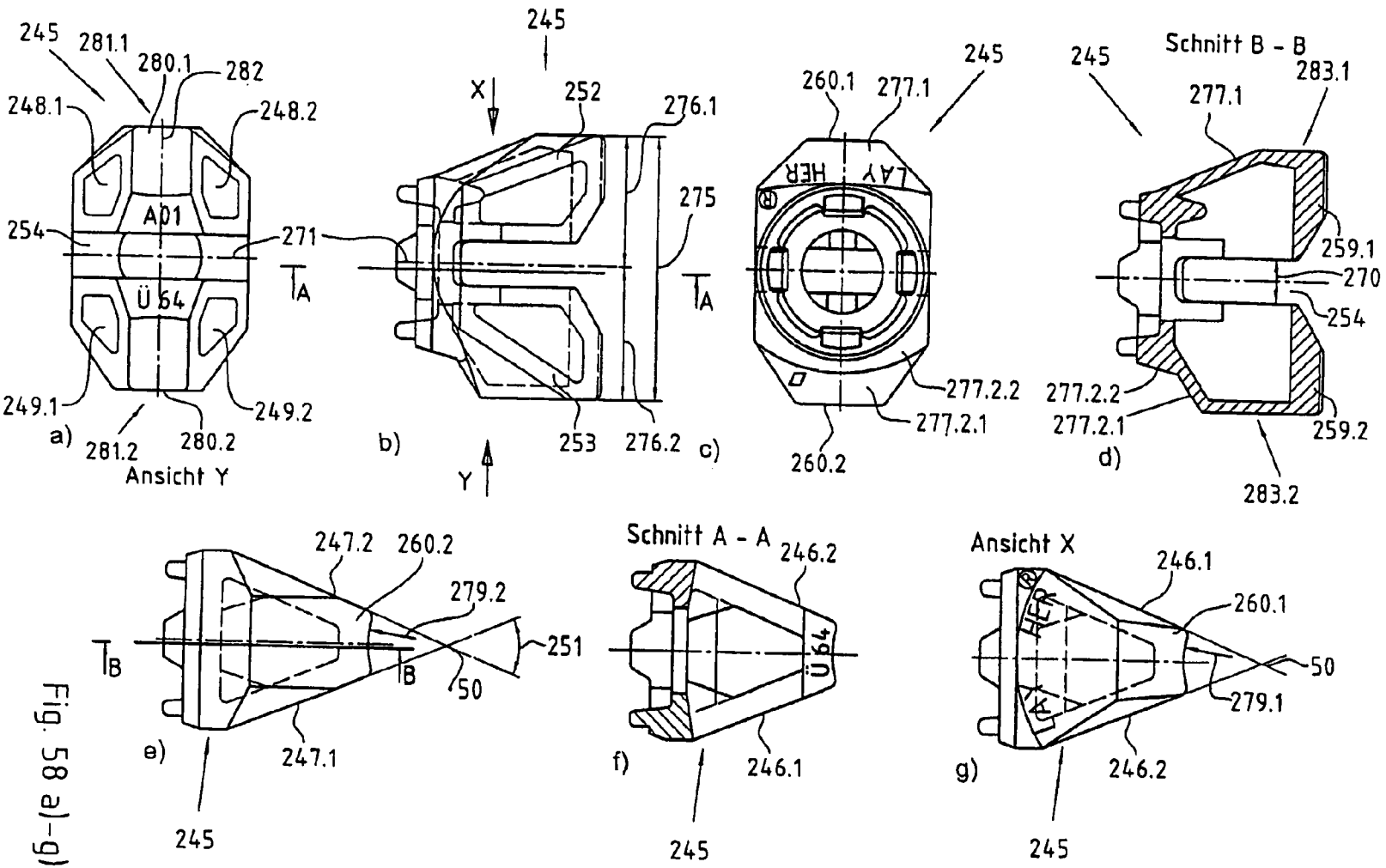
Fig. 58 a)-g)

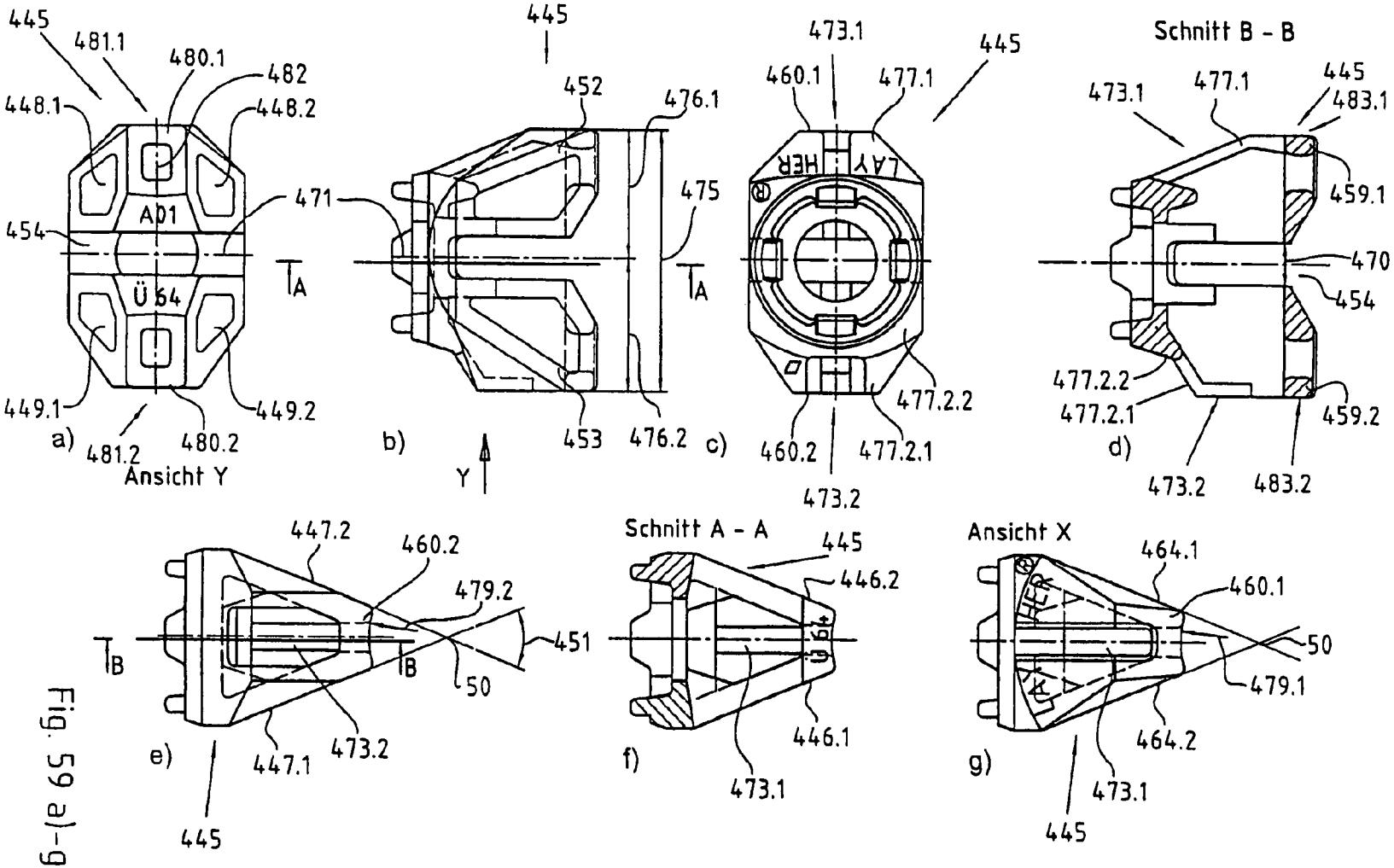
Fig. 59 a)-g)

VERTICAL FRAME OF METAL

CROSS REFERENCE TO RELATED APPLICATIONS

This application is the National Stage of PCT/DE2007/001780 filed on Oct. 5, 2007, which claims priority under 35 U.S.C. §119 of German Application No. 20 2006 015 586.4 filed on Oct. 11, 2006. The international application under PCT article 21(2) was not published in English.

The invention relates to a vertical frame of metal, particularly a scaffolding frame, with at least one first vertical post and a rod-shaped horizontal transverse arm extending transversely, preferably perpendicularly, away therefrom, the post and arm being permanently connected together by welding to be stiff in bending and torsion. The invention also relates to a three-dimensional framework, particularly scaffolding, with one more vertical frames of that kind.

Numerous scaffolding systems with vertical frame elements and/or vertical frames of that kind have become known. Amongst them are so-called system scaffoldings such as, for example, the Layher 'Blitz' scaffolding system which has been known for many decades and proved best in practice. This comprises two vertical posts and two crossbars which are permanently fixed thereto at a spacing relative to one another corresponding with the passage height and which are each arranged perpendicularly with respect to the posts and together therewith form a rectangular, closed vertical scaffolding standing frame. The upper crossbars are formed as upwardly open U-profile members in which scaffolding floor elements can be hung by way of hook units. The lower crossbar can be constructed as a rectangular beam profile. The standing frames are designed to be able to be plugged onto one another so that several scaffolding tiers can thereby be built up.

System scaffoldings of that kind have become known from, for example, DE 38 07 631 A, DE 198 27 284 A1 or WO 02/066768 A1 of the applicant. Similar system scaffoldings constructed from closed rectangular frames have become known from, for example, DE 31 39 980 C2, CH-PS 439 679 or DE 87 11 664 U1.

Other scaffoldings able to be constructed with standing frames have U-shaped vertical frames which are designed to be downwardly open. Standing frames or scaffoldings of that kind have become known from, for example DE-PS 1 434 369, DE 1 677 836 U, DE 200 02 371 U1, DE 196 48 988 A1, CH-PS 439 679, CH-PS 457 803 and U.S. Pat. No. 2,305,563.

For specific cases of use the standing frame can also be designed to be H-shaped, for example with upwardly prolonged posts. Such frames are evident from, for example, DE 20 2004 007 550 U1 of the applicant. In that case, a second connecting rod for lower stiffening can be detachably connected between the lower ends of the vertical posts.

Other facade scaffoldings can be built up from L-shaped, T-shaped or t-shaped frame elements, such as disclosed in, for example, DE 36 11 431 C2 of the applicant, FR-PS 1 561 476 or U.S. Pat. No. 2,546,676.

Finally, facade scaffoldings have become known which can be built up from h-shaped frames. Thus, scaffoldings can be realised which are built up according to the principle of a 'leading railing'. This means that during construction of a first scaffolding tier the railing element or the railing elements for the second scaffolding tier provided thereabove are already able to be mounted from the first tier, so that security against falling is already guaranteed from the first occasion of walking on the second scaffolding tier. Scaffoldings of that kind are evident from, for example, DE 196 48 988 A1 or FR-PS 25 16 141.

All these scaffoldings containing standing frames or facade frames are capable of varied use, are simple to handle and can be constructed comparatively simply and quickly without tools.

Scaffoldings able to be built up from asymmetrical part frames of T-shaped construction are evident from, for example, U.S. Pat. No. 3,656,580 and EP 1 672 140 A2. The part frames consist of a vertical post member or post to which is welded a horizontal cross member arranged perpendicularly thereto and extending away therefrom. At the end of the cross member extending away from the post member or from the post this has an anchoring body which is fixable by means of a wedge to a receiving pocket or to a hook plate, which is provided with passages, at this and to the post member or the post. These part frame elements, however, have the disadvantage that they cannot be combined with a further vertical post or post member to form a vertical frame, which on the side of the post member or post permanently connected with the cross member enables connection of standardised horizontal and diagonal connecting elements, which are designed to be matched to the grid dimension and the retaining devices—which are arranged at specific intervals on the posts—of a modular scaffolding system.

Other scaffolding systems concern so-called modular scaffoldings. These are constructed from separate individual scaffolding elements, particularly from posts as well as horizontal and/or diagonal connecting elements. The connecting elements have, at their ends, connecting heads which serve as holding devices and by means of which they can be hung in receiving elements, i.e. so-called connection nodes, and fixed thereto. These connecting nodes are mounted at regular longitudinal spacings along the posts. As horizontal and/or diagonal connecting elements use can be made of, in particular, longitudinal struts, crossbars and/or diagonal rods. Very stable scaffoldings stiff in bending and torsion can be built up in the most diverse mode and manner from these individual components. A modular scaffolding system of that kind of the applicant has as the Layher 'Allround' scaffolding been established for decades on the market as a synonym for modular scaffolding. The so-called 'Allround' nodes of the applicant has, by its unique connecting technology, replaced the conventional scaffolding construction technology. Applications in a unique multiplicity of uses can be realised by the individual 'Allround' scaffolding elements: at every construction site, in industry, chemical plants, power stations and shipyards, and in the events field, for example with platforms and stairways. Whether as a working, protective, facade or support scaffolding, as an internal, mobile or roof scaffolding and/or at the most difficult outlines and forms of architecture and in a case of increased safety demands, the 'Allround' scaffolding system of the applicant has done justice to all these tasks and requirements.

The vertical scaffolding posts, which are formed by round tubes, of this modular scaffolding are provided at regular length intervals with so-called apertured discs fastened to the posts by welding. These apertured discs are arranged concentrically with respect to the posts and surround the respective post at the full circumference in the manner of a flange. The apertured discs have several small and large passages arranged in alternation at the same circumferential angles relative to one another. The connecting heads of horizontal and/or diagonal connecting or scaffolding elements, particularly of longitudinal and/or horizontal struts as well as diagonal rods, can thereby be hooked in at these passages. The connecting heads have an upper and a lower head part each with a wedge opening for a wedge, which can be plugged through these wedge openings and through one of the passages of the associated apertured disc and by means of which the connecting head, which is provided with a slot arranged between the upper head part and the lower head part and which can be plugged onto the apertured disc, can be firmly wedge-connected with the post.

The connecting heads are usually connected as separate components, i.e. in multi-part manner, with the respective rod-shaped connecting element by welding. Connecting heads of that kind, apart from apertured discs and connecting elements, have become known from, for example, DE-PS 24 49 124, DE 37 02 057 A or the parallel EP 0 276 487 B1, DE 39 34 857 A1 or the parallel EP 0 423 516 B2, DE 198 06 094 A1 or the parallel EP 0 936 327 B1 and the parallel EP 1 452 667 B1 of the applicant. Alternative apertured disc designs are evident from, for example, DE 39 09 809 A1 and the parallel EP 0 389 933 B1 and DE 200 12 598 U1 as well as the parallel WO 02/06610 A1 and the parallel EP 1 301 673 A1 of the applicant. A scaffolding tube of a metal tubular scaffolding, in which the scaffolding tube is provided integrally, and of the same material, with a formed-on connecting head is evident from, for example, DE 34 07 425 A1 of the applicant.

It is possible from the afore-mentioned scaffolding elements, i.e. the posts provided with several apertured discs and the rod elements provided with slotted connecting heads, for example the crossbars, to also construct, inter alia, vertical frame elements or vertical frames which can have the designs mentioned in the introduction. Thus, for example, the L-shaped, t-shaped or T-shaped vertical frame elements can be built up from a post and at least one rod element provided with a connecting head. At least two or three individual parts are needed for that purpose. For construction of U-shaped, H-shaped and h-shaped vertical frames at least three individual parts are again needed, whilst for the construction of O-shaped or rectangular vertical frames at least four individual parts are required.

US 2002/0036118 A1 and EP 1 016 766 A1 disclose diverse frames and scaffoldings constructed therefrom. Each vertical frame comprises at least one vertical support rod and at least two connection/support elements fastened thereto and arranged to be offset in the longitudinal direction thereof as well as one or more railing elements fastened to the support rod and extending laterally away therefrom. Provided at the respective end of the railing elements extending away from the support rod is a connecting member which is fastened to the support rod at a vertical position or height corresponding with the associated connection/support element. The connecting member can be a separate element of metal. The vertical frames can also be constructed from two parallel support rods, between which one or more railing elements are fastened. For construction of a scaffolding, in each instance two such vertical frames are placed, with their railing elements respectively extending in longitudinal direction of the scaffolding, at a spacing from one another in transverse direction of the scaffolding. Between each two support rods, which are arranged adjacent in the transverse direction, of the vertical frame at least one horizontal transverse element is detachably fastened to the connection/support elements, which are preferably formed as flanges, of the support rods. Arranged between each two horizontal transverse elements of that kind, which are disposed at a spacing from one another in longitudinal direction of the scaffolding, are scaffolding floors provided with suspension hooks, which rest on the horizontal transverse elements.

It is an object of the invention to provide a vertical frame of the kind stated in the introduction which can be managed simply and easily, by which mounting and demounting of a three-dimensional framework designed as a scaffolding can be performed in simple mode and manner and economically, which is universally usable and economically producible and which can be combined with a modular scaffolding, which is constructed according to a grid dimension, with the possibility of utilisation of multiple connection possibilities, which are present in this, for horizontal and diagonal rod-shaped connecting elements.

This object is fulfilled particularly by the features of claim 1.

Due to the fact that the permanent connection of the first post and the second post is formed by a single crossbar, handling is facilitated and in a given case a maximum passage height can be achieved with unobstructed passage.

In an advantageous refinement the vertical frame can be designed as a torsionally stiff U-shaped, H-shaped or h-shaped frame, particularly as a U-shaped, H-shaped or h-shaped standing frame.

A U-shaped, H-shaped or h-shaped frame of that kind can be constructed to be downwardly open so that a maximum passage height is available. Moreover, cladding units, particularly wooden scaffolding boards or planks, can also thereby be placed on the transverse arm. It is thus not absolutely necessary to use system cladding units having suspension aids, in particular scaffolding system claddings, since no lower crosspiece, which would determine a maximum height of the cladding units, is present.

A good permanent connection with respect to the post can be achieved in that the upper head part and the lower head part of the first connecting head and/or the second connecting head are, in the regions of the vertical outer surfaces thereof and optionally also in regions of the horizontal outer surfaces thereof, which are connected outwardly with the vertical wall parts thereof bearing against the associated post and/or disposed opposite thereto at a small spacing, welded to the associated post by way of a respective continuous weld seam, in a given case with the exception of at least one optionally provided liquid outlet opening.

Alternatively or additionally it can be provided that the upper head part and the lower head part of the first connecting head and/or the second connecting head are, in the regions of the vertical outer surfaces thereof, which are connected outwardly with the horizontal slot surfaces of the slot of the connecting head or the respective connecting head, welded to the associated apertured disc by way of a respective continuous weld seam over the entire width of the part of the associated apertured disc projecting into the slot of the connecting head or of the respective connecting head.

An improved permanent connection can be achieved in that the upper head part and the lower head part of the first connecting head and/or of the second connecting head are, in regions of the vertical outer surfaces thereof, optionally also in regions of the horizontal outer surfaces thereof, which are connected towards the outside with the vertical wall parts thereof bearing against the associated post and/or disposed opposite thereto at a small spacing, welded to the associated post by way of a continuous weld seam and, also in regions of the vertical outer surfaces thereof, which are connected towards the outside with the horizontal slot surfaces of the slot of the connecting head or of the respective connecting head, welded to the associated apertured disc by way of a respective continuous weld seam in each instance over the entire width of the part of the associated apertured disc projecting into the slot of the connecting head or the respective connecting head, and also, in regions of vertical outer surfaces, which are connected towards the outside with the vertical slot surfaces of the slot, welded to the end surfaces, which are disposed in the region of the slot, of the associated apertured disc by way of a respective continuous weld seam, in a given case with the exception of at least one optionally provided liquid outlet opening.

An optimal permanent connection can be achieved in that the first connecting head and/or the second connecting head is or are, in the region of all its or their outer surfaces, which are connected outwardly with its or their surfaces disposed directly opposite the associated post and the associated apertured disc, welded to the associated post and to the associated apertured disc by way of a continuous weld seam, in a given case with the exception of at least of one liquid outlet opening.

In addition, it can be provided that the first connecting head and/or the second connecting head is or are permanently welded to the associated post in the manner that the horizontal plane, which intersects the slot or the respective slot at half the height of the slot width or of the respective slot width, coincides with the centre plane of the associated apertured disc. Through a centring in that manner equally favourable gap conditions between the horizontal slot surfaces of the slot and the intermediate part of the apertured disc are created, which enables simple welding with an optimum connection quality.

Moreover, provision can be made for the first connecting head and/or the second connecting head to be permanently connected with the associated post, without clamping, by a separate wedge.

Furthermore, it can be provided for the first connecting head and/or the second connecting head is or are designed in such a manner, and the associated apertured disc with the slot or the respective slot to be arranged to be engaged over at least partly in such a manner that, with the exception of a sole passage of the passages of the associated apertured disc, all other passages of the associated apertured disc are usable for a connection of holding devices, particularly for hanging in usual connecting heads of supporting and/or connecting elements, preferably of horizontally and/or diagonally extending scaffolding elements. In this manner the new vertical frame element can be combined in optimum manner with an appropriate modular scaffolding system.

In addition, provision can be made for the first connecting head and/or the second connecting head to be formed integrally, and of the same material, with the transverse arm.

A connecting head of that kind or connecting heads of that kind can be produced by deforming, particularly by pressing together or compressing, the first end and/or the second end of the transverse arm, which is preferably constructed as a hollow profile member.

Moreover, it can be provided that the transverse arm is designed to be of multi-part construction with a rod element and with the first connecting head and/or with the second connecting head, which is or are connected with the rod element, preferably permanently, in particular by welding. This offers, for example, the possibility of use of mass-production connecting heads.

Furthermore, it can be provided that an upper wedge opening is formed in the upper head part of the second connecting head, and a lower wedge opening is formed in the lower head part of the second connecting head, for a wedge able to be plugged through the wedge openings and serving for tightening the components to be connected.

In addition, provision can be made for the first connecting head and the second connecting head to be designed to be of the same construction, preferably substantially identical.

Alternatively, it can be provided that the first connecting head and the second connecting head are of different design.

In that case it can be provided that the first connecting head is formed at the transverse arm integrally and of the same material and that the second connecting head is permanently connected, preferably by welding, to a or the rod element of the transverse arm.

Alternatively, it can be provided that the first connecting head is permanently connected, preferably by welding, to a or the rod element of the transverse arm and that the second connecting head is formed at the transverse arm integrally and of the same material.

Moreover, it can be provided that the first connecting head and/or the second connecting head is or are provided with support wall parts, which have support surfaces, for support at the associated post. In that case the or each upper head part can have an upper support surface and the or each lower head part a lower support surface.

Moreover, it can be provided that the first connecting head and/or the second connecting head has or have in the region of the wall parts directly opposite the associated post, particularly in the region of the support surfaces of the support wall parts, a greater height than the height or the outer diameter of the transverse arm. This makes possible advantageous bearing and support conditions and the transmission of higher bending and torsional moments.

Alternatively or additionally it can be provided that not only the upper end of the upper head part, but also the lower end of the lower head part of the first connecting head and/or of the second connecting head project, in the region of the wall parts directly opposite the associated post, particularly in the region of the support surfaces of the support wall parts, beyond the transverse arm in a direction transverse, preferably perpendicular, to the longitudinal axis thereof.

Furthermore, it can be provided that the height of the upper head part and/or the height of the lower head part of the first connecting head and/or of the second connecting head reduces or reduce in direction towards the transverse arm, preferably gradually, to the outer diameter or the height of the transverse arm.

In addition, it can be provided that an upper outer surface of the upper head part and/or a lower outer surface of the lower head part of the first connecting head and/or the second connecting head is or are formed to be inclined relative to the transverse arm, preferably to include with a notional line extending parallel to the longitudinal axis of the transverse arm an angle which is greater than zero degrees, preferably between 10 degrees and 35 degrees, particularly approximately 25 degrees. This makes possible further improved supporting and force or moment transmission relationships.

Furthermore, it can be provided that the vertical wall parts, which are directly opposite the post or the respective post and preferably bear thereagainst, of the first connecting and/or the second connecting head have a part-cylindrical form and, considered in a cross-section perpendicular to the longitudinal axis of the associated post, are formed with a radius corresponding with the outer radius of the post and preferably amounting to 24.15 millimeters. This makes possible a particularly stress-free transmission of force or moment.

In addition, it can be provided that the spacings of the upper end of the upper support surface and the lower end of the lower support surface from the horizontal plane intersecting the slot at half the height of the slot width are of the same size. In this manner it is inconsequential during assembly in which setting, differing by 180 degrees, the respective connecting head is welded to the transverse arm or the post. Overall, through these measures advantageous force and moment transmission relationships result for all connecting heads.

Moreover, provision can be made for the first connecting head and/or the second connecting head to be formed symmetrically with respect to a vertical plane containing the longitudinal axis of the transverse arm.

Furthermore, it can be provided that the first connecting head and/or the second connecting head is formed symmetrically with respect to a horizontal plane intersecting the slot at half the height of the slot width.

Furthermore, it can be provided that the slot of the first connecting head and the slot of the second connecting head are arranged substantially parallel to one another.

In addition, it can be provided that the slot of the first connecting head and/or the slot of the second connecting head is or are arranged perpendicularly to the longitudinal axis of the associated post.

Furthermore, provision can be made for the slot of the first connecting head and/or the slot of the second connecting head to have a slot width which is between 7 millimeters to 13 millimeters, preferably between 8 millimeters and 12 millimeters, particularly approximately 10 millimeters.

In addition, it can be provided that the first apertured disc and/or the second apertured disc has or have an apertured disc thickness between 8 millimeters and 11 millimeters, preferably approximately 9 millimeters.

Furthermore, it can be provided that the upwardly facing horizontal and/or inclined upper wall parts of the upper head part of the first connecting head and/or of the second connecting head can be formed, with the exception of an optionally provided liquid outlet opening, to be free of openings.

In addition, it can be provided that the downwardly facing horizontal and/or inclined lower wall parts of the lower head part of the first connecting head and/or of the second connecting head are formed, with the exception of an optionally provided liquid outlet opening, to be free of openings. This increases the stability and torsional stiffness of the connecting heads.

The stability and torsional stiffness can be further improved in that not only the upwardly facing horizontal and/or inclined upper wall parts of the upper head part of the first connecting head and/or of the second connecting head are formed to be free of openings, with the exception of an optionally provided liquid outlet opening, but also the downwardly facing horizontal and/or inclined lower wall parts of the lower head part of the first connecting head and/or of the second connecting head are formed to be free of openings with the exception of an optionally provided liquid outlet opening.

Moreover, it can be provided that the upper head part of the first connecting head and/or of the second connecting head and/or the lower head part of the first connecting head and/or of the second connecting head is or are formed to be free of wedge openings for a separate plug-through wedge. It is thereby possible to improve, in particular, the connecting heads, which are known from the state of the art and which are fixable with the help of plug-through wedges at retaining devices of posts, with respect to their stability and torsional stiffness.

In addition, it can be provided that the first connecting head and/or the second connecting head is formed on the or on the respective upper wall part, which is constructed between its or their vertical side wall parts, with a toeboard fastening element, which is arranged preferably perpendicularly to the longitudinal axis of the transverse arm and extends upwardly away from the or the respective connecting head and which is constructed as, in particular, a toeboard fastening pin, for the fastening of a toeboard, which is permanently fastened there, preferably by welding.

In that case provision can be made for the toeboard fastening element to be arranged parallel to the longitudinal axis of the associated post.

Moreover, it can be provided that the toeboard fastening element has from the associated post disposed opposite thereto a spacing of 10 millimeters to 20 millimeters, preferably approximately 15 millimeters. This makes possible a horizontal gap-free mounting of a toeboard so that the risk of accident, particularly due to objects falling down, can be minimised.

In addition, provision can be made for the transverse arm and/or the rod element of the transverse arm to be formed by a tube, particularly by a round tube or by an oval tube or by an upwardly open profile member, particularly by an upwardly open U-profile member.

Moreover, it can be provided that the transverse arm and/or the rod element of the transverse arm is or are formed with a U-profiled tube which is preferably closed in cross-section and has two lateral U-limbs, which are respectively formed by double wall regions and which extend in an upward direction at least in part regions, preferably parallel to one another, going out from a hollow profile part preferably formed to be box-shaped, rectangular, C-shaped, U-shaped or V-shaped. A profile tube of that kind fulfils, in particular manner, the demands placed on a single transverse arm of a vertical frame element according to the invention.

A hollow profile part of that kind can be formed with an outwardly disposed lower horizontal wall part and with an inwardly disposed upper horizontal wall part which extend substantially over the entire length of the transverse arm.

These horizontal wall parts can advantageously have from one another a spacing which is between 15 millimeters and 25 millimeters, preferably approximately 20 millimeters.

Moreover, it can be provided that the free ends of the two lateral U-limbs are of equal length and have, from the inwardly disposed upper horizontal wall part, a respective spacing of between 28 millimeters and 38 millimeters, preferably between 30 millimeters and 36 millimeters, particularly approximately 33 millimeters.

Moreover, provision can be made for the hollow profile part to have a height of between 42 millimeters and 63 millimeters, preferably between 45 millimeters and 61 millimeters, particularly approximately 53 millimeters.

In addition, it can be provided that the hollow profile part has a width of between 45 millimeters and 53 millimeters, preferably between 48 millimeters and 50 millimeters, particularly approximately 49 millimeters.

Moreover, it can be provided that the U-profile tube is produced by deforming, particularly by bending over or flanging, a metal plate, particularly on rolling train. In that case it can be provided that a connection, which is free of overlap, of two plate edges of the metal plate is produced over the entire length of the U-profile or U-profile tube, particularly by means of laser welding. However, it will be obvious that the plate edges of the metal plate can also be connected by, for example, folding.

Alternatively, provision can be made for the U-profile tube to be produced by deforming, particularly by stretch-reduction of a cross-sectionally closed tube, particularly a round, square or rectangular tube.

Alternatively, it can be provided that the U-profile tube is produced by extruding.

Furthermore, it can be provided that the transverse arm formed as a crossbar has an upper longitudinal outer edge which forms a support edge for floor units, particularly scaffolding floors, able to be placed on the transverse arm and/or hung in at the transverse arm by means of suspension aids, wherein the longitudinal outer edge is arranged above the first apertured disc and/or above the second apertured disc and at a spacing above the centre plane of the apertured disc or the respective apertured disc which is smaller than the thickness or the height or the outer diameter of the transverse arm.

This spacing can advantageously be selected in the manner that it corresponds with approximately half the thickness or half the height or half the outer diameter of the transverse arm.

In a concrete development the spacing can be 18 millimeters to 30 millimeters, preferably 21 millimeters to 27 millimeters, particularly approximately 24 millimeters to 25 millimeters.

In addition, it can be provided that the length of the vertical outer surfaces, which run together in wedge shape, of the side wall parts of the first connecting head and/or of the second connecting head, considered in a direction of projection perpendicular to the longitudinal axis of the transverse arm, is between 30 millimeters and 50 millimeters, preferably between 32 millimeters and 38 millimeters, particularly approximately 35 millimeters or approximately 38 millimeters.

Further, it can be provided that the first apertured disc and/or the second apertured disc has at least three, preferably at least seven, especially at least eight, passages for connection of holding devices, particularly for suspension of supporting and/or connecting elements, preferably of horizontally and/or diagonally extending scaffolding elements, wherein in each instance a passage is arranged with respect to an adjacent passage at the same circumferential angle, preferably of 45 degrees.

In addition, provision can be made for the passages at least in an apertured disc part, which is not covered by the first connecting head and/or by the second connecting head, of the associated apertured disc to be of different size, wherein at least two, preferably at least four, first passages of the passages are greater than a second passage resepectively arranged between two of the larger passages.

In addition, it can be provided that an apertured disc part, which has a passage of the passages, of the first apertured disc and/or the second apertured disc, preferably inclusive of the entire passage, projects into the slot of the associated connecting head.

Further, it can be provided that the passage is a smaller passage of the passages of different size.

Moreover, provision can be made for the first apertured disc to embrace the first post at the full circumference and/or for the second apertured disc to embrace the second post at the full circumference.

Furthermore, it can be provided that the first apertured disc and the transverse arm are arranged in the region of the upper end of the first post, preferably below the upper end region of the first post.

Moreover, it can be provided that the second apertured disc and the transverse arm are arranged in the region of the upper end of the second post, preferably below the upper end region of the second post.

In addition, it can be provided that the first apertured disc has from the lower end of the first post, and/or the second apertured disc has from the lower end of the second post, a spacing of between 170 centimeters and 210 centimeters, preferably approximately 190 centimeters.

Additionally, it can preferably be alternatively provided that the first apertured disc has from the lower end of the first post, and/or the second apertured disc has from the lower end of the second post, a spacing of between 80 centimeters and 100 centimeters, preferably approximately 90 centimeters.

Moreover, provision can be made for the first post and the second post to be of equal length below the transverse arm and/or above the transverse arm.

Furthermore, provision can be made for the first post to have a greater length below the transverse arm than above the transverse arm and for the second post to have a greater length above the transverse arm than below the transverse arm.

Furthermore, it can be provided that the second post has a greater length below the transverse arm than above the transverse arm and that the first post has a greater length above the transverse arm than below the transverse arm.

In addition, provision can be made for the first post and/or the second post to have a greater length below the transverse arm than above the transverse arm.

Moreover, provision can be made for the first post and/or the second post to have greater length above the transverse arm than below the transverse arm.

Moreover, it can be provided that the upper end region, which is formed as a tube connector, or the lower end region, which is formed as a tube connector, of the first post and/or the second post has an outer diameter which is smaller than the outer diameter of the post or the posts in the remaining regions thereof, wherein the or the respective tube connector is formed at the post or posts integrally and of the same material.

Furthermore, provision can be made for the first post and the second post to be arranged parallel to one another.

In addition, provision can be made for the transverse arm to be formed with a straight rod element.

Further, it can be provided that the longitudinal axis of the transverse arm is arranged in the region of the height of the slot, preferably in the region of the height between the horizontal slot surfaces of the slot, particularly at approximately the height of the horizontal plane intersecting the slot at half the height of the slot width.

Moreover, it can be provided that the first post, the second post and the transverse arm span a common frame plane.

Moreover, it can be provided that the first post, which is formed as a hollow profile member, particularly as or with a round tube, and/or the second post, which is formed by hollow profile member, particularly as or with a round tube, has or have a wall thickness of 2.5 millimeters to 3.5 millimeters, particularly of approximately 2.7 millimeters.

Furthermore, provision can be made for the transverse arm to have a wall thickness of 2.5 millimeters to 4.0 millimeters, particularly of approximately 2.7 millimeters or approximately 3.2 millimeters.

Further, it can be provided that a first railing element fastening device for fastening of a railing element serving as safety means against falling, preferably also at least one second railing element fastening device of that kind spaced from the first railing element fastening device in longitudinal direction of the second post, is or are provided at the second post at a spacing from the second apertured disc.

Further, it can be provided that the railing element fastening device for the or each fall safety means of the second post is or are constructed differently from the first apertured disc and/or differently from the second apertured disc.

In addition, provision can be made for the first railing element fastening device for the fall safety means to have from the lower end of the first post and/or from the lower end of the second post a spacing amounting to between 75 centimeters and 125 centimeters, preferably approximately 95 centimeters.

Furthermore, it can be provided that the second railing element fastening device for the fall safety means has from the lower end of the first post and/or from the lower end of the second post a spacing amounting to between 25 centimeters and 65 centimeters, preferably approximately 45 centimeters.

In addition, it can be provided that the first railing element fastening device for the fall safety means has from the lower end of the first post and/or from the lower end of the second post a spacing of between 175 centimeters and 225 centimeters, preferably approximately 195 centimeters.

In addition, it can be provided that the second railing element fastening device for the fall safety means has from the lower end of the first post and/or from the lower end of the second post a spacing of between 125 centimeters and 165 centimeters, preferably approximately 145 centimeters.

The invention also relates to a three-dimensional framework, particularly a scaffolding, with one or more vertical frames according to at least one of claims 1 to 25.

The three-dimensional framework can be provided with at least four posts, at least one cladding unit mounted thereon, particularly scaffolding floor, and with at least one railing element constructed as safety means against falling, particularly with at least one diagonal element, which is fastened to two posts spaced apart in longitudinal direction of the three-dimensional framework, for stiffening of the three-dimensional framework (20), preferably with at least one longitudinal rod element (22), which is fastened to two posts (21) spaced apart in longitudinal direction of the three-dimensional framework (20), for stiffening the three-dimensional framework (20).

Further features, aspects and advantages of the invention can be inferred from the dependent claims and the following description part, in which advantageous exemplifying embodiments of the invention are described by way of the figures, in which:

Figure 3:
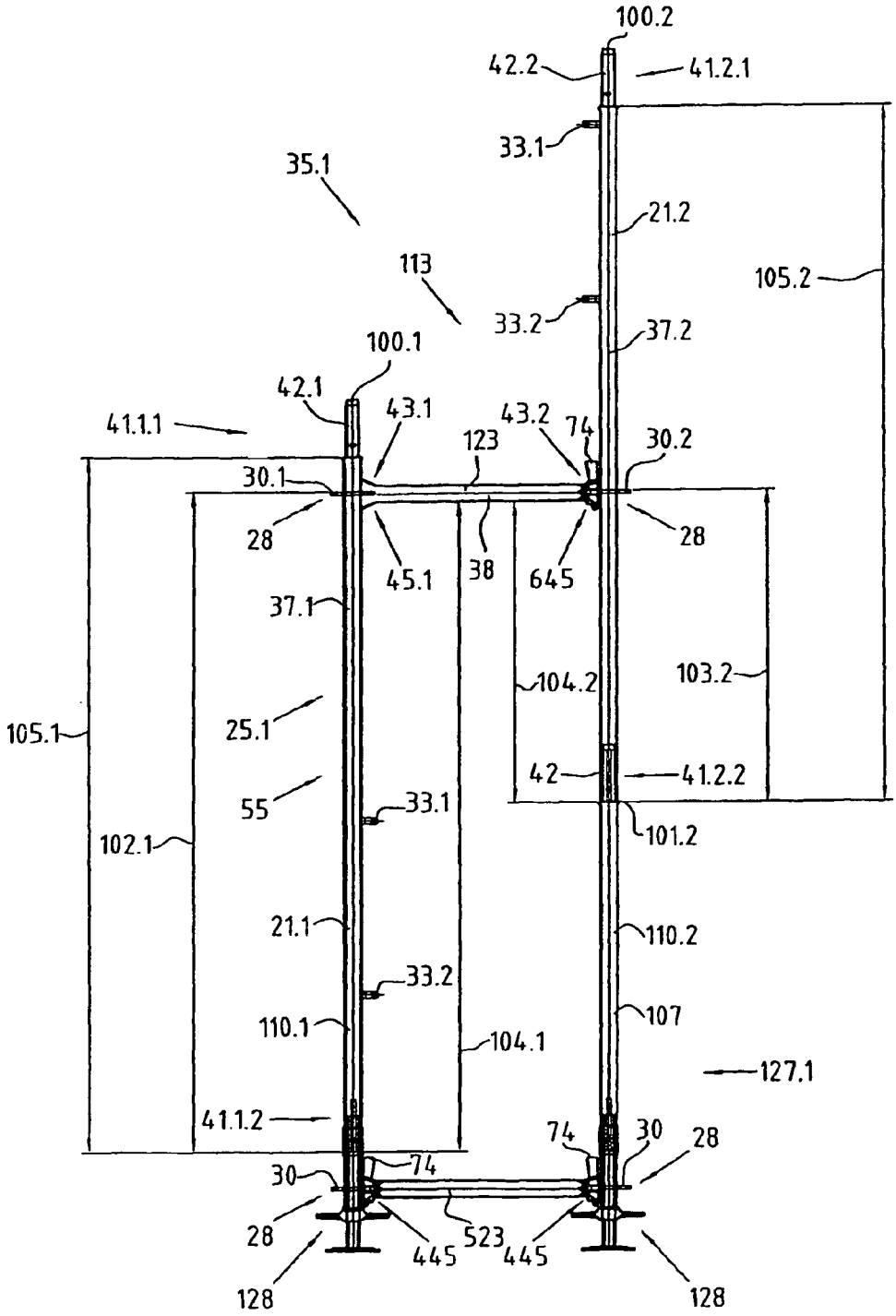
Figure 4:
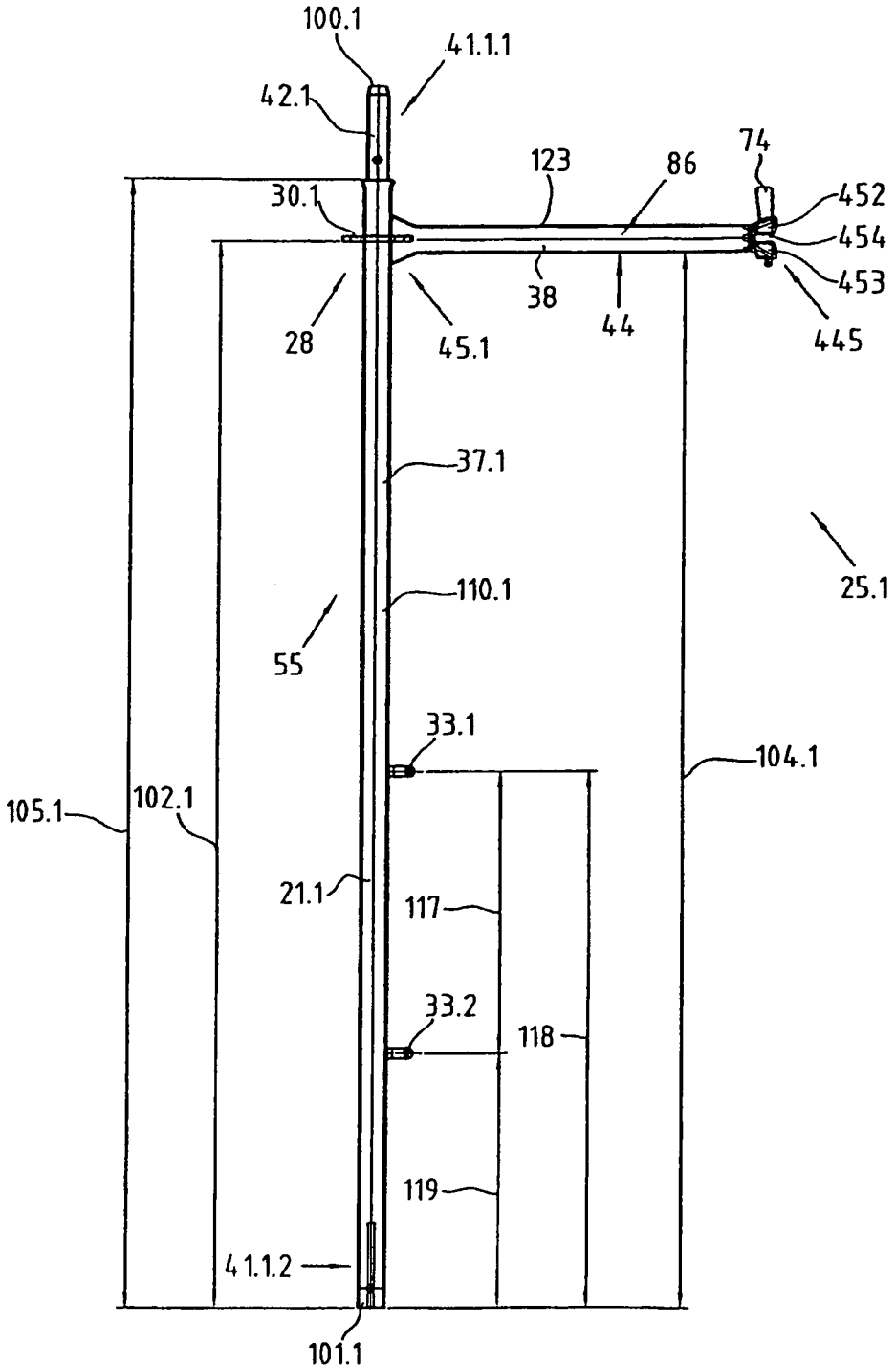
Figure 5:
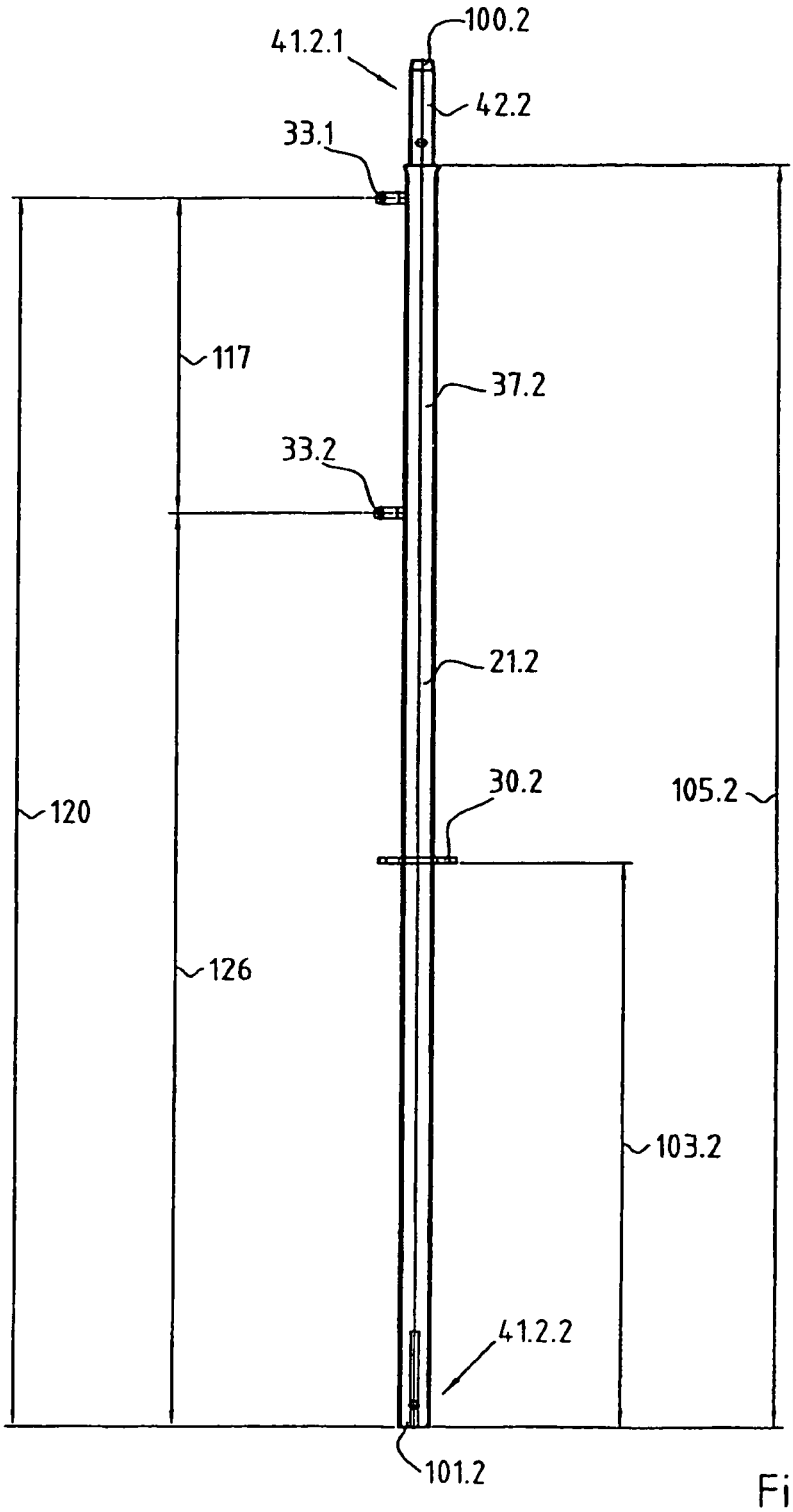
Figure 6:
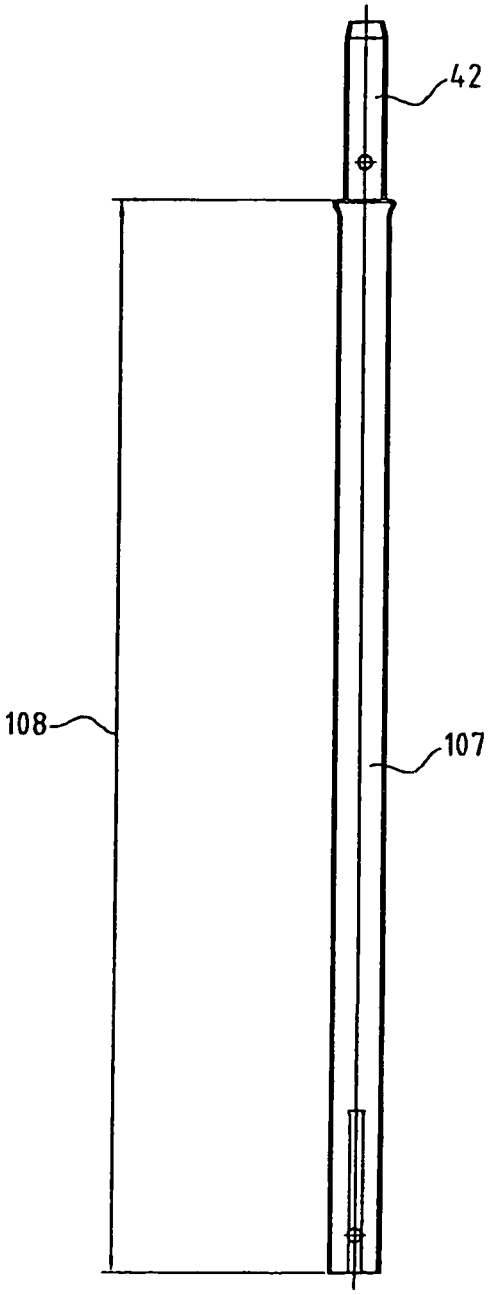
Figure 7:
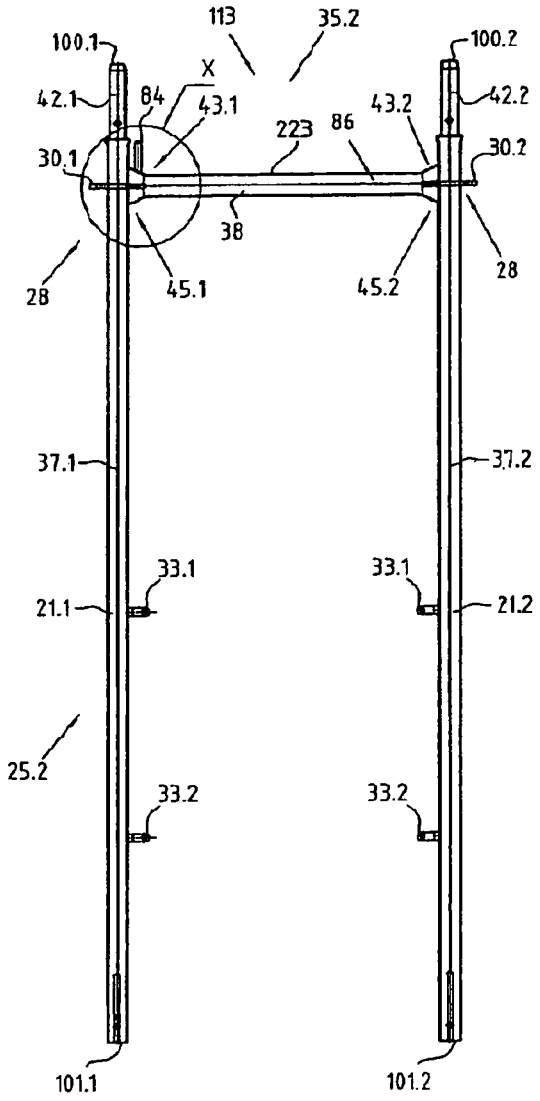
Figure 8:
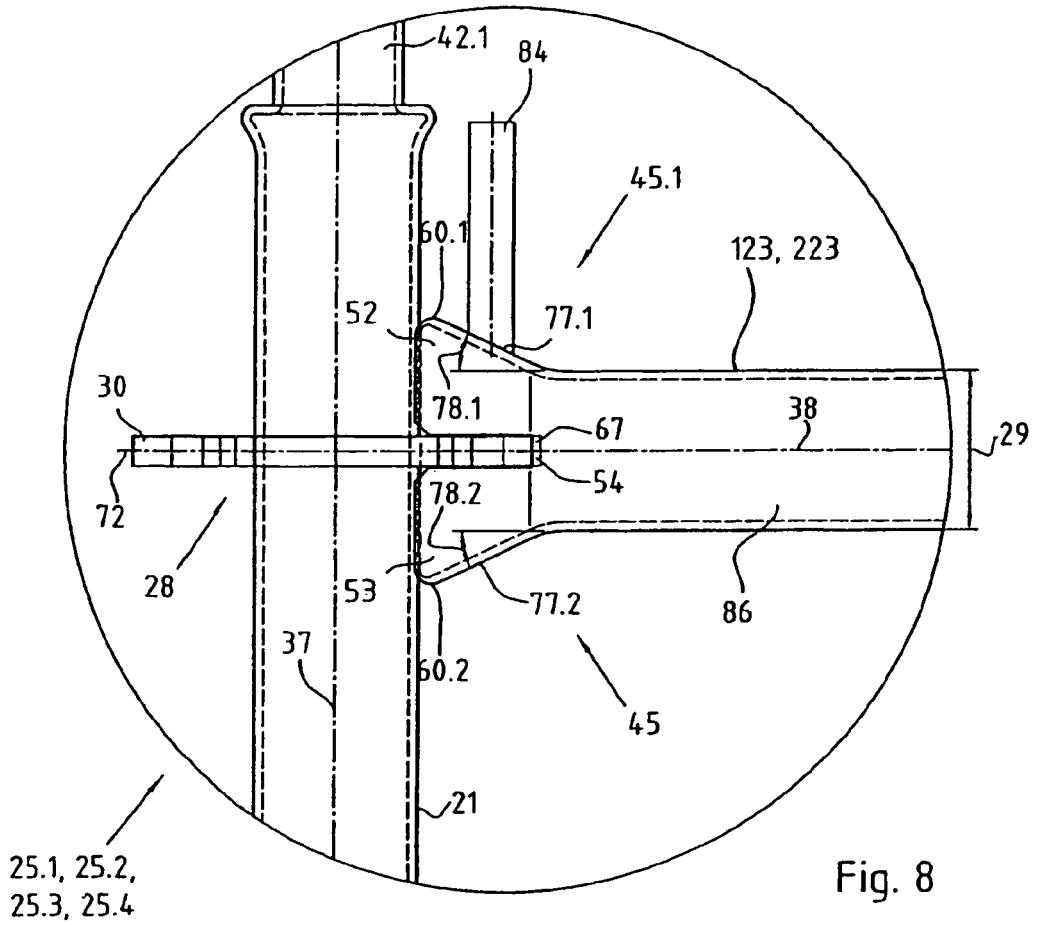
Figure 9:
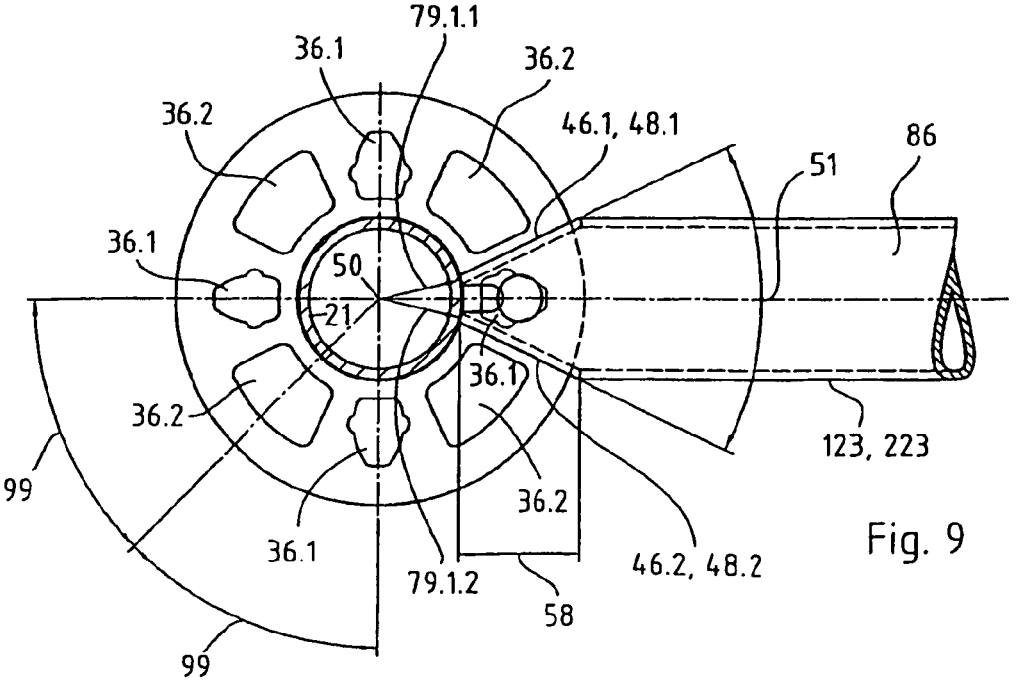
Figure 10:
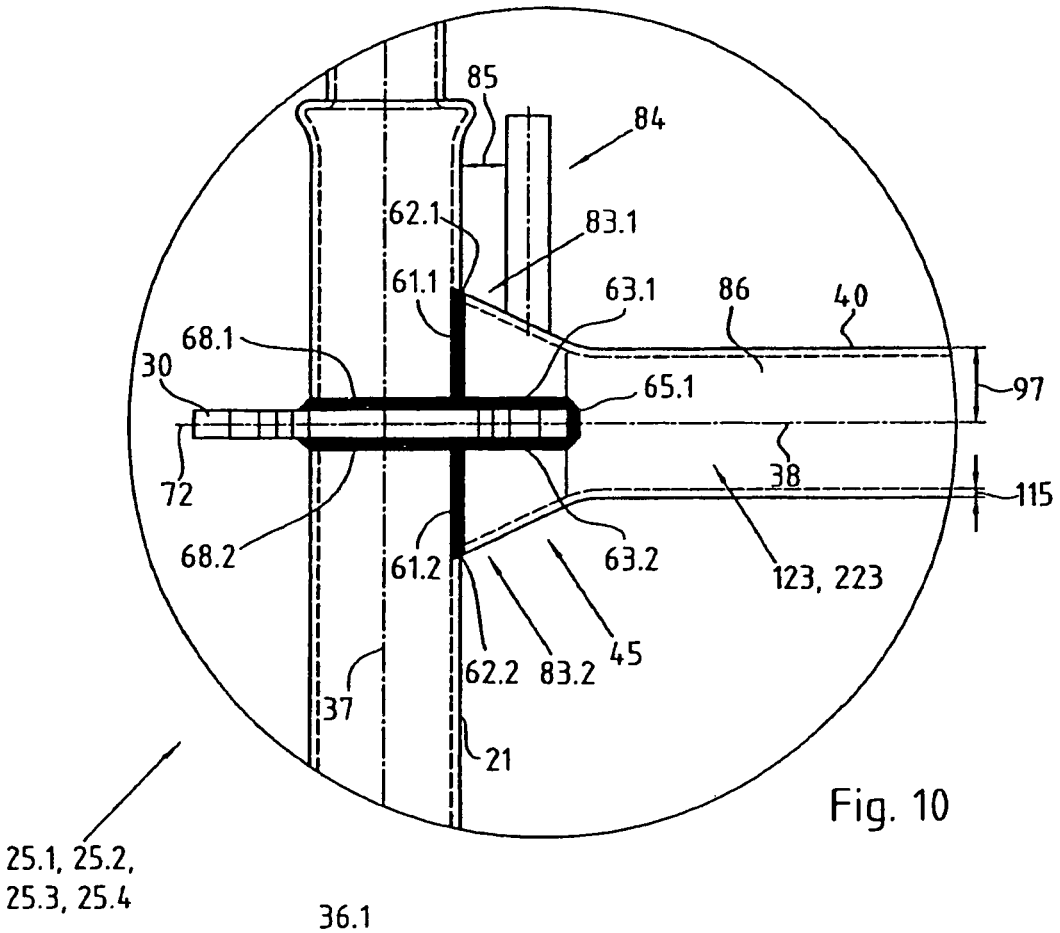
Figure 11:
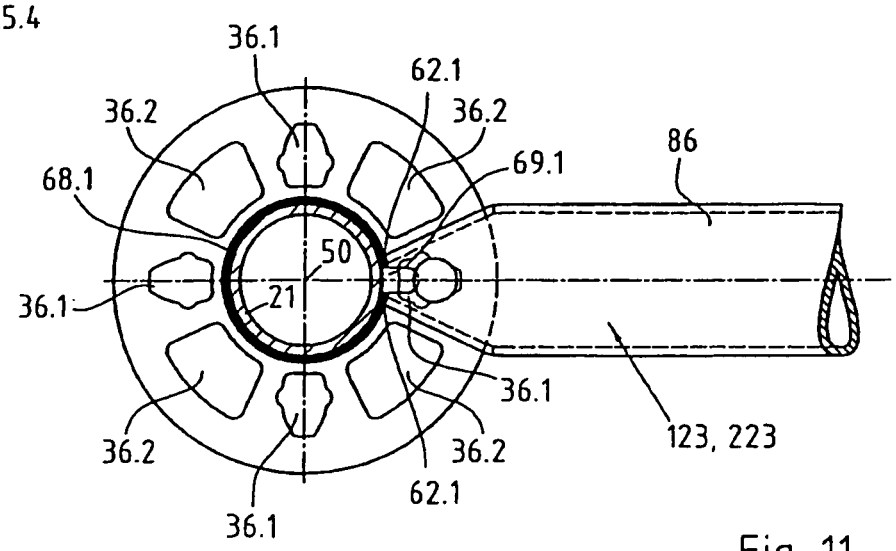
Figure 12:
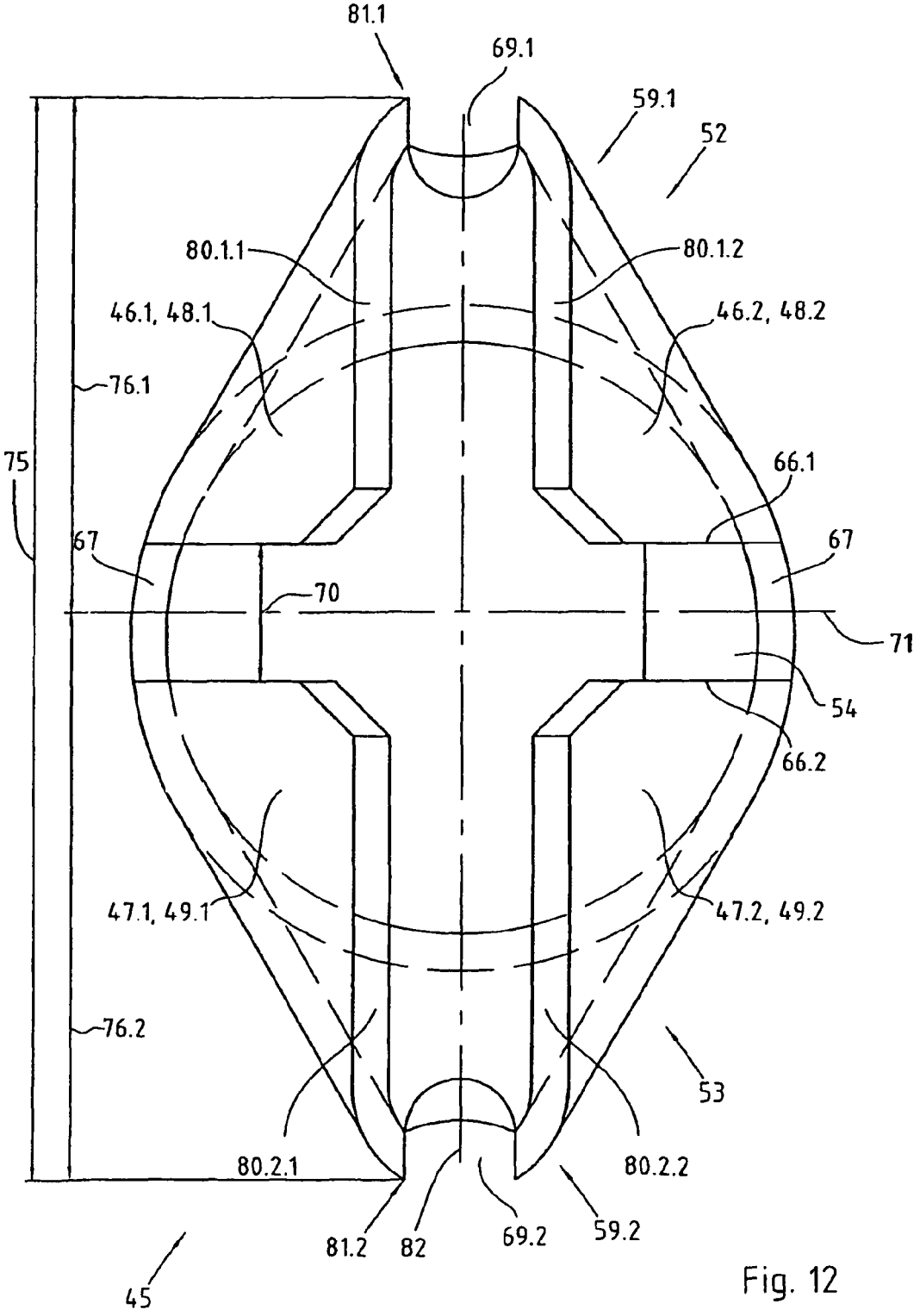
Figure 13:
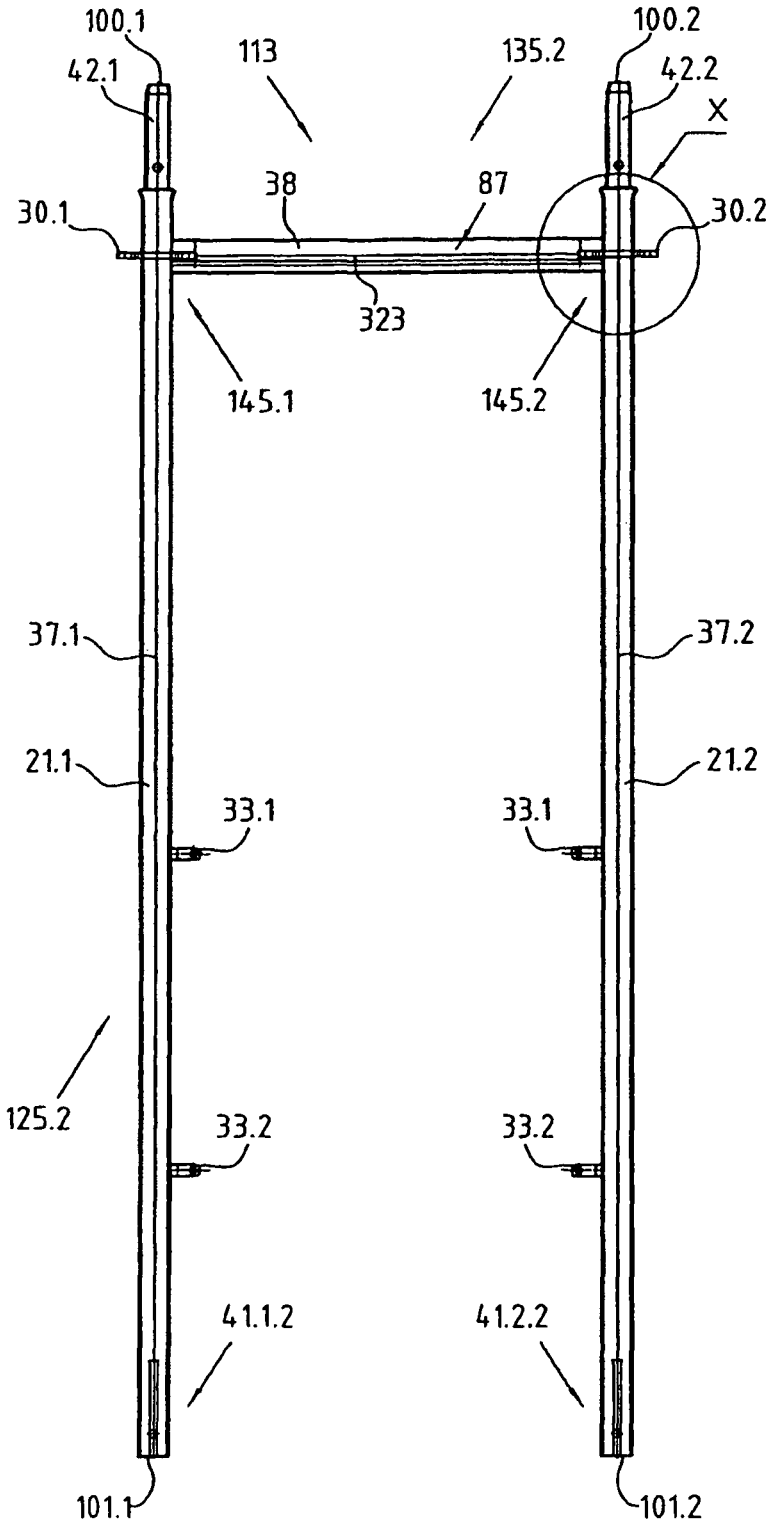
Figure 14:
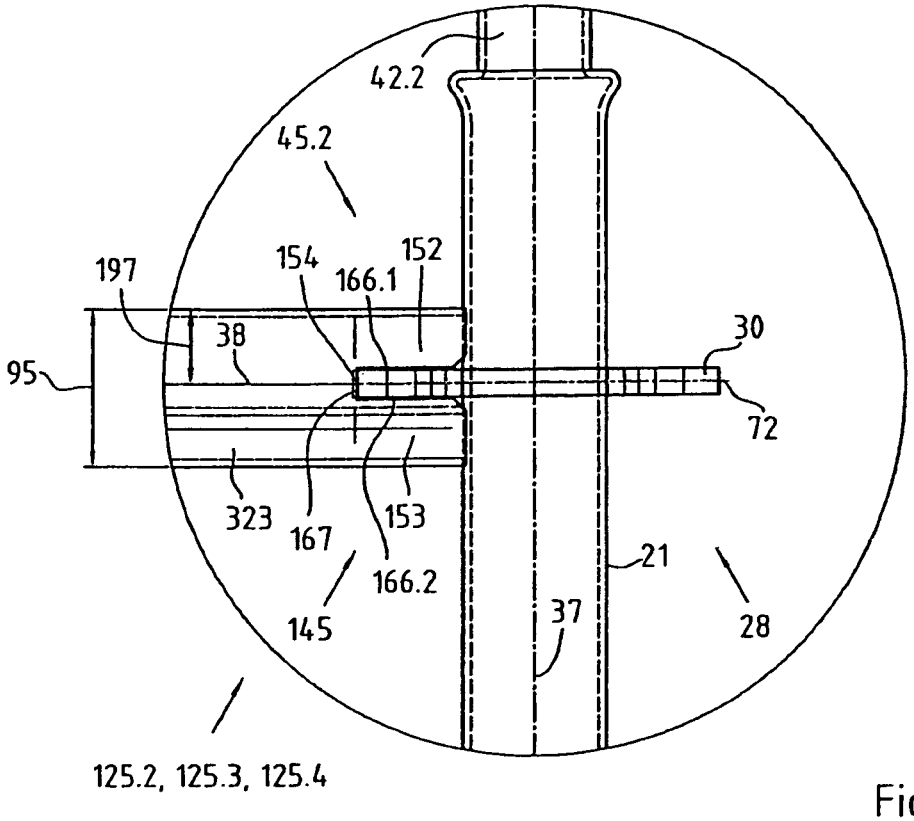
Figure 15:
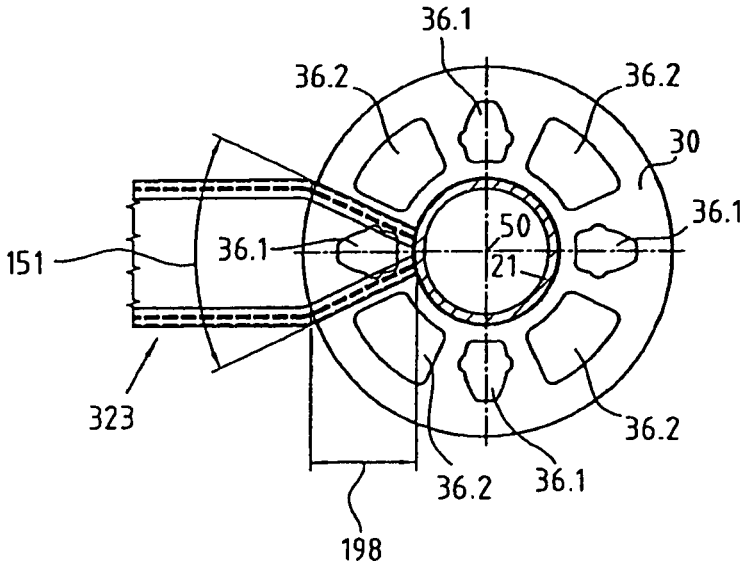
Figure 16:
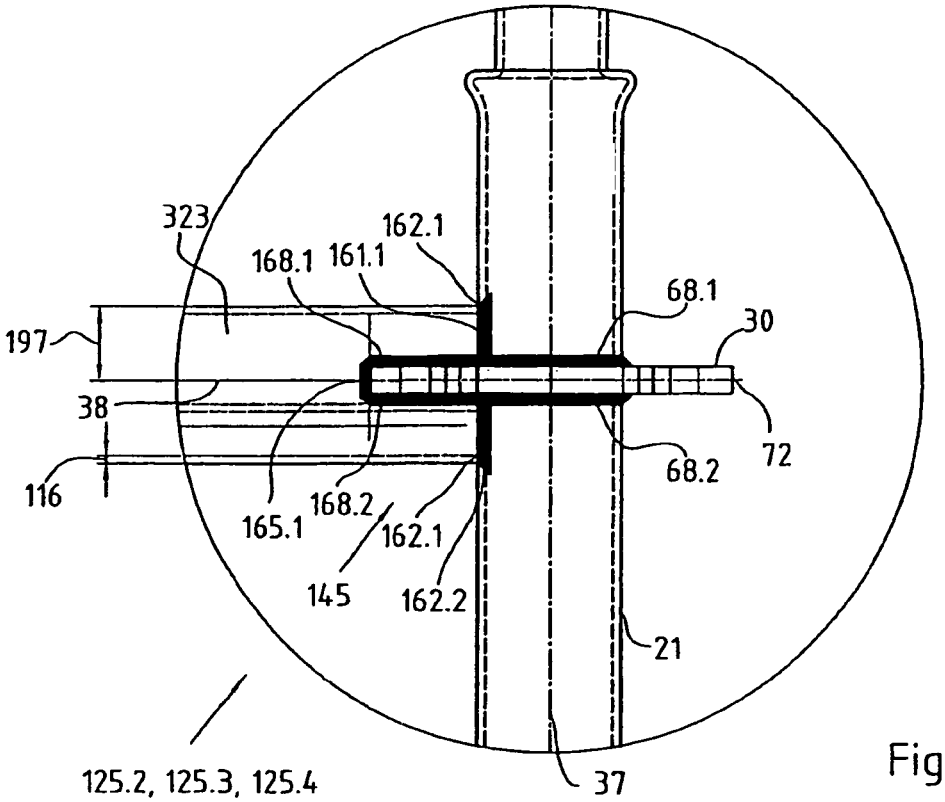
Figure 17:
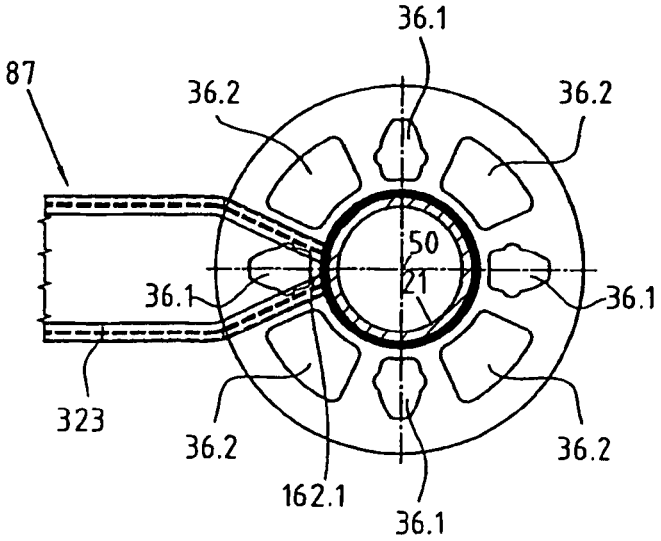
Figure 18:
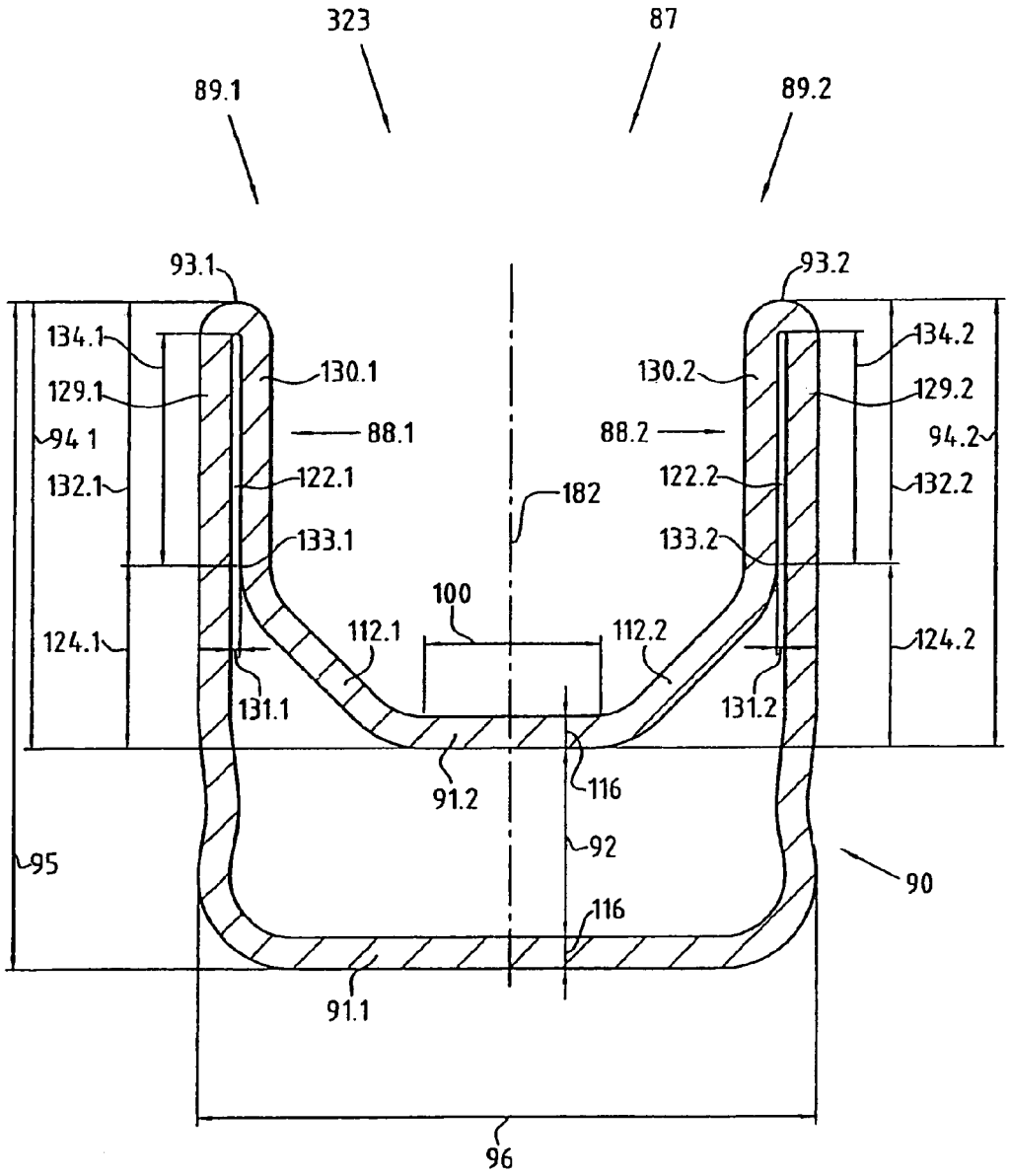
Figure 19:
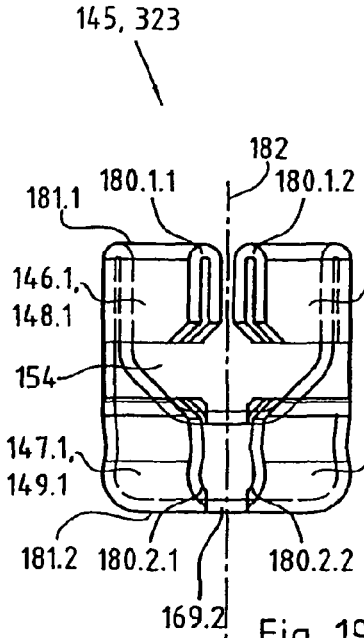
Figure 20:
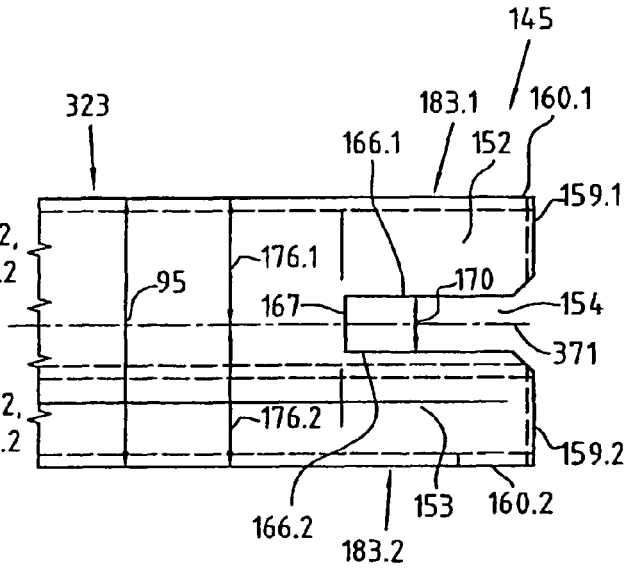
Figure 21:
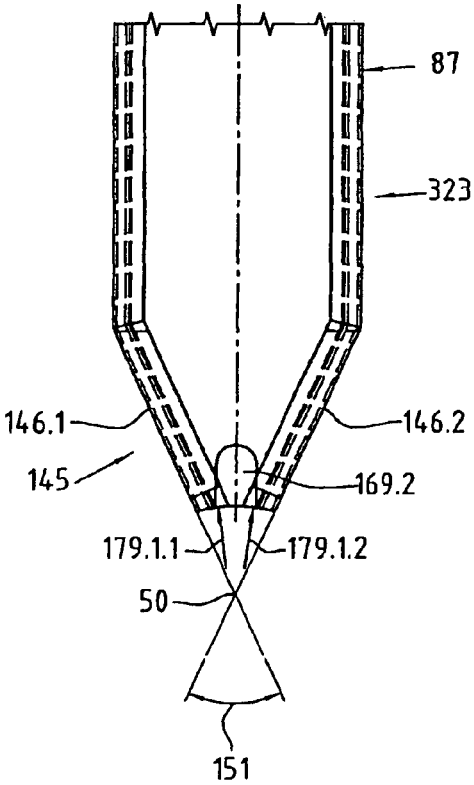
Figure 22:
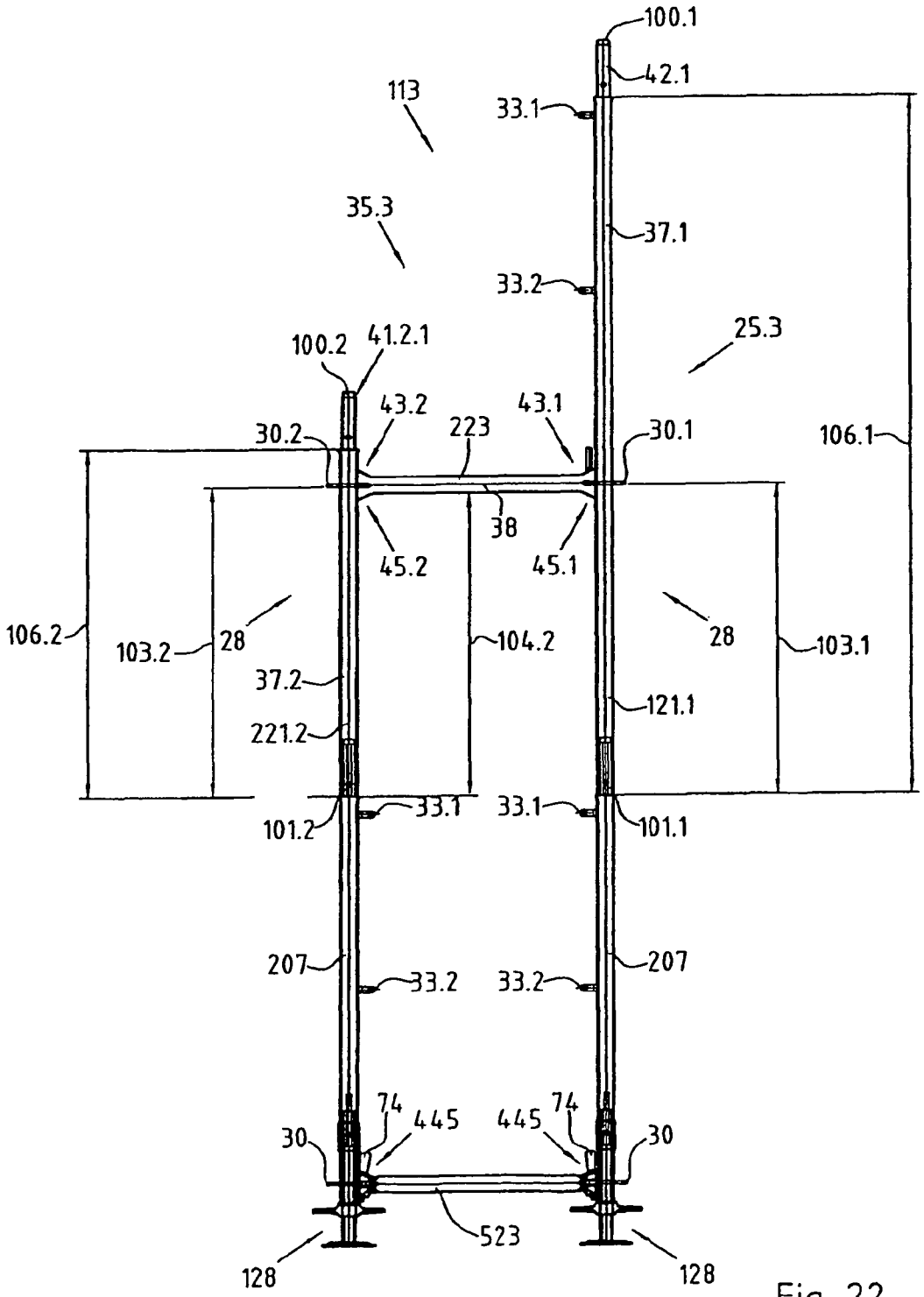
Figure 23:
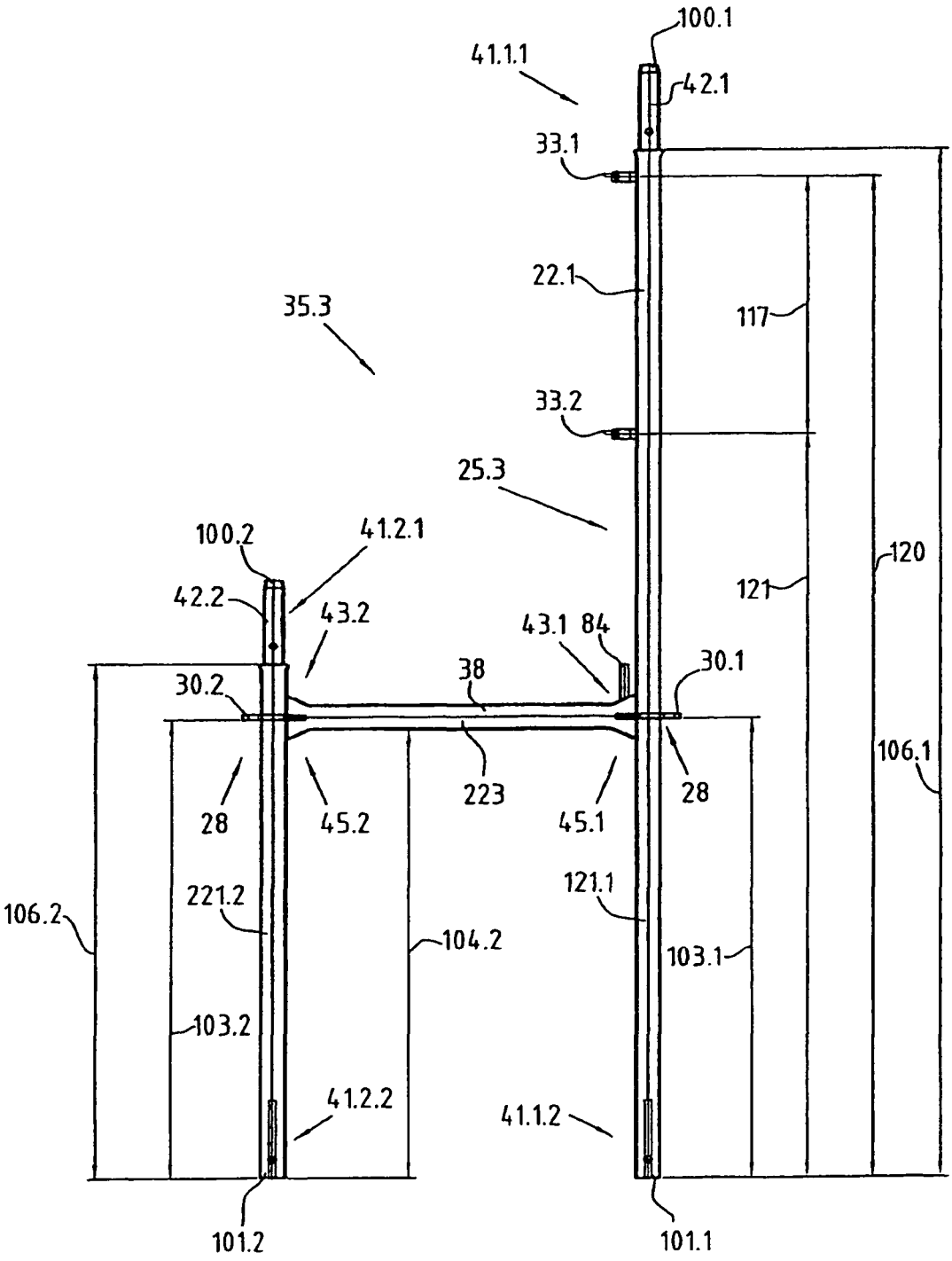
Figure 24:
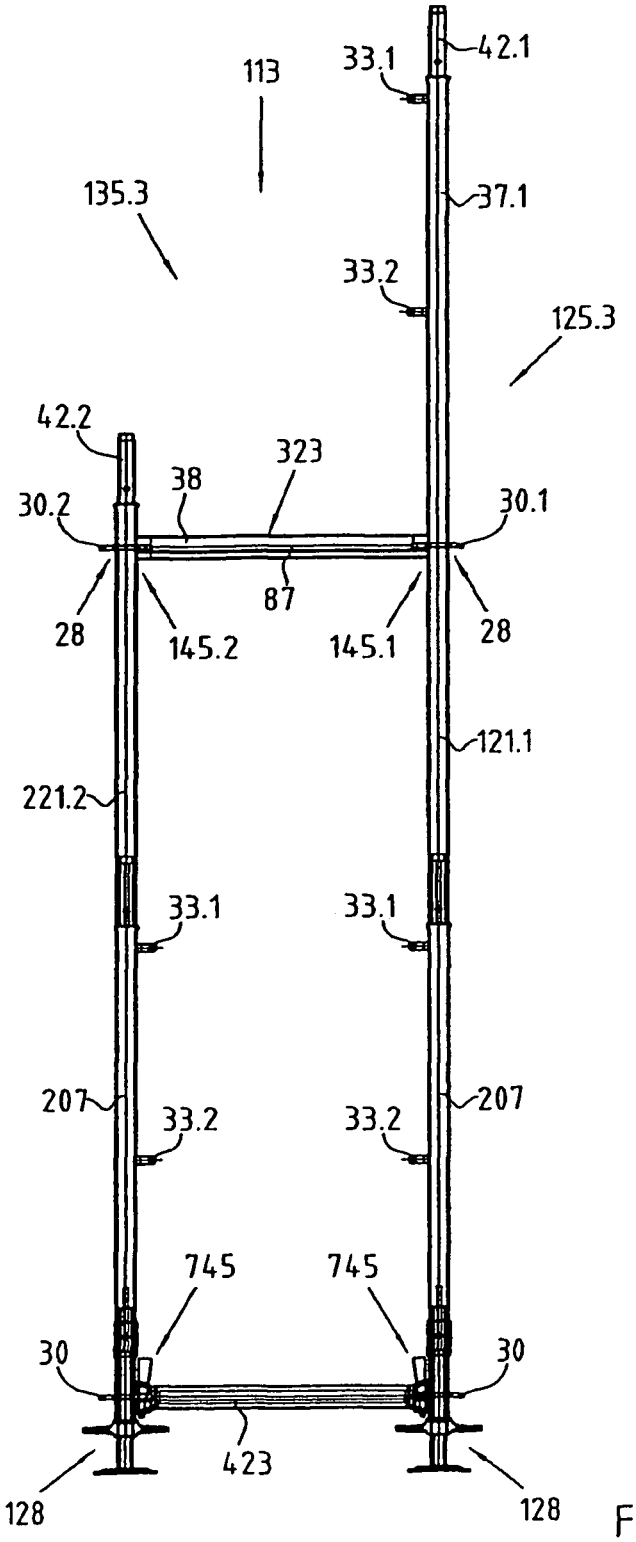
Figure 25:
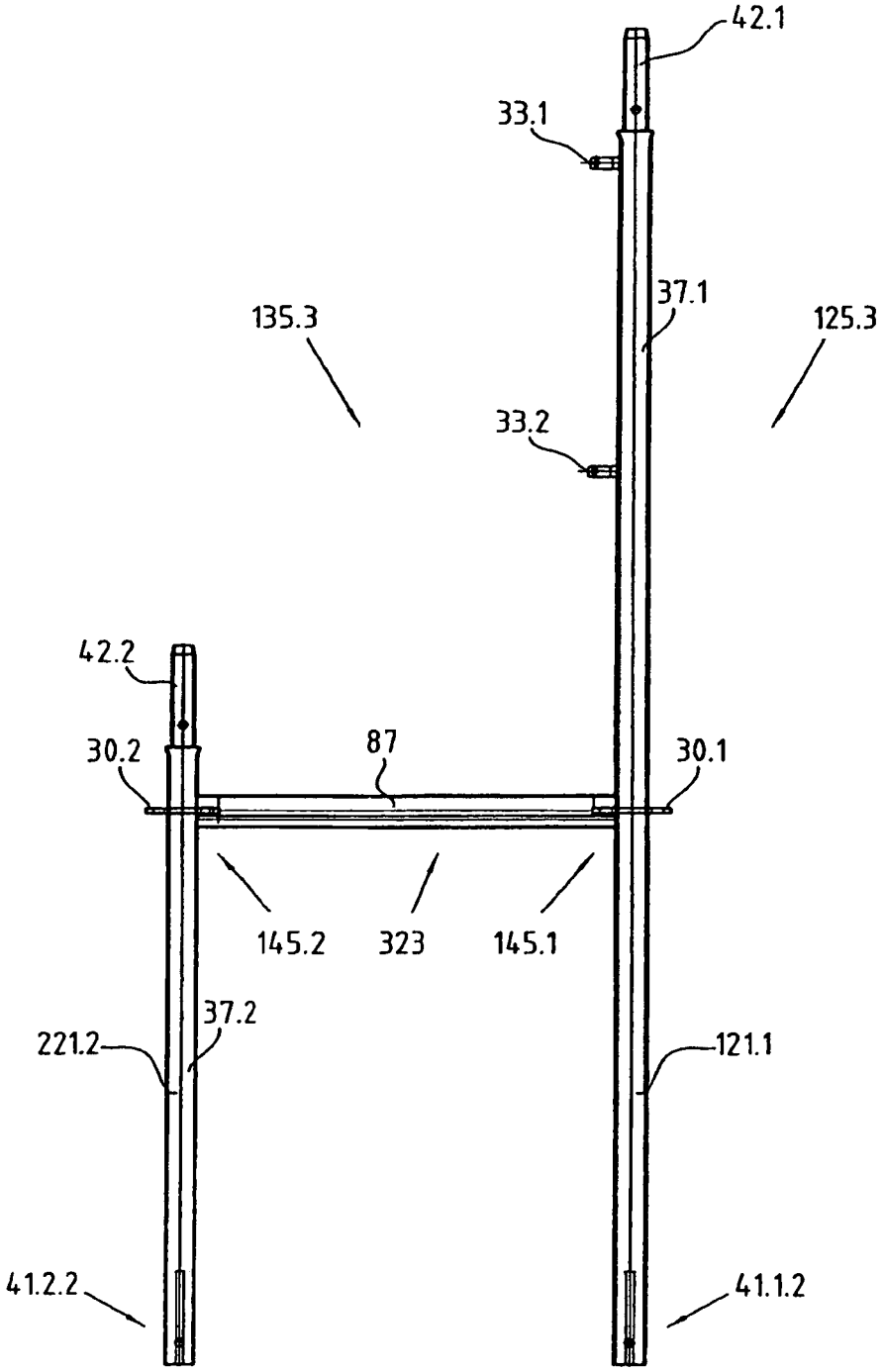
Figure 26:
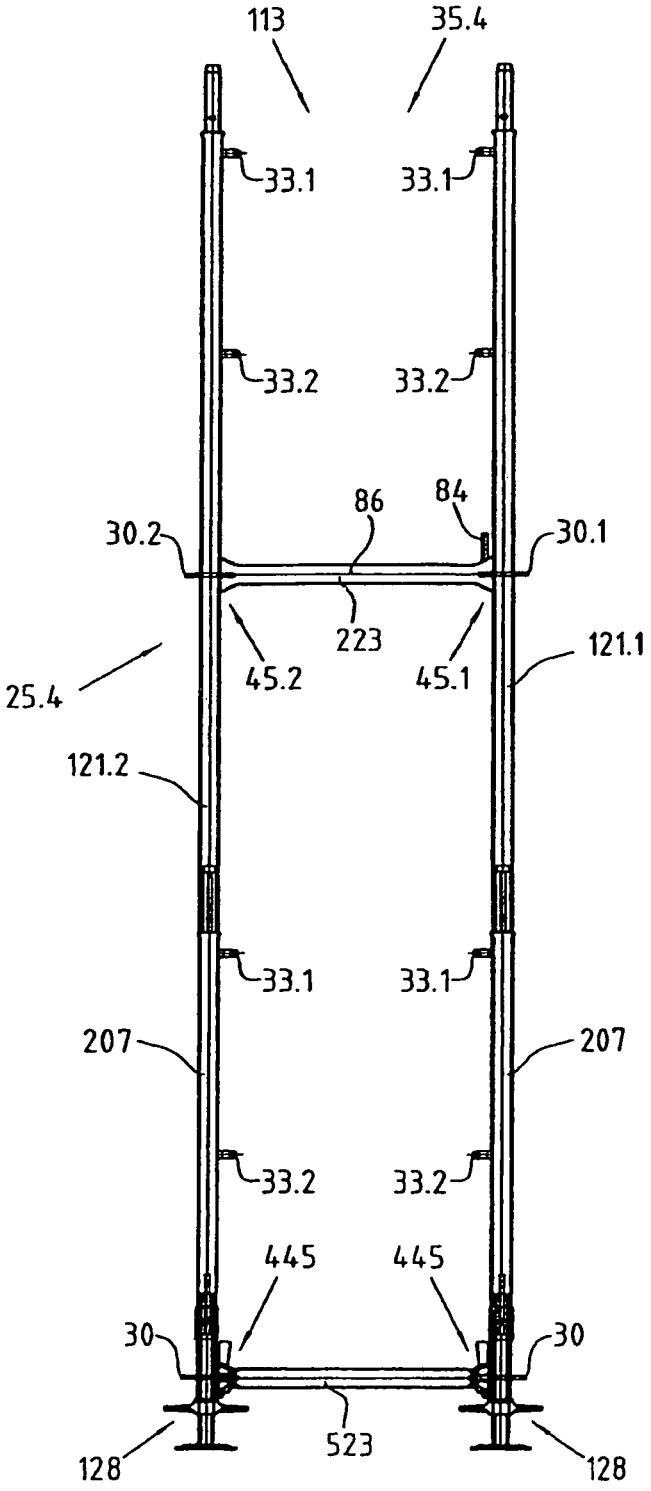
Figure 27:
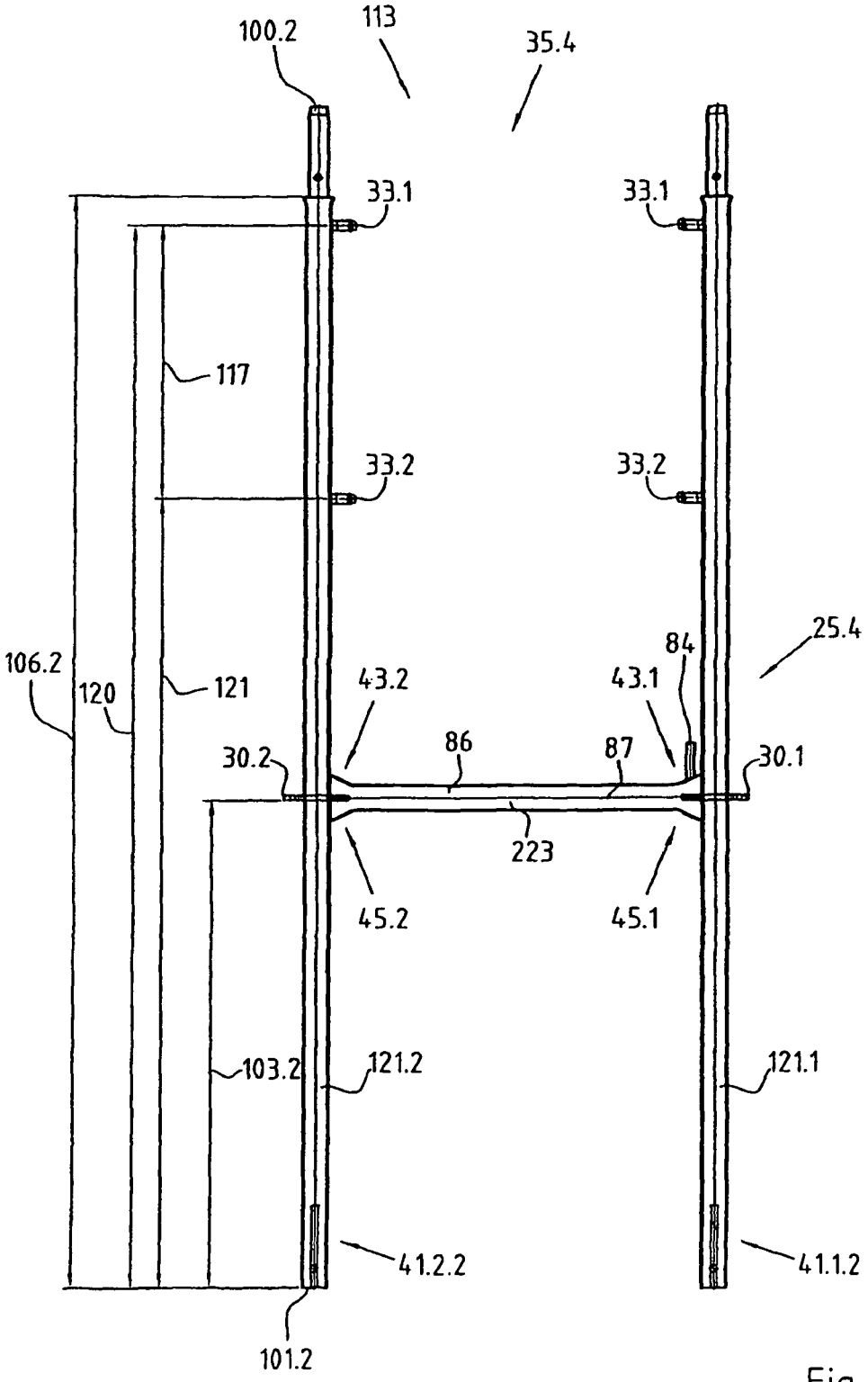
Figure 28:
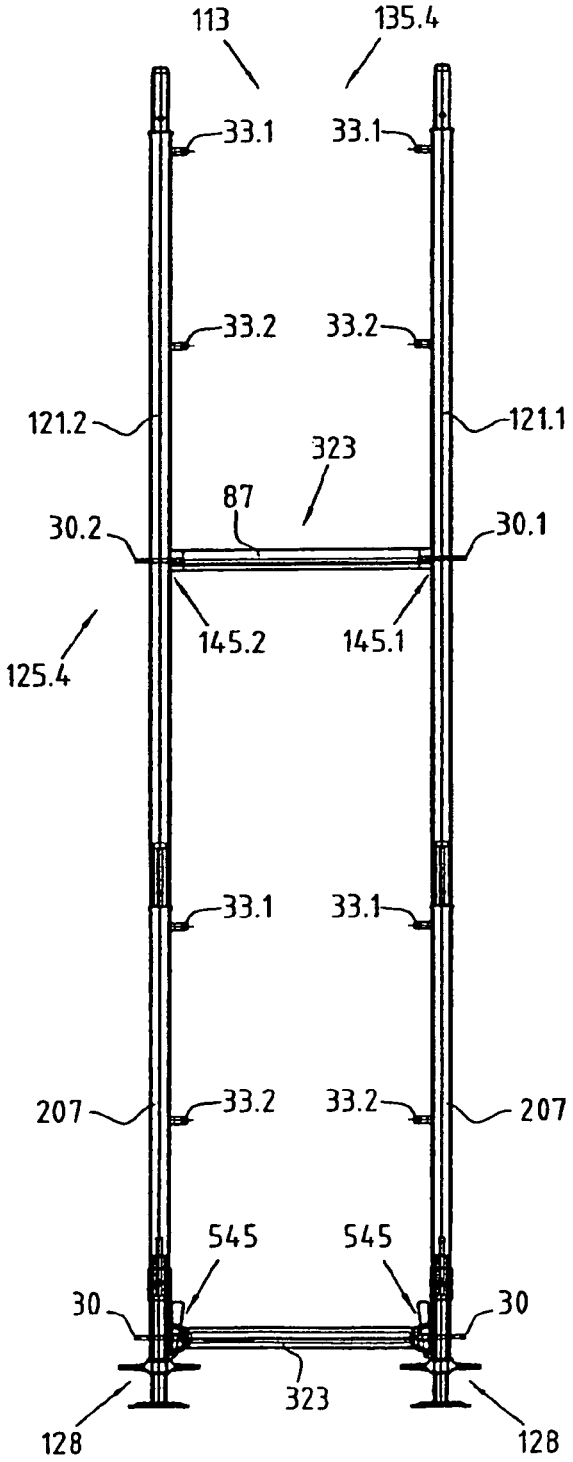
Figure 29:
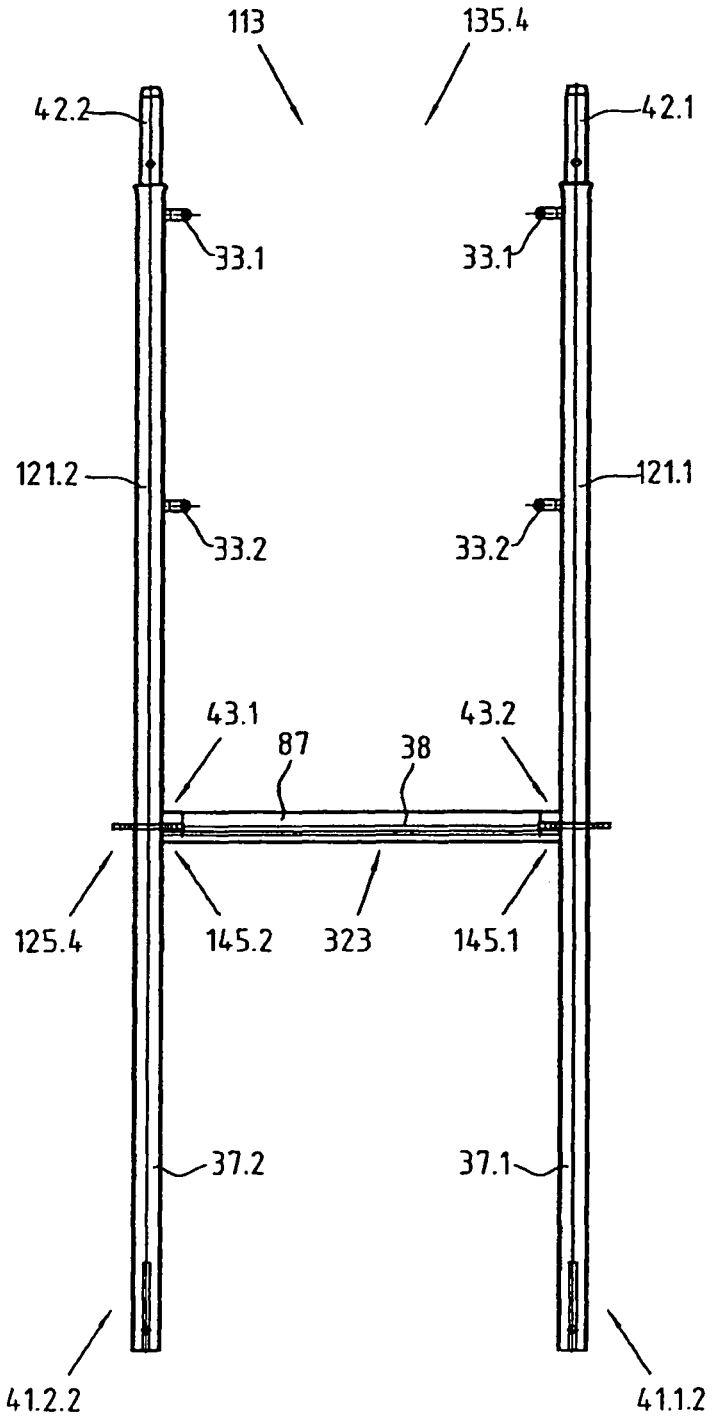
Figure 30:
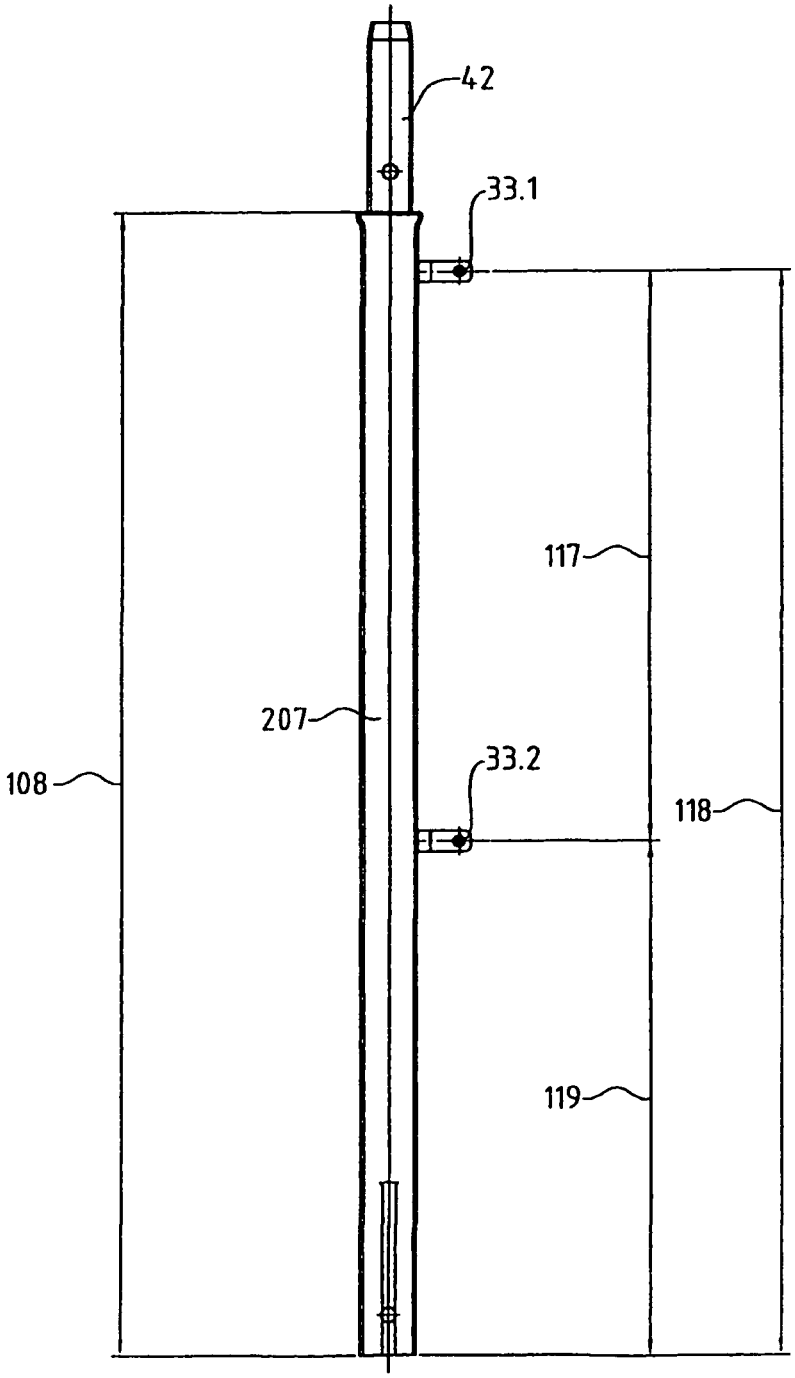
Figure 31:
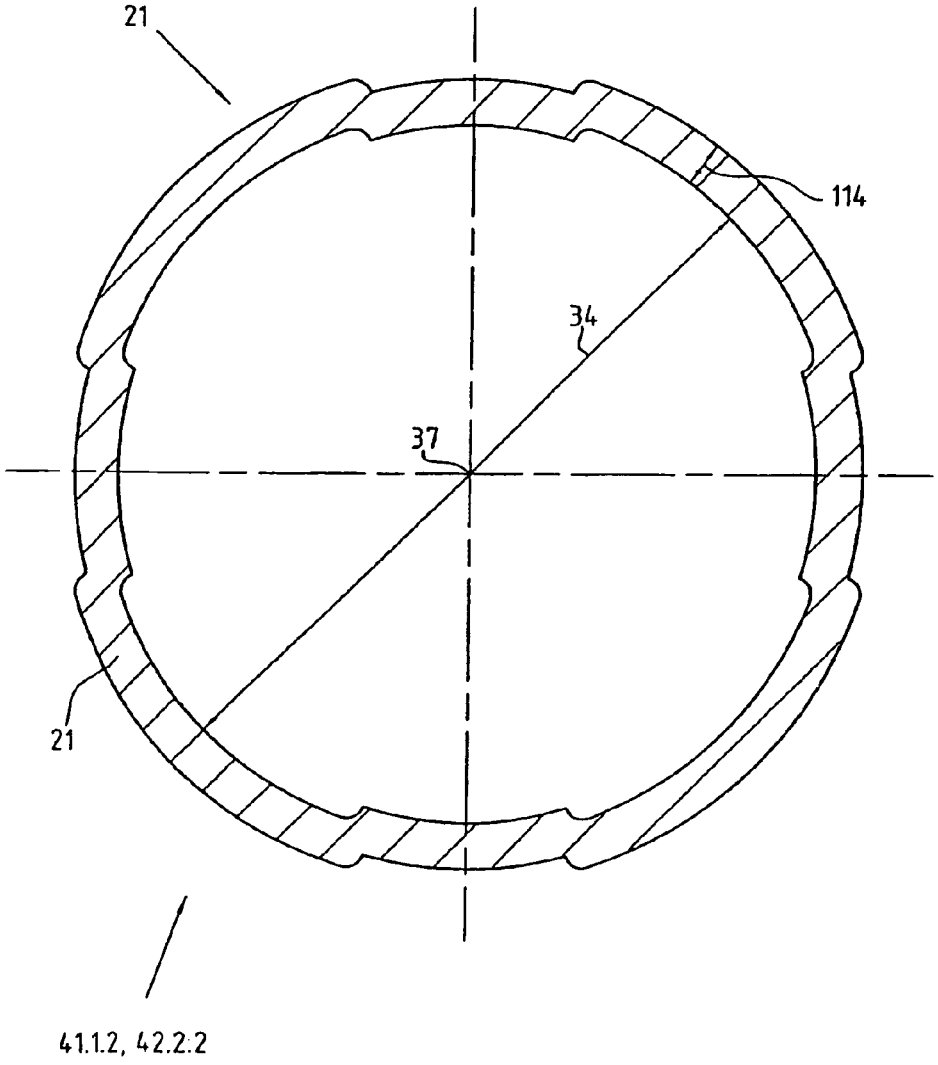
Figure 32:
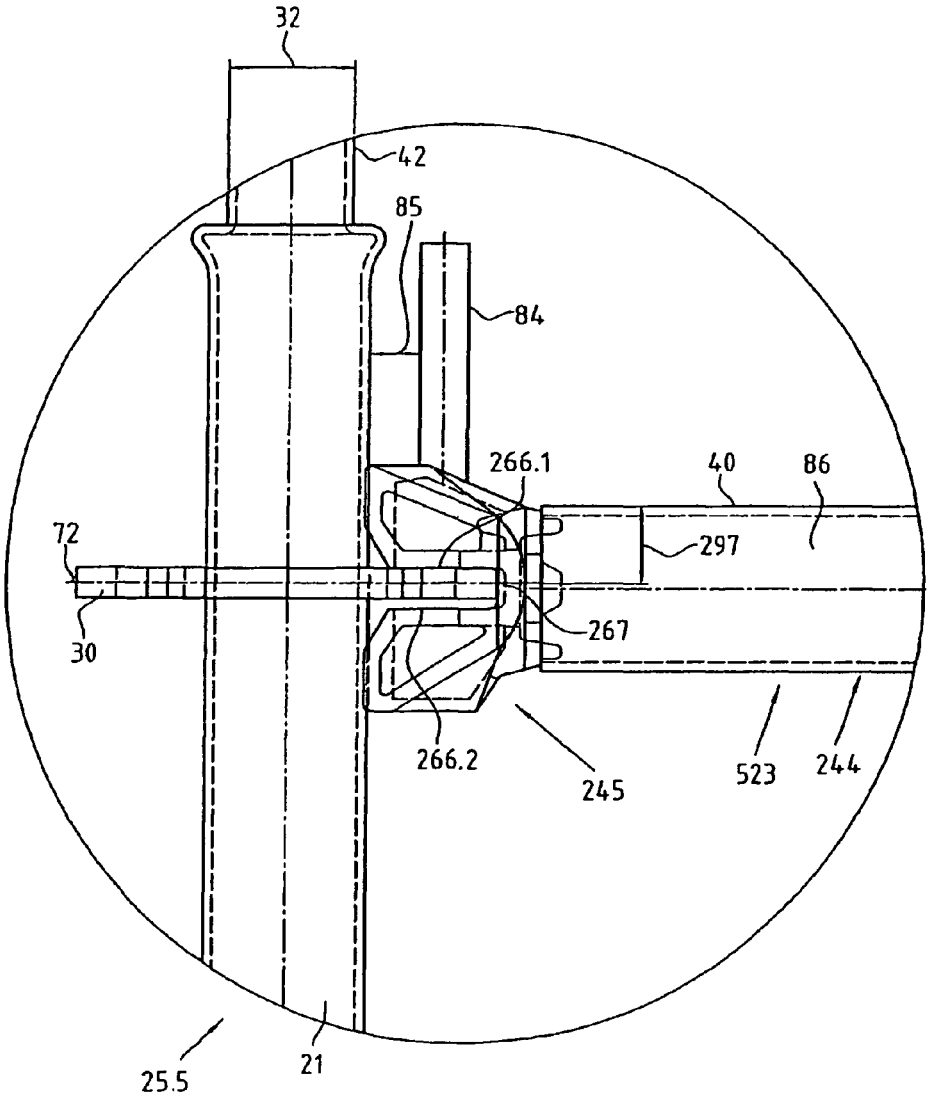
Figure 33:
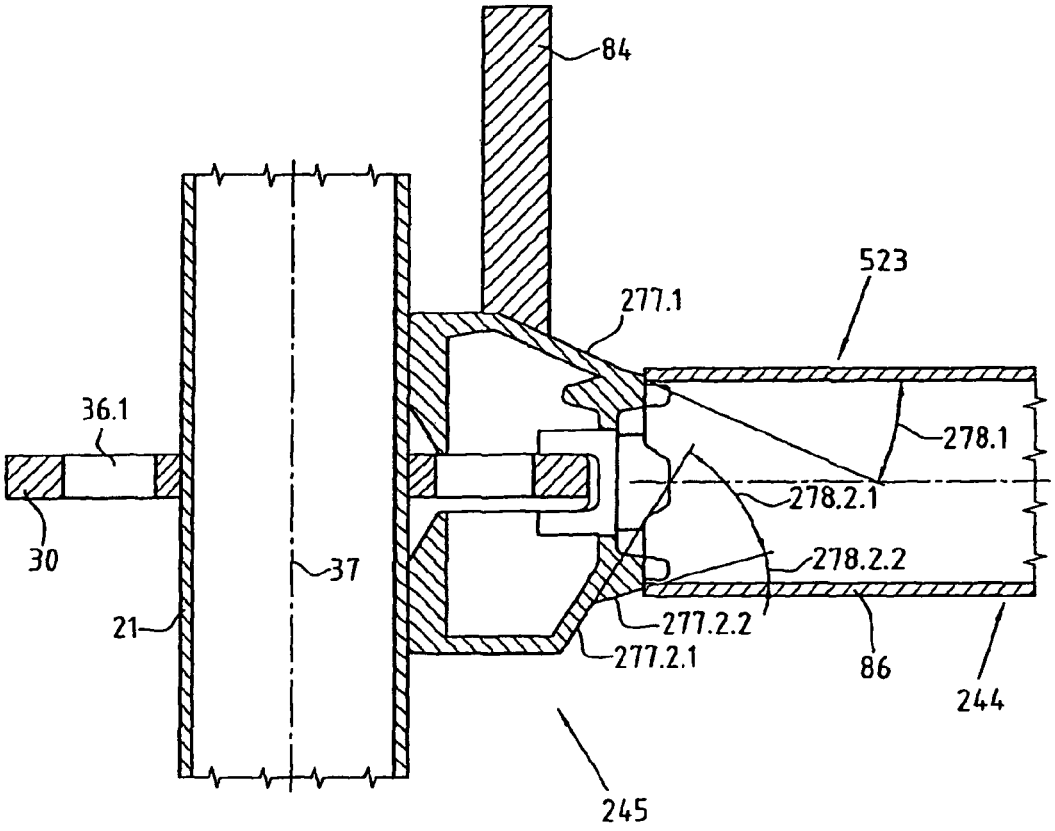
Figure 34:
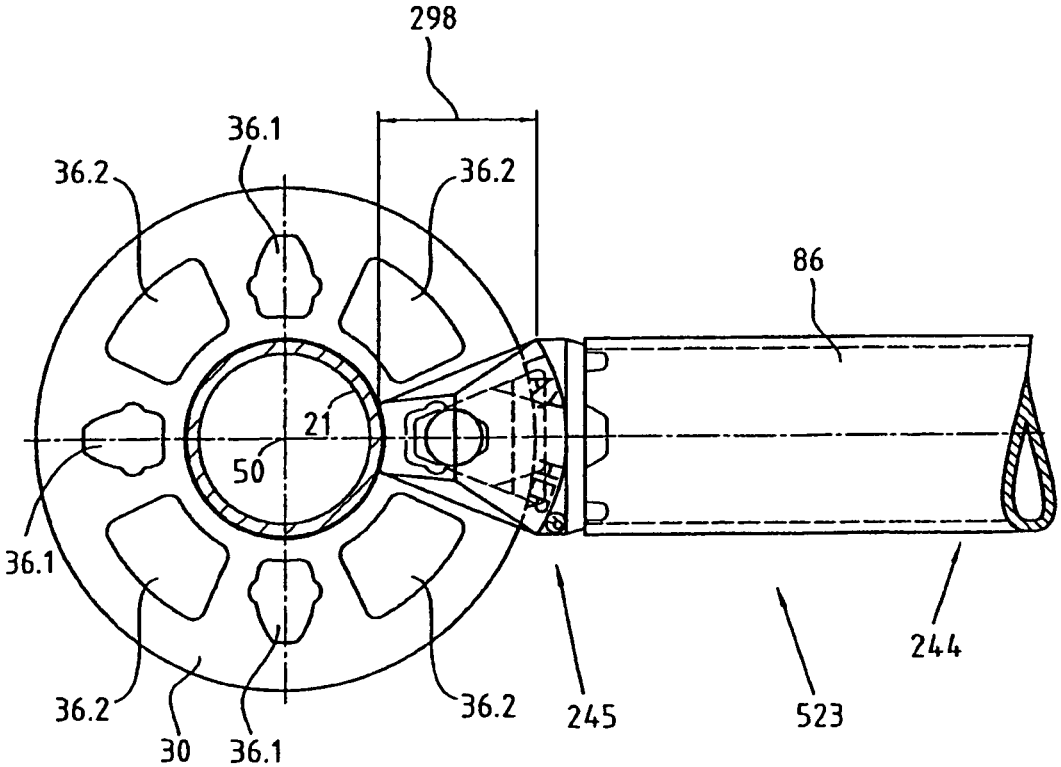
Figure 35:
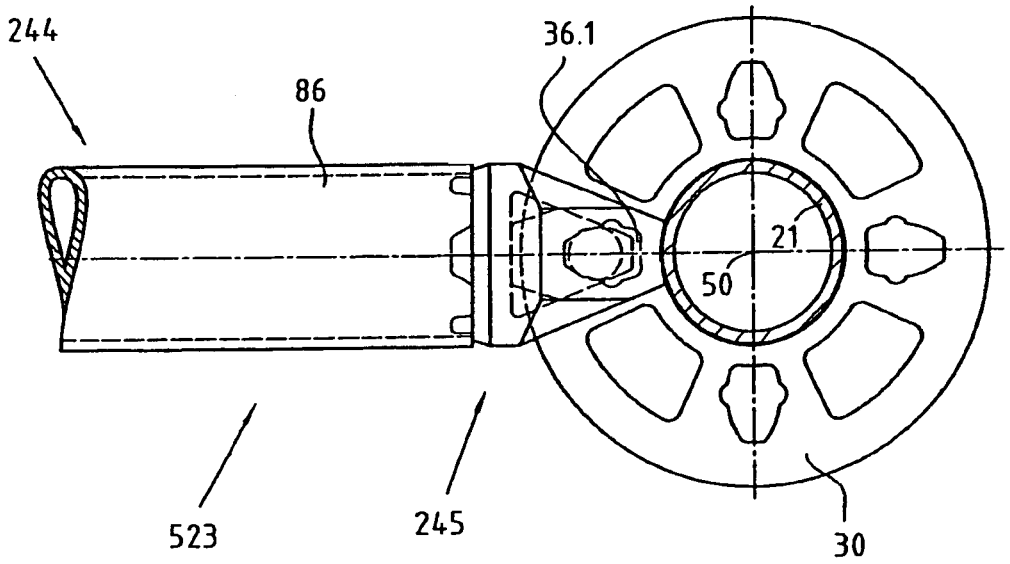
Figure 36:
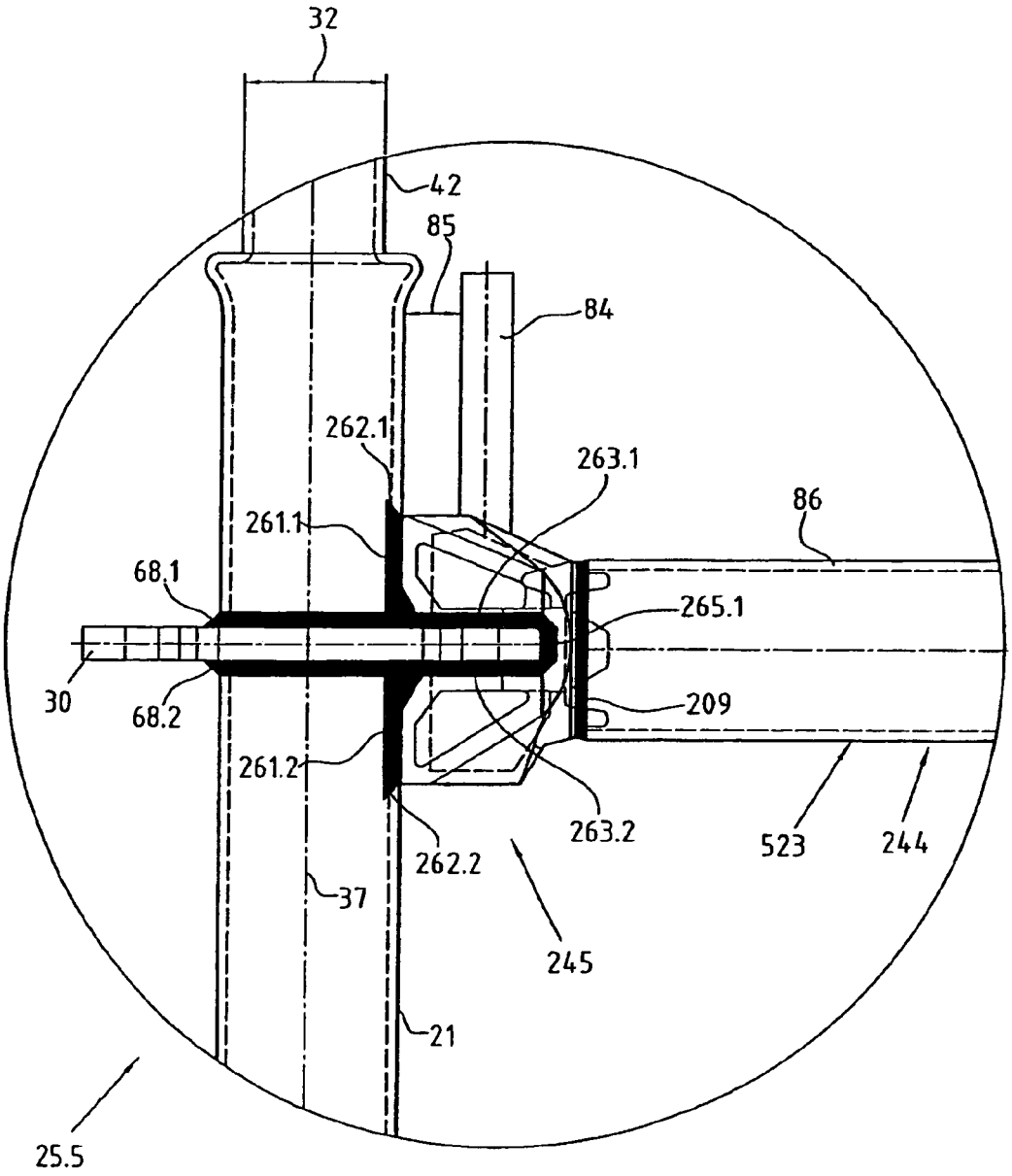
Figure 37:
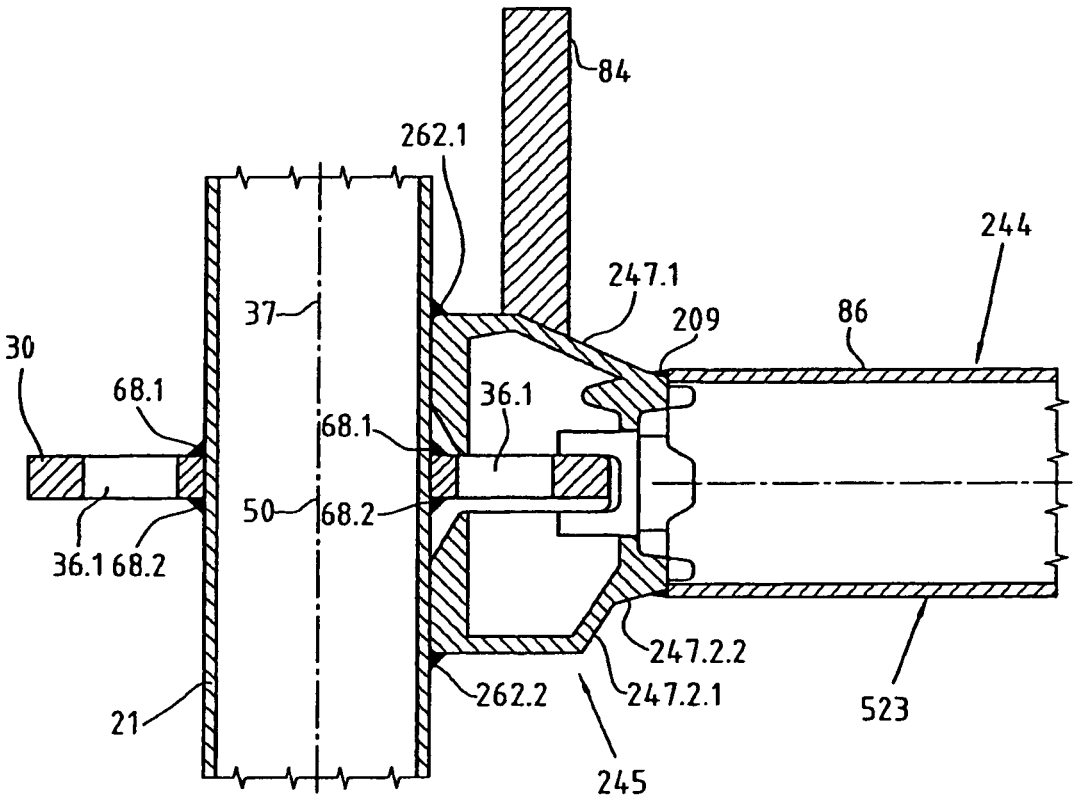
Figure 38:
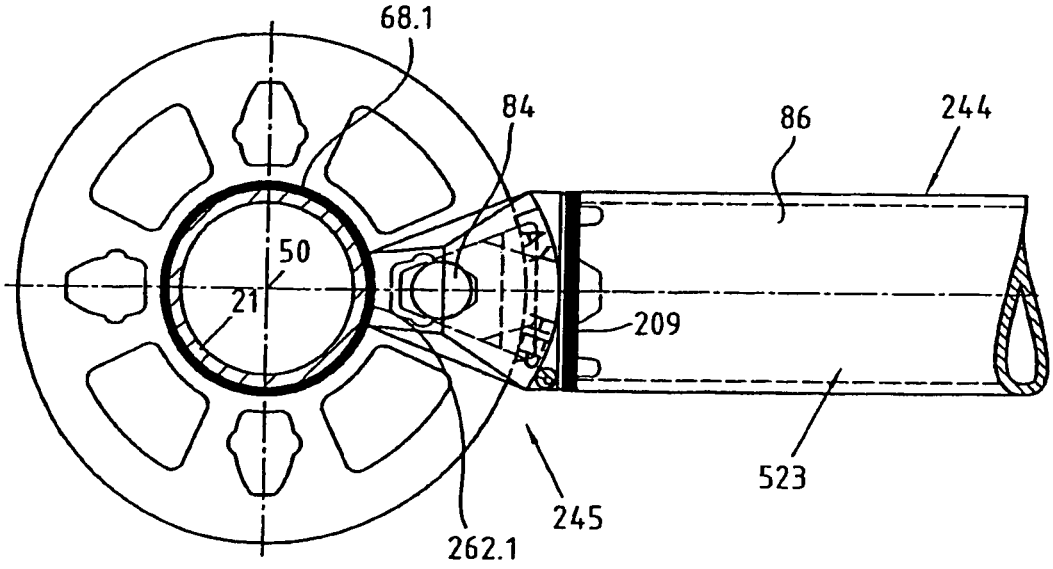
Figure 39:
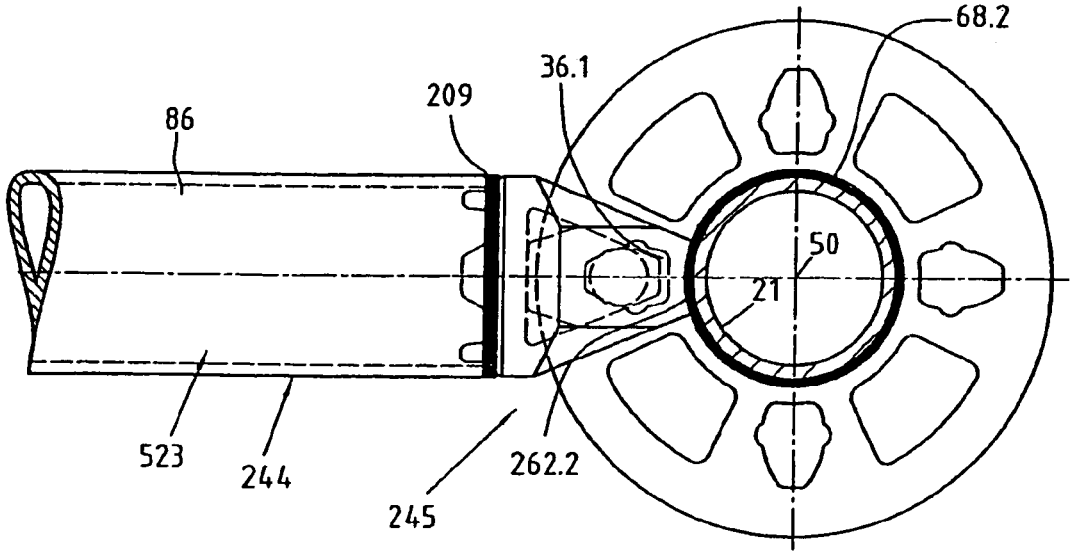
Figure 40:
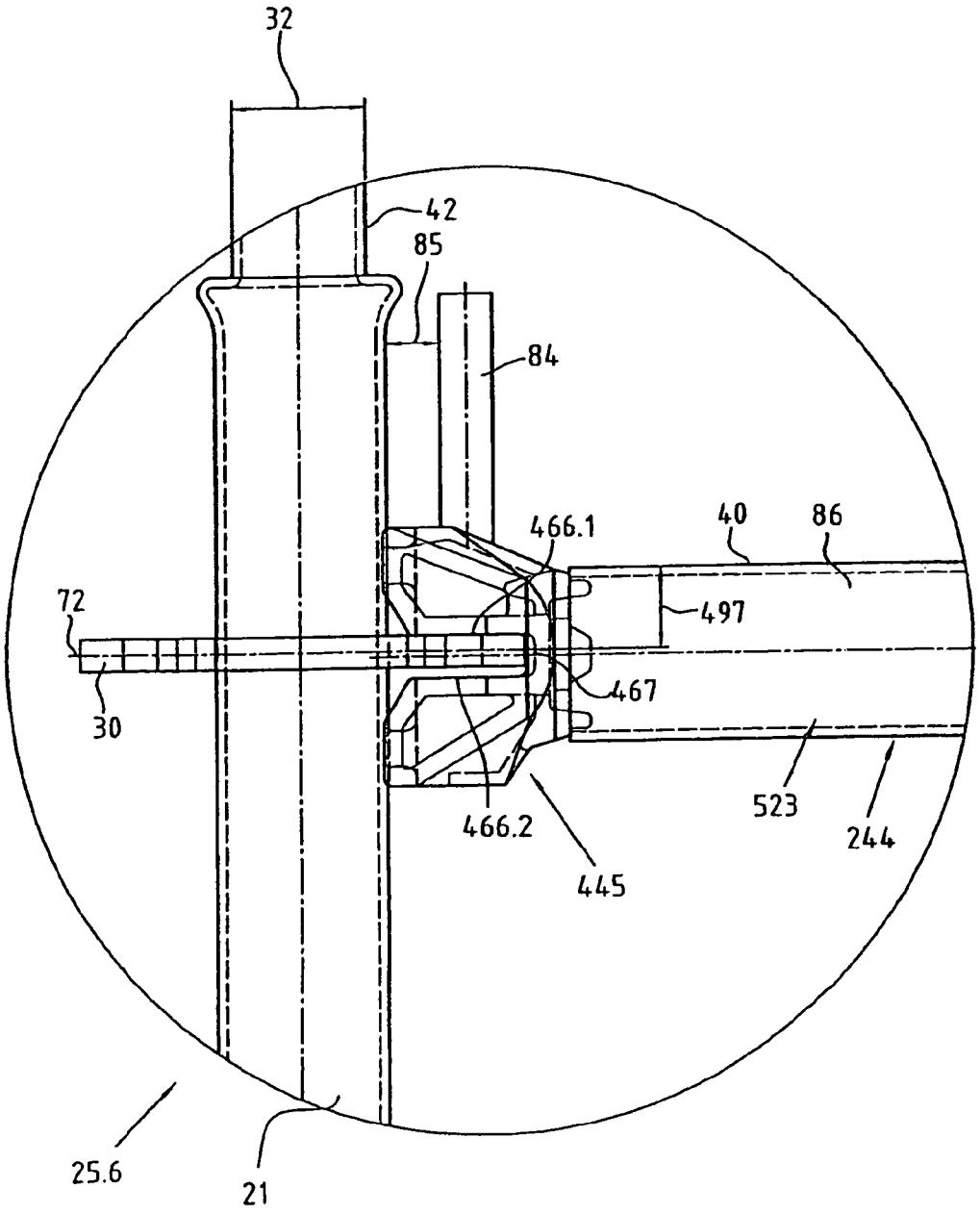
Figure 41:
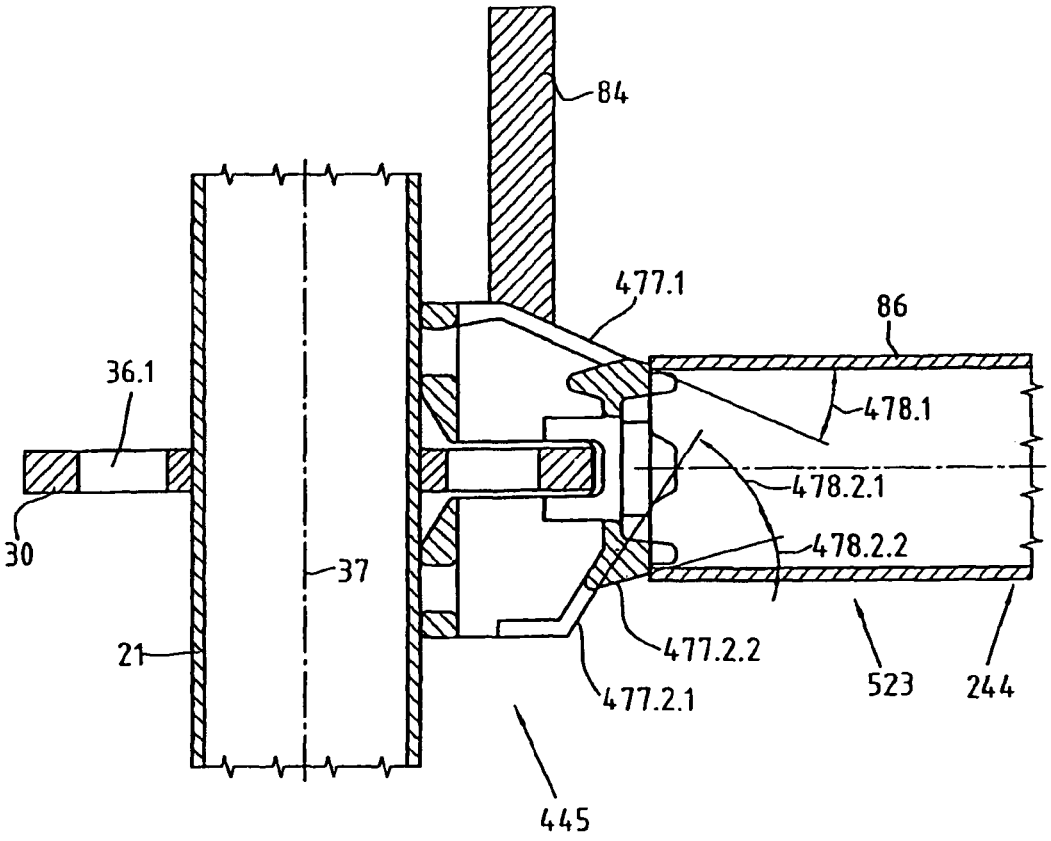
Figure 42:
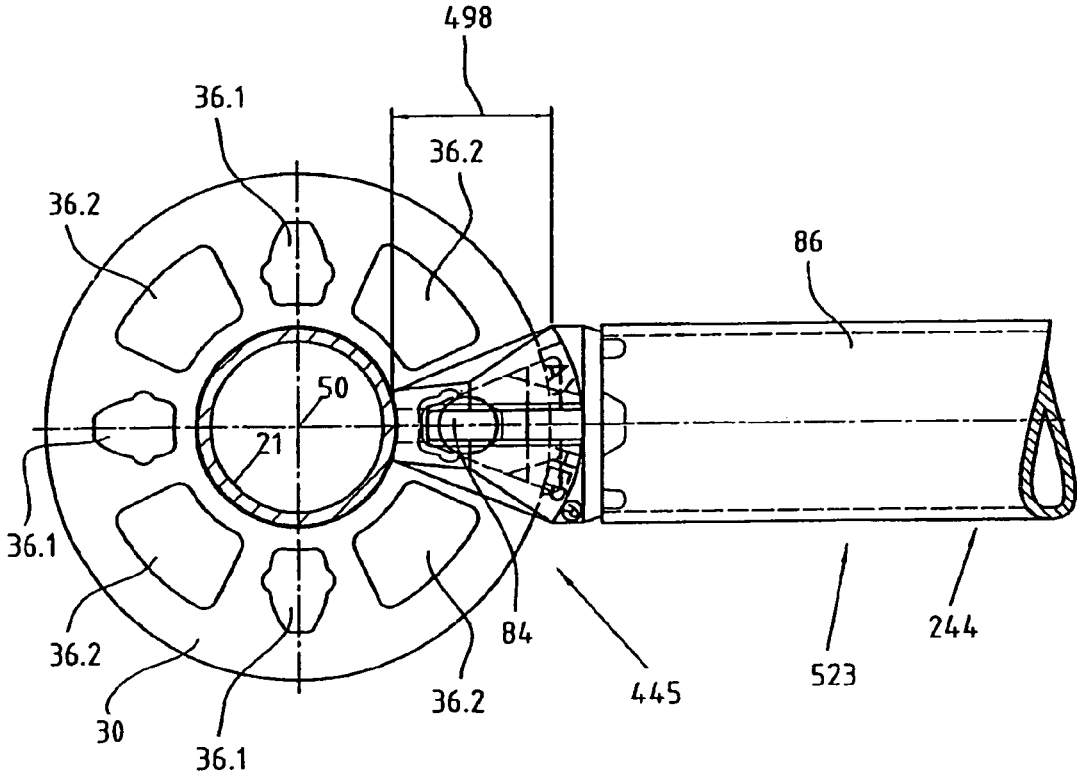
Figure 43:
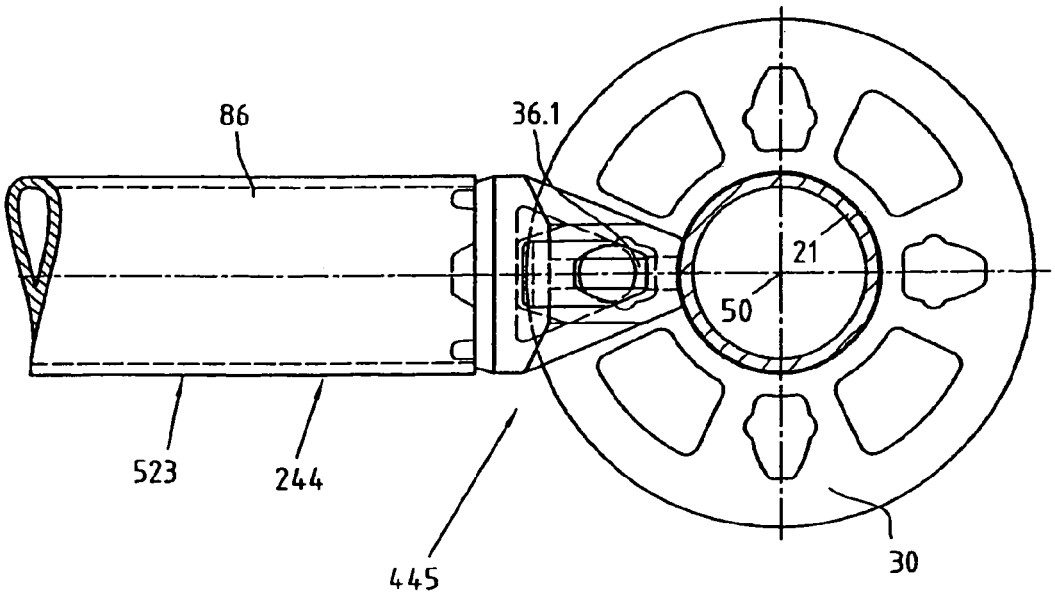
Figure 44:
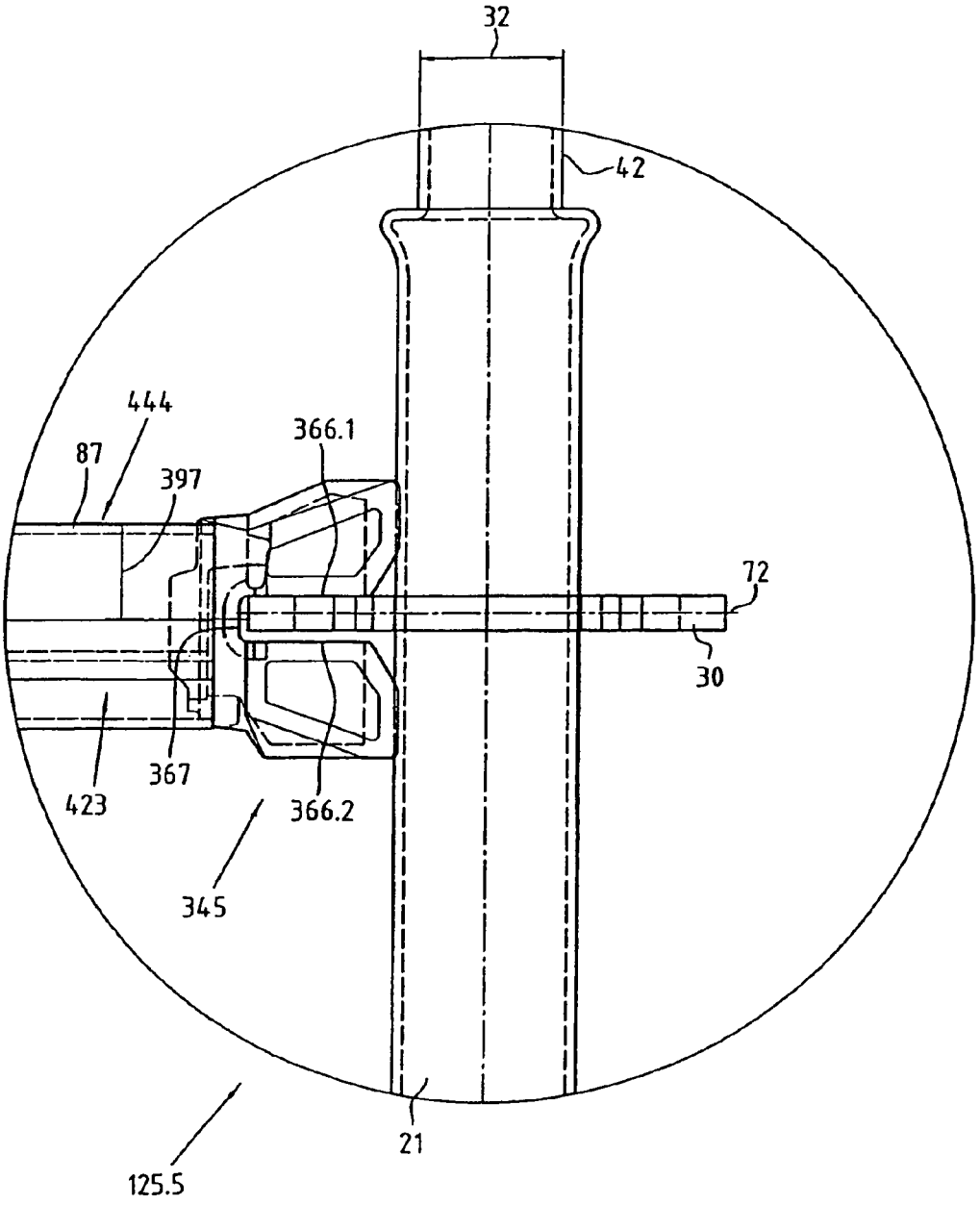
Figure 45:
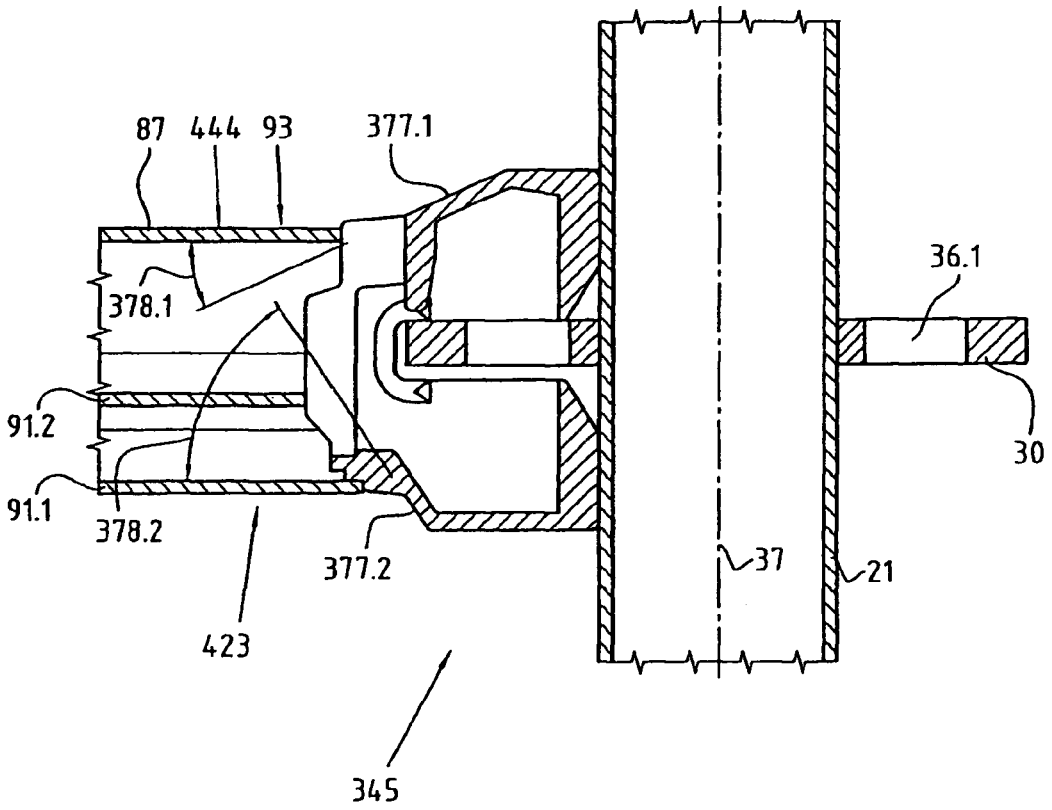
Figure 46:
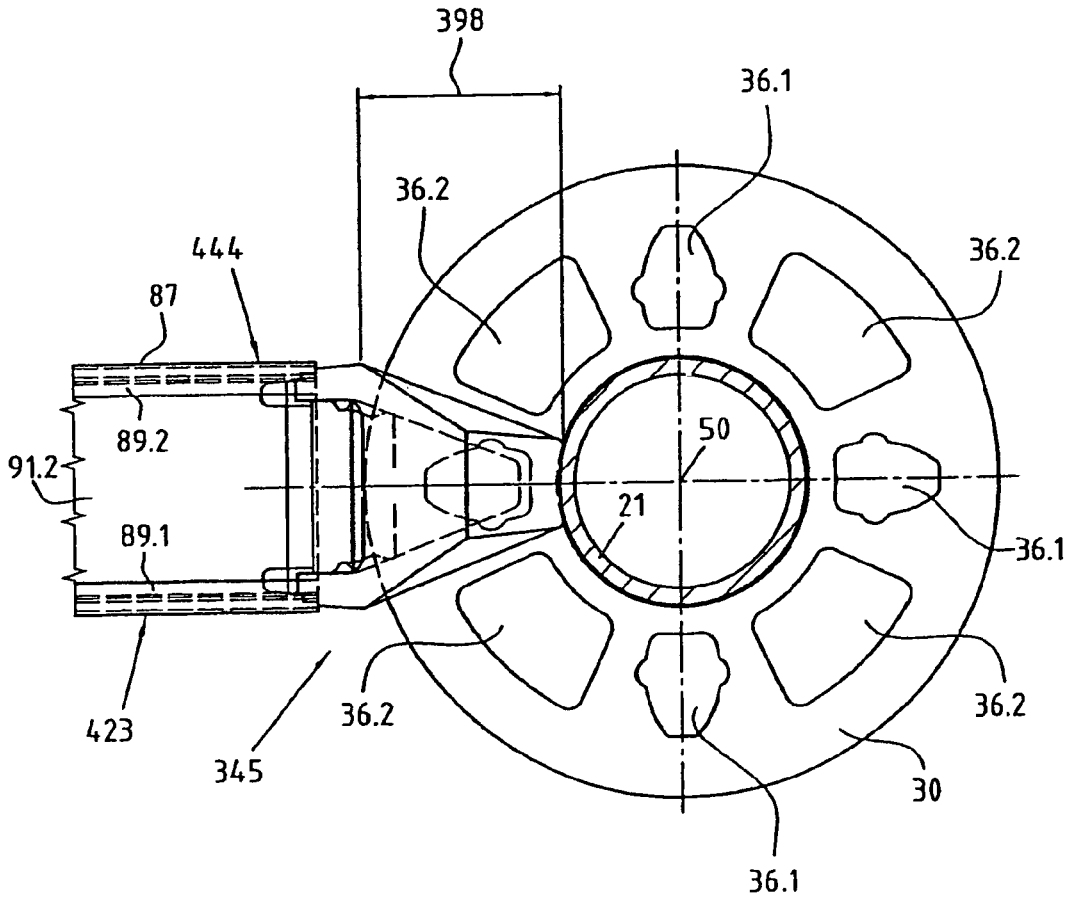
Figure 47:
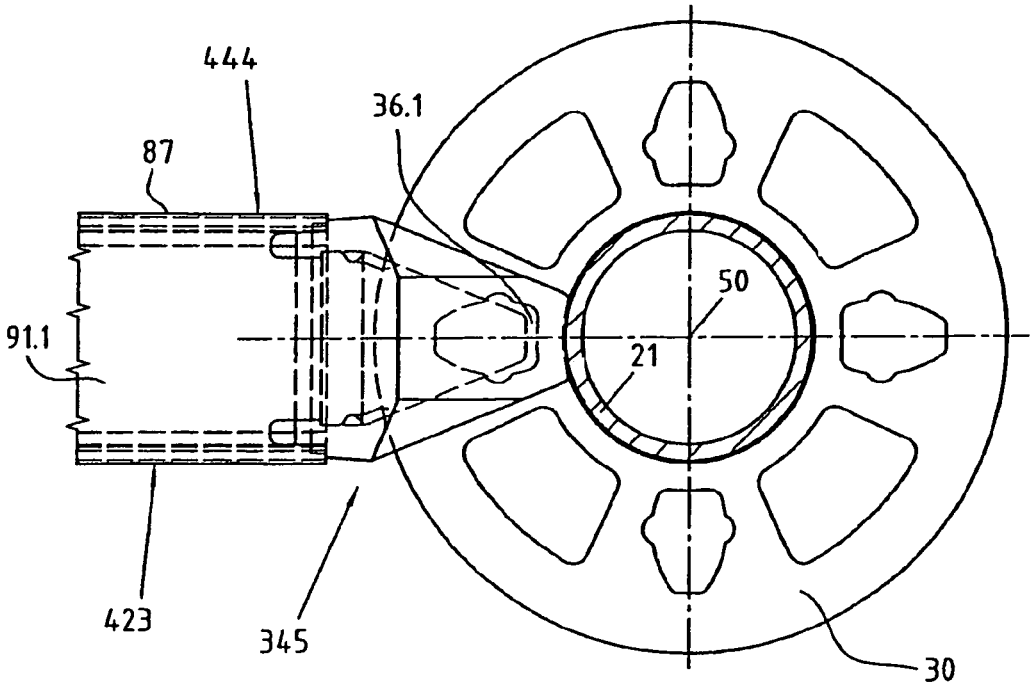
Figure 48:
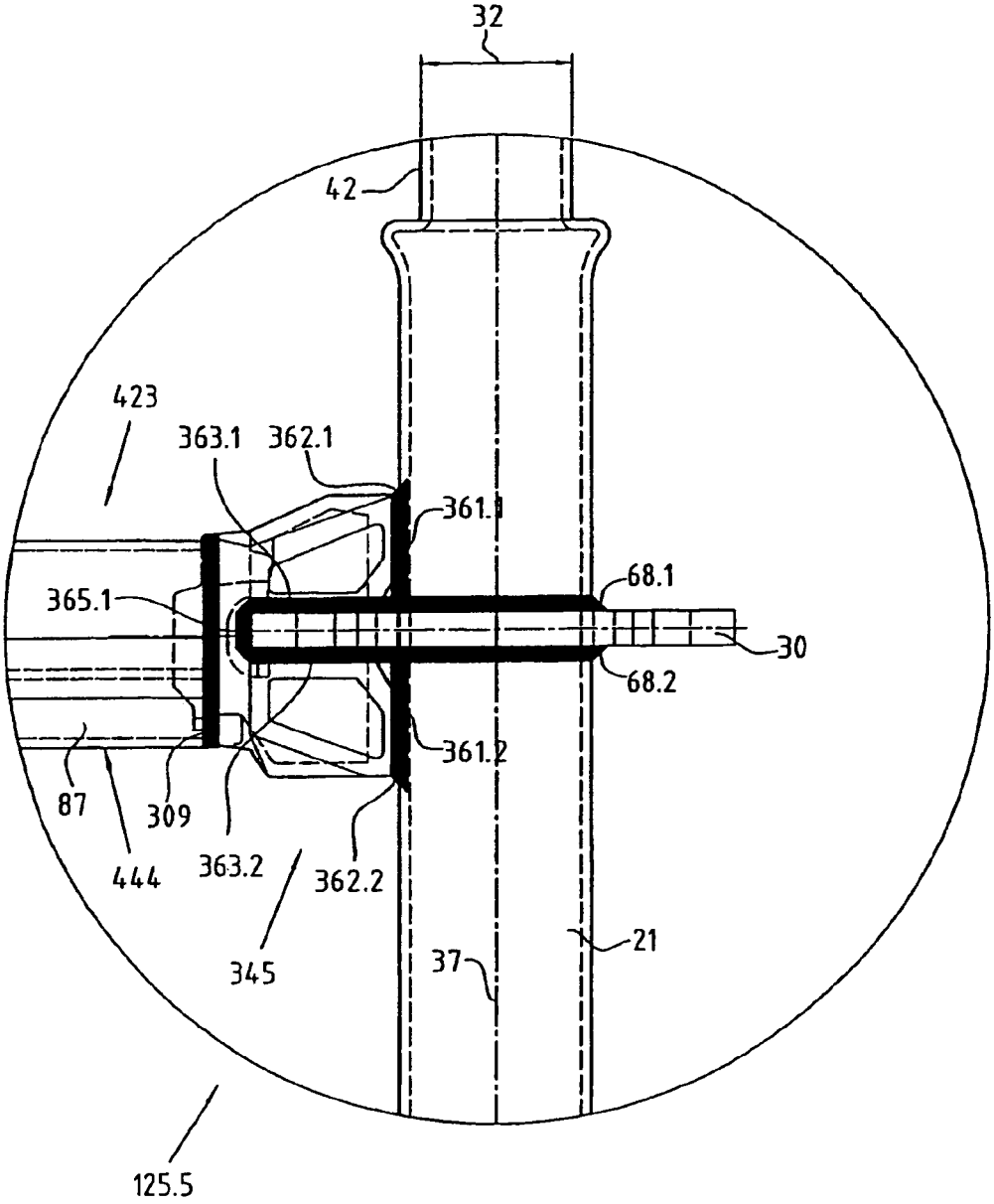
Figure 49:
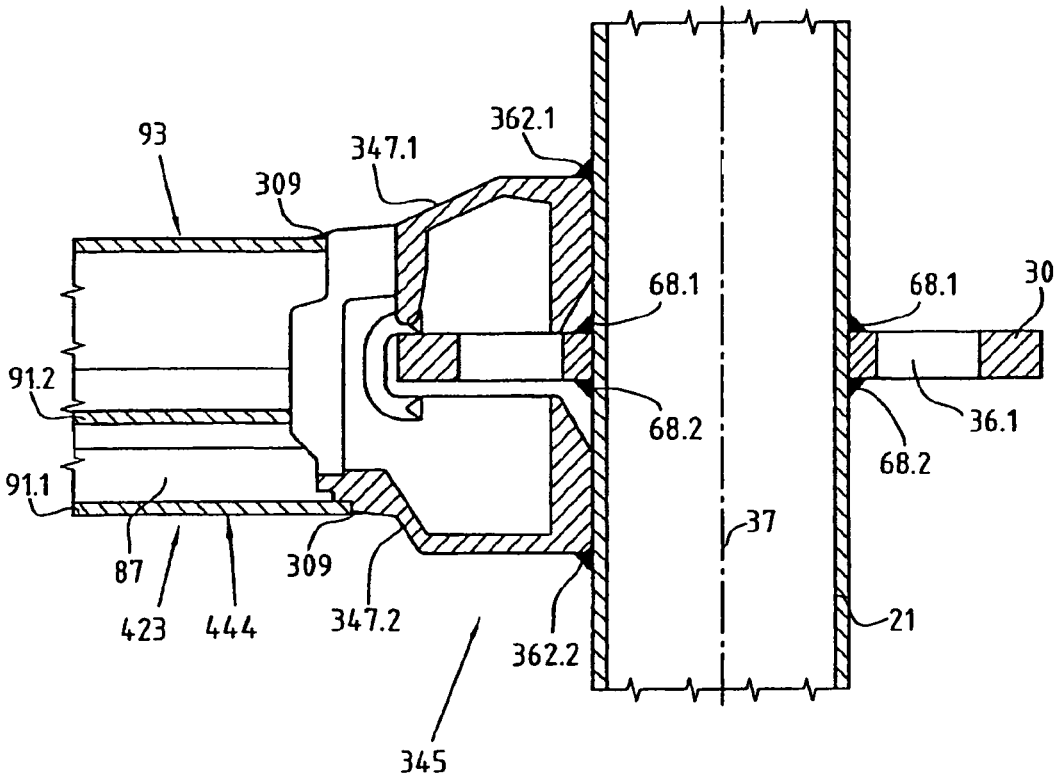
Figure 50:
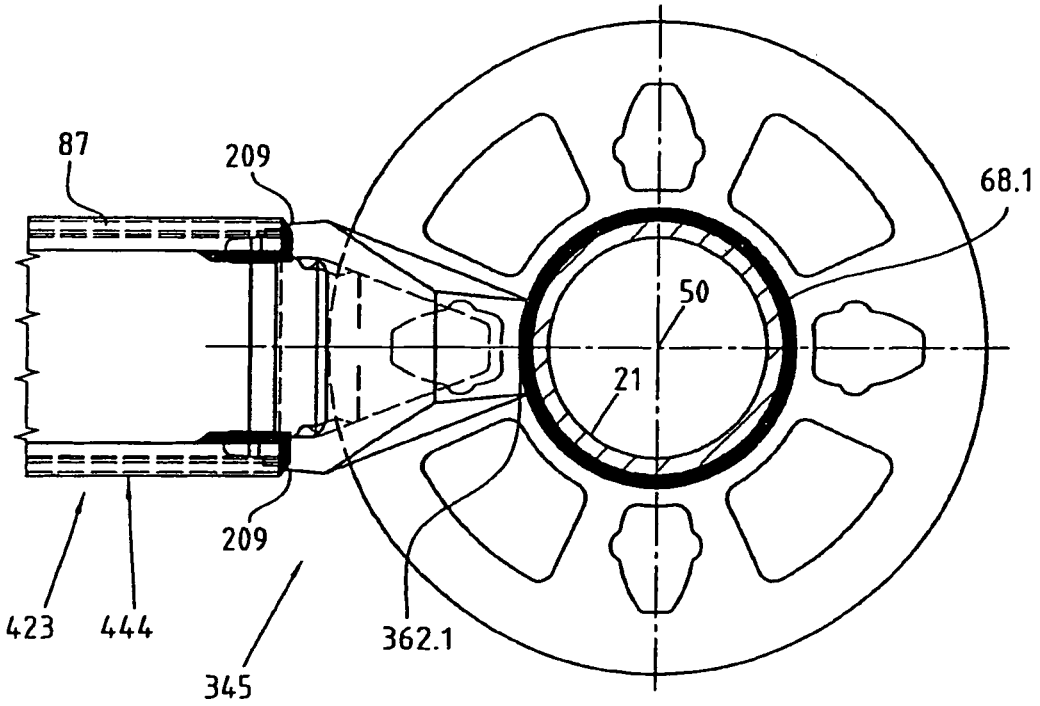
Figure 51:
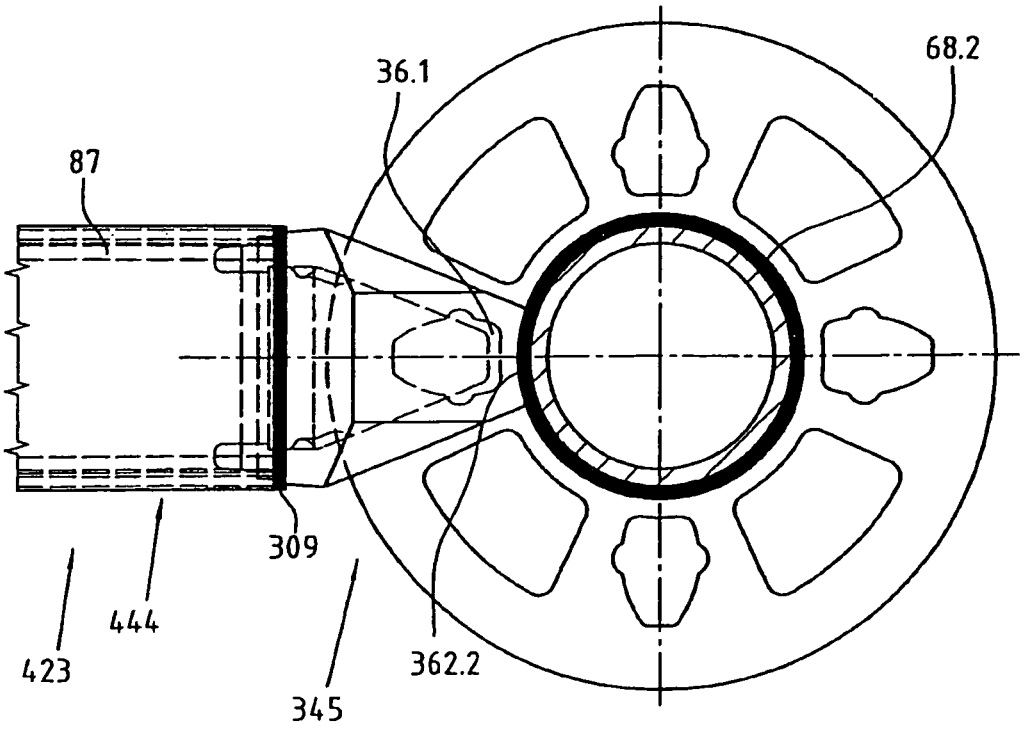
Figure 52:
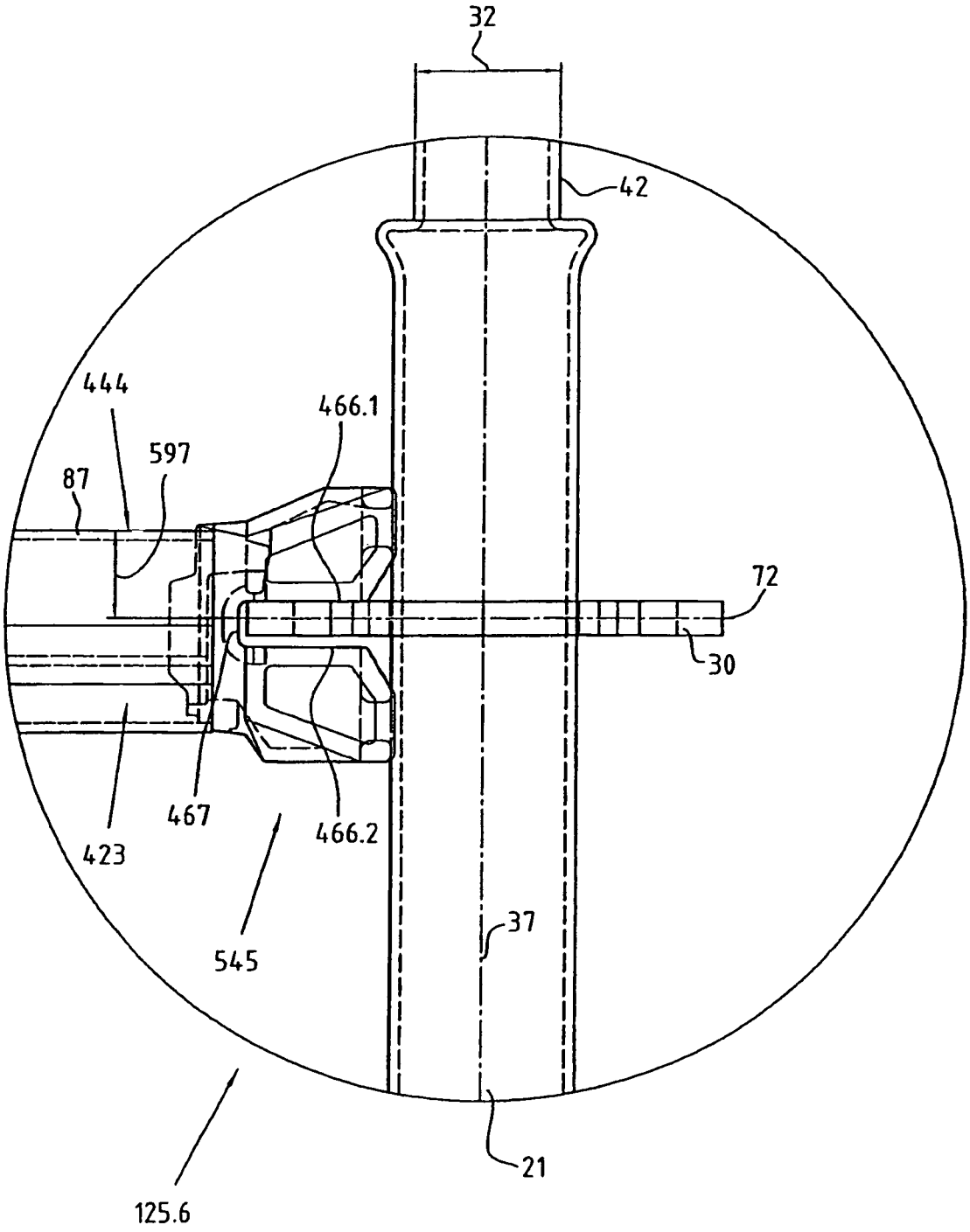
Figure 53:
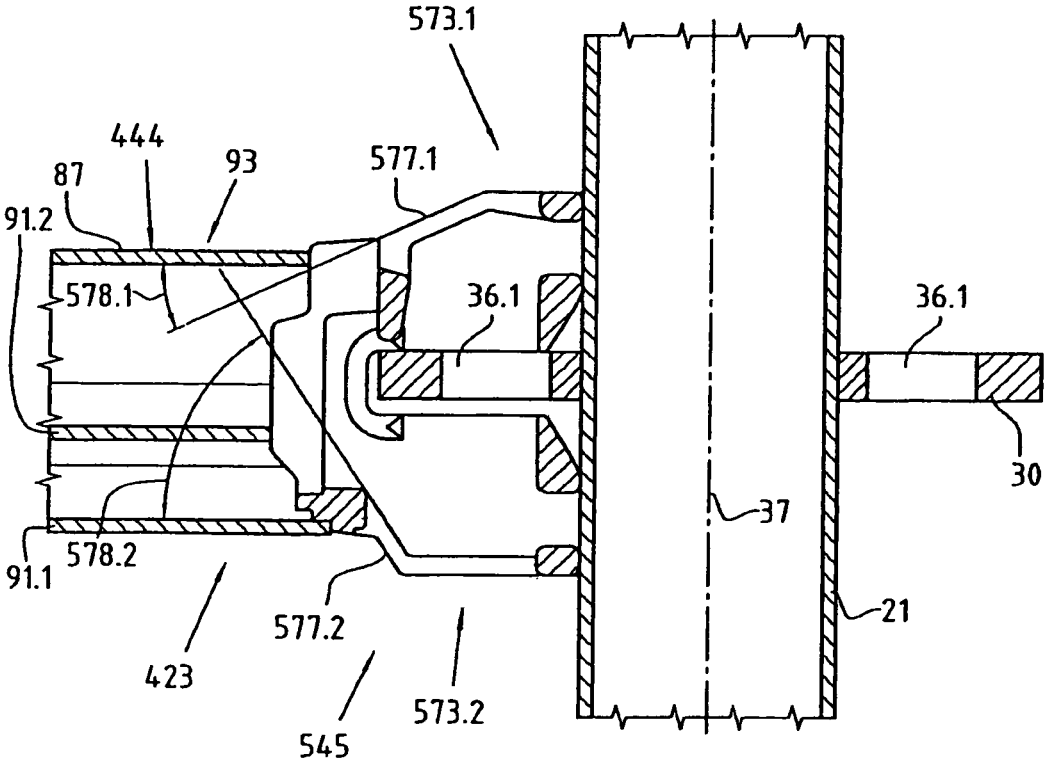
Figure 54:
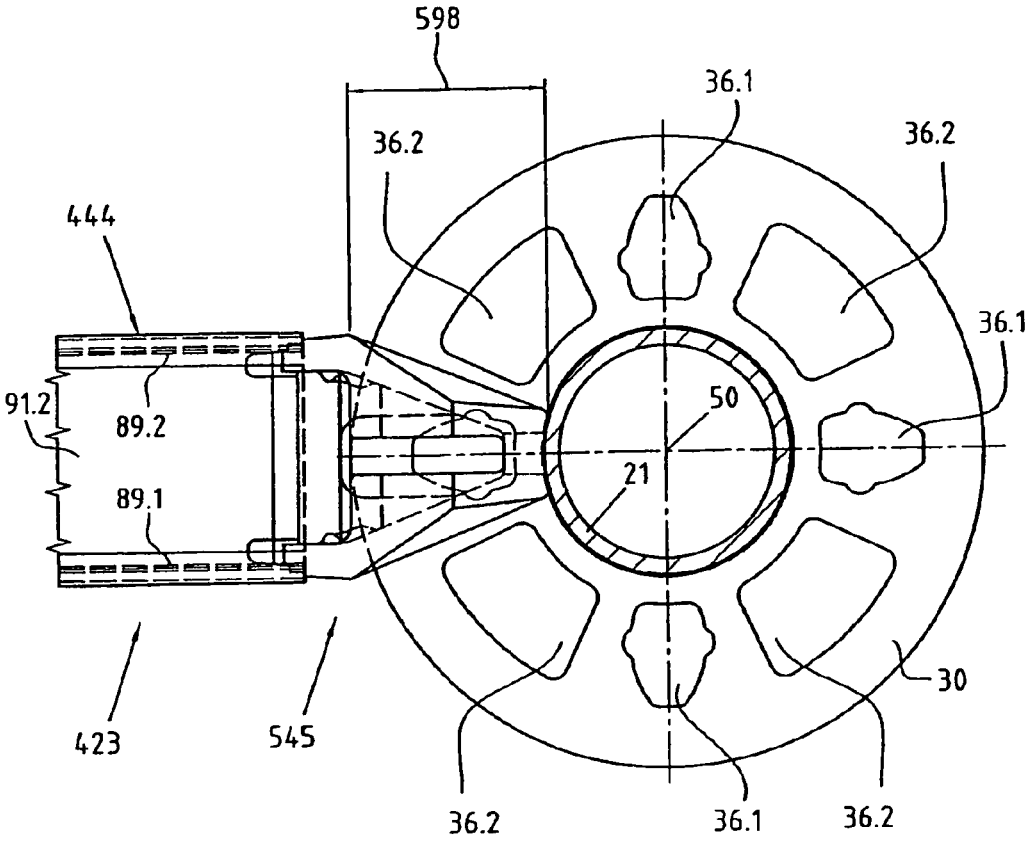
Figure 55:
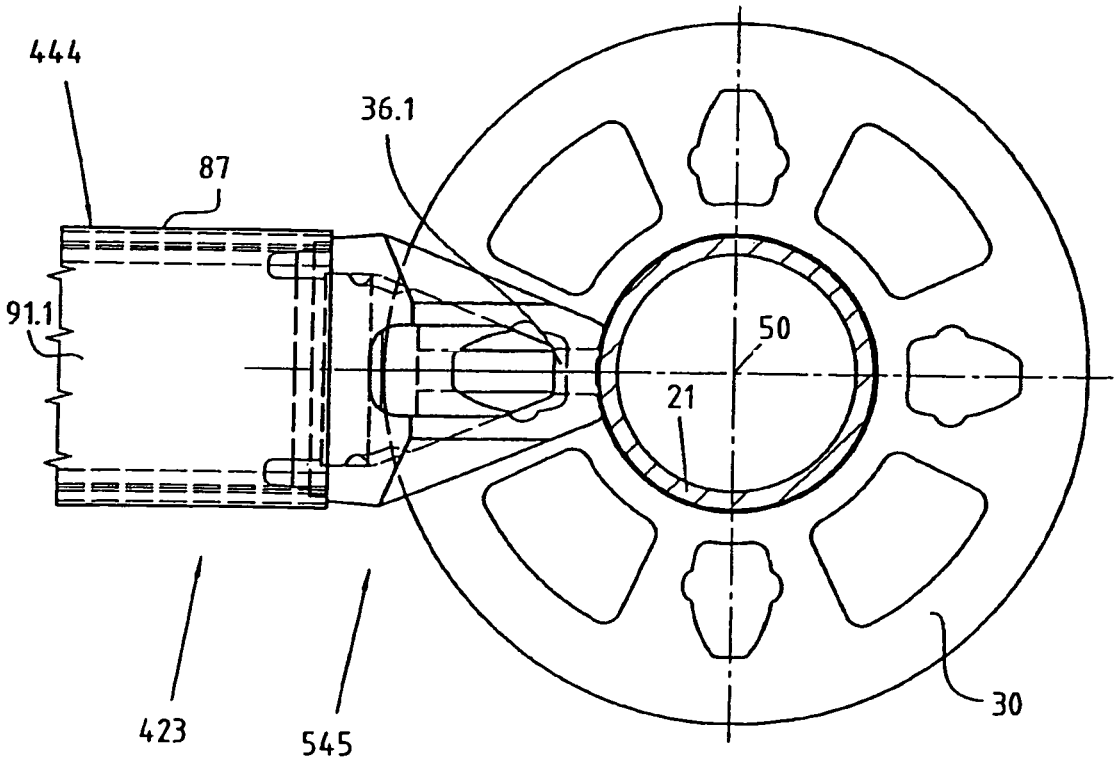

FIG. 3 shows a side view of a vertical frame element with a first post and with a transverse arm, which is designed with a round tube and which is provided integrally, and of the same material, with a formed-on connecting head and which is welded at its end facing away from the first post to a separate connecting head, which is connected by way of a second post of the same length, but with an apertured disc mounted at a different height, so as to form a lateral frame stiff in bending and torsion, wherein the second post is supported on a short post with construction of a lateral vertical frame for connection of a leading railing;

FIG. 4 shows an enlarged side view of the vertical frame element according to FIG. 3;

FIG. 5 shows an enlarged side view of the second, long post, which can be combined with the vertical frame element according to FIG. 3;

FIG. 6 shows an enlarged side view of the short post, which can be combined with the vertical frame element according to FIG. 3 by plugging on of the second, long post according to FIG. 5;

FIG. 7 shows a side view of a further vertical frame element, with a first post and a transverse arm, which is designed with a round tube and which is provided at both ends with a connecting head, which is formed on integrally and of the same material and which is welded to a second post of same mode of construction and length by comparison with the first post so as to form a vertical, downwardly open lateral U-frame stiff in bending and torsion;

FIG. 8 shows an enlarged side view of the detail 'X' in FIG. 7 in the region of the connecting node;

FIG. 9 shows a part plan view of the vertical frame element according to FIG. 7 in the region of the detail according to FIG. 8, with the post in sectional illustration;

FIG. 10 shows an illustration corresponding with FIG. 8, but now with weld seams emphasised in thick black lines in the node region;

FIG. 11 shows an illustration corresponding with FIG. 9, but now with weld seams emphasised in thick black lines in the node region;

FIG. 12 shows a front view of a connecting head, which is formed at a transverse arm designed with a round tube, in a state of not being welded to the post and the apertured disc;

FIG. 13 shows a side view of a further vertical frame element with a first post and a transverse arm, which is designed with a U-profile tube and which is provided at both ends with a connecting head formed on integrally and of the same material, wherein the two connecting heads are welded to posts of the same mode of construction and length so as to form a downwardly open lateral U-frame stiff in bending and torsion;

FIG. 14 shows an enlarged side view of the detail 'X' in FIG. 13 in the region of the connecting node;

FIG. 15 shows a part plan view of the vertical frame element according to FIG. 13 in the region of a detail according to FIG. 14, with the post in sectional illustration;

FIG. 16 shows an illustration corresponding with FIG. 14, but with weld seams emphasised in thick black lines in the node region;

FIG. 17 shows an illustration corresponding with FIG. 11, but with weld seams emphasised in thick black lines in the node region;

FIG. 18 shows a substantially enlarged cross-section of a transverse arm, which is formed as a U-profile tube, in a sectional plane formed perpendicularly to the longitudinal axis of the transverse arm;

FIG. 19 shows a front view of one of the connecting heads formed at the U-profile tube according to FIG. 18, in a state of not being welded to the post and the apertured disc;

FIG. 20 shows a side view of the U-profile tube in the region of a connecting head formed thereat;

FIG. 21 shows a plan view of the U-profile tube in the region of a connecting head formed thereat;

FIG. 22 shows a side view of a h-shaped vertical frame element with a first, long post and a transverse arm, which is designed with a round tube and which is provided at both ends with a connecting head formed on integrally and of the same material, wherein the second connecting head formed at the end of the transverse arm facing away from the first, long post is welded across a second, short post with formation of a lateral vertical frame stiff in bending and torsion, wherein the h-shaped vertical frame element is constructed with two short posts so as to form a lateral scaffolding frame, which corresponds with a storey height, for connection of a leading railing;

FIG. 23 shows an enlarged side view of the vertical frame element according to FIG. 22;

FIG. 24 shows a side view of a further h-shaped vertical frame element with a first, long post and a transverse arm, which is designed with a U-profile tube and which is provided at both ends with a connecting head formed on integrally and of the same material, wherein the second connecting head formed at the end of the transverse arm facing away from the first, long post is welded across a second, short post with formation of a lateral h-frame stiff in bending and torsion, wherein the h-shaped vertical frame element is constructed with two short posts so as to form a lateral scaffolding frame, which corresponds with a storey height, for connection of a leading railing;

FIG. 25 shows an enlarged side view of the vertical frame element according to FIG. 24;

FIG. 26 shows a side view of an H-shaped vertical frame element with a first post and a transverse arm, which is designed with a round tube and which is provided at both ends with a connecting head formed on integrally and of the same material, wherein the second connecting head formed at the end of the transverse arm facing away from the first, long post is welded across a second post of the same mode of construction and length as the first post to form a lateral H-frame stiff in bending and torsion, wherein the H-shaped vertical frame element is plugged onto two short posts and in this manner similarly constructed to form a lateral scaffolding frame, which corresponds with a storey height, for connection of a leading railing on both sides;

FIG. 27 shows an enlarged side view of the vertical frame element according to FIG. 26;

FIG. 28 shows a side view of a further H-shaped vertical frame element, with a first post and a transverse arm, which is designed with a U-profile tube and which is provided at both ends with a connecting head formed on integrally and of the same material, wherein the connecting head formed at the end of the transverse arm facing away from the first, long post is attached across a second constructionally identical post of the same length as the first post to form a lateral H-frame stiff in bending and torsion, wherein the H-shaped vertical frame element is in turn plugged onto two short posts and in this manner similarly constructed to form a lateral scaffolding frame, which corresponds with a storey height, for connection of a leading railing at both sides;

FIG. 29 shows an enlarged side view of the vertical frame element according to FIG. 28;

FIG. 30 shows an enlarged view of one of the two short posts, which are shown in FIGS. 22, 24, 26 and 28 and which each have two fastening devices, which are spaced apart in longitudinal direction of the post, for safety means against falling;

FIG. 31 shows an enlarged cross-section of a round tube such as, in the case of the posts, can be used or formed in each of the end regions thereof;

FIG. 32 shows an enlarged detail side view in the region of the connecting node of a further vertical frame element in which a rod element, which is designed as a round tube, of the transverse arm is provided with a connecting head according to the invention, which is free of wedge openings and which is welded as a separate component, wherein a toeboard pin is welded to the connecting head;

FIG. 33 shows a longitudinal section in the node region according to FIG. 32, in a sectional plane containing the longitudinal axis of the post and the longitudinal axis of the transverse arm;

FIG. 34 shows a plan view of the connecting node according to FIG. 32, with the post in sectional illustration;

FIG. 35 shows an underneath view of the connecting node according to FIG. 32, with the post in sectional illustration;

FIG. 36 shows an illustration corresponding with FIG. 32, but with weld seams emphasised in thick black lines in the node region and in the region between the connecting head and the rod element of the transverse arm;

FIG. 37 shows a longitudinal section in the node region according to FIG. 36, in a sectional plane containing the longitudinal axis of the post and the longitudinal axis of the transverse arm;

FIG. 38 shows a plan view of the node according to FIG. 36, with the post in sectional illustration;

FIG. 39 shows an underneath view of the node according to FIG. 36, with the post in sectional illustration;

FIG. 40 shows an enlarged detail side view in the region of the connecting node of a further vertical frame element, wherein the connecting head shown here is a mass-production connecting head of the applicant according to the state of the art, which is welded as a separate component to a rod element of a multi-part transverse arm, wherein a toeboard pin is also welded to this connecting head;

FIG. 41 shows a longitudinal section in the node region according to FIG. 40, in a sectional plane containing the longitudinal axis of the post and the longitudinal axis of the transverse arm;

FIG. 42 shows a plan view of the node according to FIG. 40, with the post in sectional illustration;

FIG. 43 shows an underneath view of the node according to FIG. 40, with the post in sectional illustration;

FIG. 44 shows an enlarged detail side view in the region of the connecting node of a further vertical frame element, in which a connecting head, which is formed to be free of wedge openings, of the multi-part transverse arm constructed with a U-profile tube is welded to the U-profile tube, and which is shown here without a toeboard pin able to be mounted thereon;

FIG. 45 shows a longitudinal section in the node region according to FIG. 44, in a sectional plane containing the longitudinal axis of the post and the longitudinal axis of the transverse arm;

FIG. 46 shows a plane view of the node according to FIG. 44, with the post in sectional illustration;

FIG. 47 shows an underneath view of the node according to FIG. 44, with the post in sectional illustration;

FIG. 48 shows an illustration corresponding with FIG. 44, but now with weld seams emphasised in thick black lines in the node region and in the region between the connecting head and the U-profile tube of the transverse arm;

FIG. 49 shows a longitudinal section in the node region according to FIG. 48, in a sectional plane containing the longitudinal axis of the post and the longitudinal axis of the transverse arm;

FIG. 50 shows a plan view of the node according to FIG. 48, with the post in sectional illustration;

FIG. 51 shows an underneath view of the node according to FIG. 48, with the post in sectional illustration;

FIG. 52 shows an enlarged detail side view in the region of the node of a further vertical frame element, in which the connecting head of the transverse arm designed with a U-profile tube is welded to the U-profile tube, wherein the connecting head is a mass-production connecting head of the applicant according to the state of the art;

FIG. 53 shows a longitudinal section in the node region according to FIG. 52, in a sectional plane containing the longitudinal axis of the post and the longitudinal axis of the transverse arm;

FIG. 54 shows a plan view of the node according to FIG. 52, with the post in sectional illustration;

FIG. 55 shows an underneath view of the node according to FIG. 52, with the post in sectional illustration;

FIG. 56*a*)-*g*) shows a connecting head, as a separate component, for connection with a U-profile tube of a transverse arm of a vertical frame according to the invention in:

a) front view,
b) side view,
c) rear view,
d) longitudinal section,
e) underneath view
f) cross-section,
g) top view;

FIG. 57*a*)-*g*) shows a mass-production connecting head of the applicant according to the state of art, as a separate component, for connection with a U-profile tube of a transverse arm of a vertical frame according to the invention in:

a) front view,
b) side view,
c) rear view,
d) longitudinal section,
e) underneath view
f) cross-section,
g) top view;

FIG. 58*a*)-*g*) shows a connecting head, as a separate component, for connection with a round tube of a transverse arm of a vertical frame according to the invention in:

a) front view,
b) side view,
c) rear view,
d) longitudinal section,
e) underneath view
f) cross-section,
g) top view;

FIG. 59*a*)-*g*) shows a mass-production connecting head of the applicant according to the state of art, as a separate component, for connection with a transverse arm, which is designed with a round tube, of a vertical frame according to the invention in:

a) front view,
b) side view,
c) rear view,
d) longitudinal section,
e) underneath view
f) cross-section,
g) top view.

Figure 1:
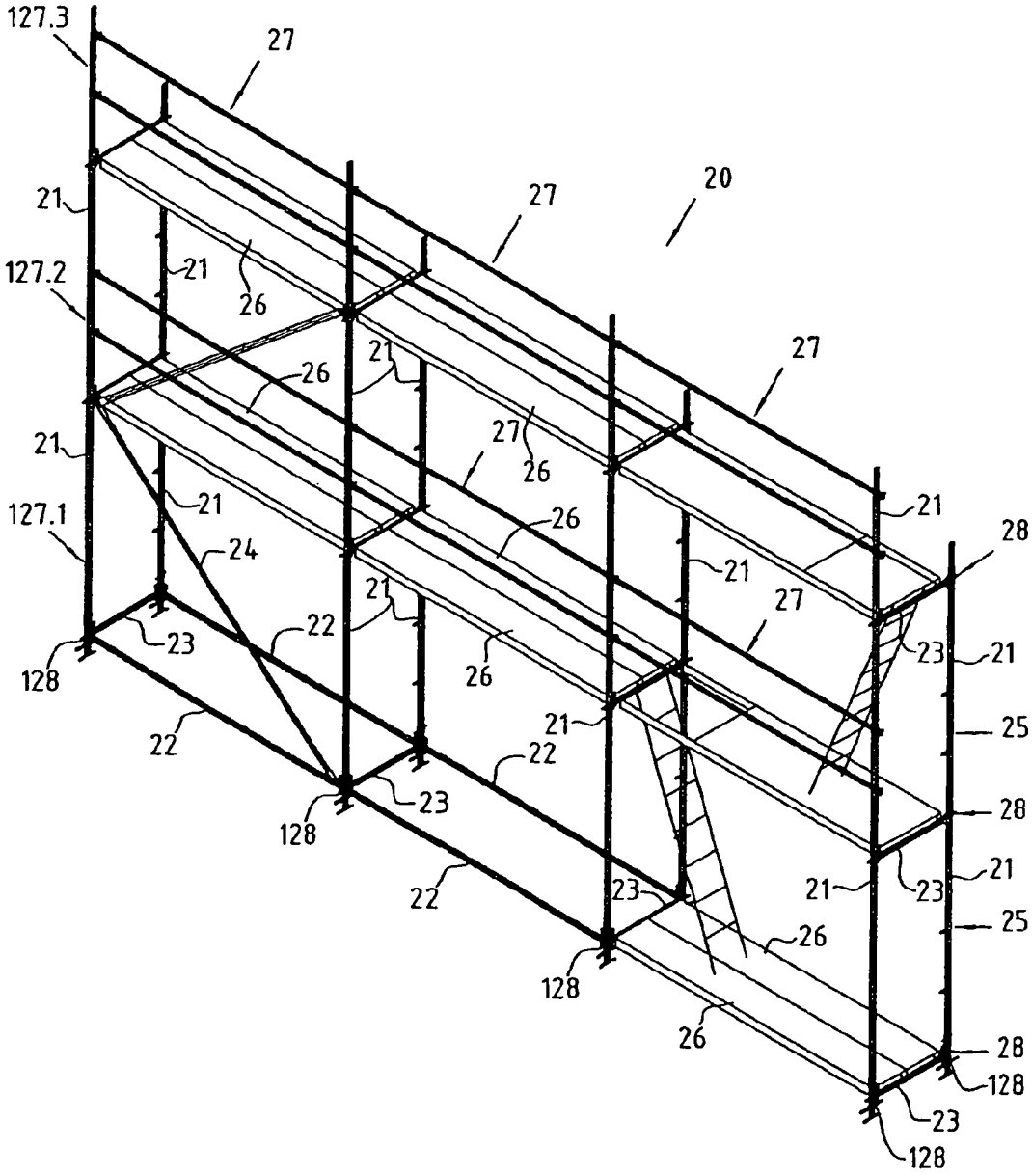
FIG. 1 shows a three-dimensional view of a scaffolding which is set up with use of a vertical frame according to a first variant of embodiment of the invention, with construction of a facade frame with a leading railing.
Figure 2:
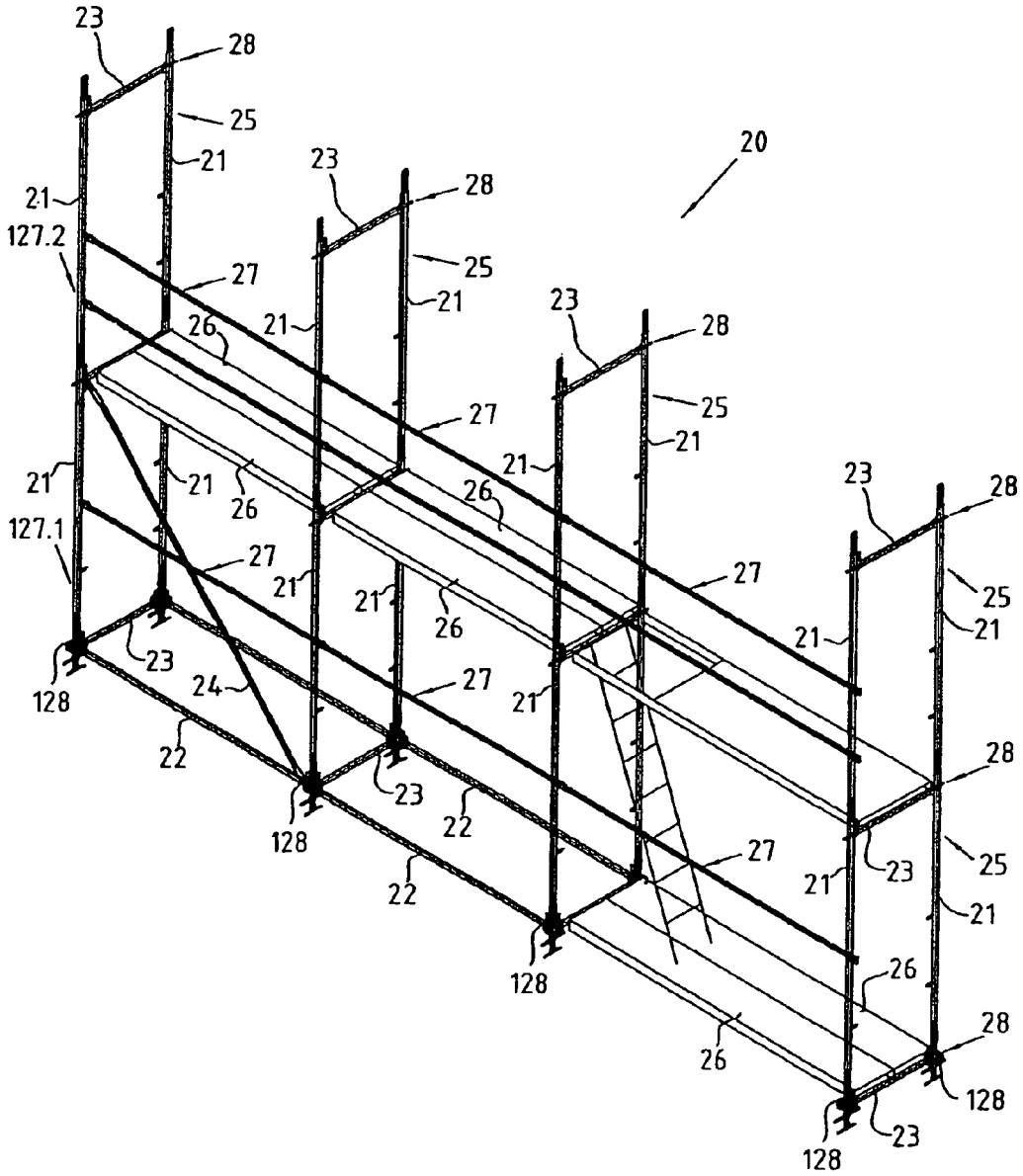
FIG. 2 shows a three-dimensional view of a scaffolding, which is set up with use of a vertical frame according to a second variant of embodiment of the invention, with construction of a downwardly open U-standing frame.

The three-dimensional framework 20 shown in FIGS. 1 and 2 is constructed as a scaffolding and comprises vertical posts 21, cladding units 26 mounted thereat, particularly scaffolding floors or planks, as well as railing elements serving as safety means 27 against falling, particularly horizontal railing rods, and diagonal elements 24 stiffening the three-dimensional framework 20, particularly diagonal rods, which are fastened between two spaced-apart posts 21, 21. At least one diagonal element 24 is attached in each storey 127.1, 127.2, 127.3. As usual with modular scaffoldings, the lowermost storey 127.1 can be constructed with so-called start members 128, which preferably enable a compensation of level relative to the ground by way of a fitted spindle, wherein the upper plug-in or plug-on ends of the start members 128 can be plugged into or onto which of the posts 21 is able to brought into a common horizontal plane.

The longitudinal bar 22 and the crossbar 23 of the lowermost storey 127.1 are provided at their two respective ends with connecting heads 445 and/or 545, which can be wedge-connected with the associated apertured disc 30 of the start member 128 by means of a wedge 74, so that the longitudinal bar 22 and the crossbar 23 are connectible or connected with the start members 128 in a manner stiff in bending and torsion so as to form a base frame similarly stiff in bending and torsion.

Based thereon, the vertical posts 21 and all further connecting, rest and/or support elements can be built up to form a stable and torsionally stiff three-dimensional framework 20.

The vertical frame elements 25; 25.1 to 25.6, 125.2 to 125.6 can be used for construction of the further storeys 127.2, 127.3, as shown particularly in FIGS. 3, 4, 7, 13, 22 to 29 and 32 to 52. Each of these vertical frame elements 25; 25.1 to 25.6, 125.2 to 125.6 consists of a first vertical post 21; 21.1, 121.1 and a rod-shaped, horizontal transverse arm 23; 123, 223, 323, 423, 523 extending transversely, preferably perpendicularly, away therefrom, wherein the first post 21; 21.1, 121.1 is permanently connected with the transverse arm 23, 123, 223, 323, 423, 523 in a manner stiff in bending and torsion by welding.

A first apertured disc 30; 30.1 provided with several passages 36; 36.1, 36.2 is permanently fastened, preferably by welding, to the respective first post 21; 21.1, 121.1, the disc being arranged concentrically with respect to the first post 21; 21.1, 121.1 and surrounding the post 21; 21.1, 121.1 in flange-like manner at least partly, preferably over the full circumference. A first railing element fastening device 33; 33.1 for fastening a fall safety means 27 designed as a railing element, particularly a railing rod, preferably also at least one second railing element fastening device 33, 33.2 of that kind, i.e. constructionally and functionally the same, at a spacing from the first railing element fastening device 33; 33.1 in longitudinal direction of the first post 21; 21.1, 121.2, is or are provided at the first post 21; 21.1, 121.1 at a spacing from the first apertured disc 30; 30.1.

The post 21; 21.1, 121.1 has an upper end region 41.1.1 and a lower end region 41.1.2, of which one end region 41.1.1, particularly the upper end region 41.1.1, is formed as a tube connector 42; 42.1 and has relative to the other end region 41.1.2 a different cross-section in the manner that a further post 21 can be plugged onto the first post 21; 21.1, 121.1.

The transverse arm 23, 123, 223, 323, 423, 523 has at a first end 43.1 a first connecting head 45; 45.1, 145.1, 245, 445 and at a second end 43.2 facing away from this end 43.1 a second connecting head 45; 45.2, 145.2, 345, 545, 445, by means of which the transverse arm 23; 123, 223, 323, 423, 523 is fixable or fixed in a manner stiff in bending and torsion to a second vertical post 21; 21.1, 121.2, 221.2 by way of a second apertured disc 30; 30.2, which is provided with several passages 36; 36.1, 36.2 and permanently connected, preferably by welding, with the second post 21; 21.1, 121.2, 221.2 and which is arranged concentrically with respect thereto and surrounds this in flange-like manner at least partly, preferably around the full circumference, with formation of a vertical frame 35; 35.1, 35.2, 35.3, 35.4, 135.2, 135.3, 135.4, according to the invention, particularly a scaffolding frame.

The first connecting head 45; 45.1, 145.1, 245, 445, preferably each connecting head 45; 45.1, 145.1, 245, 445, 45.2, 145.2, 345, 545, is bounded by side wall parts 46.1, 46.2, 47.1, 47.2; 146.1, 146.2; 147.1, 147.2; 246.1, 246.2; 247.1, 247.2; 346.1, 346.2; 347.1, 347.2; 446.1, 446.2; 447.1, 447.2; 546.1, 546.2; 547.1, 547.2, which have vertical outer surfaces 48.1, 48.2, 49.1, 49.2; 148.1, 148.2, 149.1, 149.2; 248.1, 248.2, 249.1, 249.2; 348.1, 348.2, 349.1, 349.2; 448.1, 448.2, 449.1, 449.2; 548.1, 548.2, 549.1, 549.2, which run together in wedge-like manner towards a centre, particularly towards the post and disc centre 50 of the associated apertured disc 30; 30.1, 30.2, and which include a wedge angle 51, which is preferably 40 degrees to 50 degrees, particularly approximately 45 degrees, for example 44 degrees.

The first connecting head 45; 45.1, 145.1, 245, 445, preferably each connecting head 45; 45.1, 145.1, 245, 445, 45.2, 145.2, 345, 545, has an upper head part 52, 152, 252, 352, 452, 552 and a lower head part 52, 152, 253, 353, 454, 553, which are preferably integrally connected together and between which a slot 54, 154, 254, 354, 454, 554 open towards the respectively associated post 21; 21.1, 121.1; 21.2; 121.2; 221.2 and towards the vertical outer surfaces 48.1, 48.2, 49.1, 49.2; 148.1, 148.2, 149.2; 248.1, 248.2, 249.1, 249.2; 348.1, 348.2, 349.1, 349.2; 448.1, 448.2, 449.1, 449.2; 548.1, 548.2, 549.1, 549.2, is provided.

Each connecting head 45; 45.1, 145.1, 245, 445; 45.2, 145.2, 345, 545 is plugged by its slot 54, 154, 254, 354, 454, 554 onto the apertured disc 30; 30.1; 30.2 projecting at least partly thereinto and is permanently connected, by welding, with the associated post 21; 21.1; 121.1; 21.2, 121.2, 221.2 and preferably also to the associated apertured disc 30; 30.2.

In this manner a vertical frame element 25; 25.1, 25.2, 25.3, 25.4, 25.5, 25.6, 125.2, 125.3, 125.4, 125.5, 125.6 stiff in bending and torsion is created, which can be formed to be L-shaped, T-shaped or t-shaped and which constructs in varied and advantageous mode and manner a U-shaped, an H-shaped or an h-shaped vertical frame 35; 35.1, 35.2, 35.3, 35.4, 135.2, 135.3, 135.4 and/or is usable for construction of a three-dimensional framework 20, particularly a scaffolding, which is compatible with a matching modular scaffolding, thus can be combined therewith, which similarly is or can be constructed with posts 21 having corresponding or matching apertured discs. In that case, combinations of that kind are possible not only within or on a common storey 127.1, 127.2, 127.3, but also within a common area, thus over at least two storeys 127.1, 127.2, 127.3, as are also combinations with one another of these two combination possibilities.

The transverse arm 23, 123, 223, 323, 423, 523 of the vertical frame element 25; 25.1 to 25.6; 125.2 to 125.6 can be designed with a tube, particularly with a round tube 86 or with an oval tube, with an upwardly open profile, preferably with an upwardly U-profile, particularly with a U-profile tube 87.

The connecting heads 45, 45.1 145.1, 245, 445; 45.2, 145.2, 345, 545 of the transverse arm 23, 123, 223, 323, 423, 523 can be connected or formed therewith integrally and of the same material at its first end 43.1 and/or at its second end 43.2 and/or can be formed as a separate component which can be connected, preferably permanently, particularly by welding, with a rod element 44, 244, 444 of the transverse arm 23, 123, 223, 323, 423, 523.

The connecting heads 45, 45.1, 145.1, 245, 445; 45.2, 145.2, 345, 545 of the transverse arm 23, 123, 223, 323, 423, 523 can, in particular, be constructed as connecting heads 45.1, 45.2; 145.1, 145.2; 245, 345 designed to be free of wedge openings for a separate plug-through wedge, but they can also be formed as connecting heads provided with wedge openings for a separate plug-through wedge 74, such as has become known, for example, in accordance with the state of the art, wherein connecting heads of that kind provided with wedge openings 473.1, 473.2; 573.1, 573.2 can also not be provided with an associated plug-through wedge, as in the case of the connecting heads 445 and 545.

With respect to connecting heads of that kind which have already become known from the state of the art, such as are shown particularly in FIGS. 57*a*) to *g*) and 59*a*) to *g*) in each instance without a plug-through wedge, reference can be made to, in particular, DE 198 06 094 A1 and the parallel EP 0 936 327 A1, which for the sake of simplicity are at this point incorporated in full content.

With respect to the apertured discs 30; 30.1, 30.2 provided with passages 36; 36.1, 36.2, which similarly have become known from the state of the art, reference can similarly be made to the afore-mentioned protective rights and additionally to DE 39 09 809 A1 and the parallel EP 0 389 933 A1 as well as to DE 200 12 598 U1 and the parallel WO 02/06610 A1 as well as the parallel EP 1 301 673 A1, which for the sake of simplicity are incorporated at this point in full content.

The new 'solid' connecting heads 345 and 245 shown particularly in FIGS. 56*a*) to *g*) and 58*a*) to *g*) differ from the mass-production connecting heads 545 and 445 shown in FIGS. 57*a*) to *g*) and 59*a*) to *g*) in that they are designed to be free of wedge openings for a separate plug-through wedge, such as are still present in the form of the upper wedge openings 573.1, 573.1 and the lower wedge openings 473.2, 573.2 in the mass-production connecting heads 445, 545.

Thus, in the new 'solid' connecting heads 245 and 345 the upwardly facing horizontal and/or inclined upper wall parts 283.1, 383.1 of the upper head part 252, 352 and the downwardly facing and/or inclined lower wall parts 283,2, 383.2 of the lower head part 253, 353 are designed to be free of openings. These measures improve the stability and torsional stiffness of these new connecting heads 245 and 345. Moreover, the fastening, preferably the welding, of a toeboard fastening element 84, which is to be provided in a given case and is preferably formed as a pin or rod, is thereby facilitated and in addition the stability of the connection between the toeboard fastening element 84 and the upper head part of the corresponding connecting head is improved.

FIGS. 3 and 4 show a vertical frame element 25.1 which, however, is not the subject of the invention. This consists of a vertical first post 21.1 and a single transverse arm 123, which here is designed with a round tube 86 and which is arranged in the region of the upper end 100.1 of the first post 21.1, but below the upper end region 41.1.1 formed with a tube connector 42.1, perpendicularly to the post 21.1. The transverse arm 123 has a first connecting head 45.1, which is formed integrally and of the same material at its first end 43.1 associated with the post 21.1 and which is permanently connected with the first post 21.1 by way of the apertured disc 30.1 to be stiff in bending and torsion with formation of an L-shaped frame element 55.

The first post 21.1 has, inclusive of its upper end region 41.1.1, thus from its lower end 101.1 to its upper end 100.1, a total length of 216.5 centimeters. The length 102.1, which corresponds with a floor height or height of a storey 127.1, 127.2, 127.3, of the post 21.1 from the lower end 101.1 thereof to the upper end region 41.1.1 thereof is 200 centimeters. The upper end region 41.1.1 of the post 21.1 is formed as a tube connector 42.1, the outer diameter of which is less than the inner diameter of the lower end region 41.1.2 of the post 21.1, so that a corresponding post 21; 21.1 can be plugged onto the tube connector 42.1. The tube connector 42.1 is connected with the post tube of the post 21.1 integrally and of the same material. The lower end region 41.1.2 of the post 21.1 here has four impressments arranged in this region in the longitudinal direction of the post 21.1 and at the same circumferential angles relative to one another, as apparent particularly by way of the cross-section shown in FIG. 31. With respect thereto reference can be made to DE 101 12 370 A1 and the parallel WO 02/066768 A1 and the parallel EP 1 362 151 A1, which for the sake of simplicity are at this point incorporated in full content.

A single apertured disc 30.1 is welded to the first post 21.1, the disc being arranged concentrically thereto and surrounding this in flange-like manner as well as over the full circumference. This apertured disc 30.1 is arranged at a spacing 101.2, which amounts to 190 centimeters, from the lower end 101.1 of the post 27.1. Provided at the post 21.1 are two railing element fastening devices 33.1 and 33.2, which enable the connection or fastening of fall safety means 27, for example of scaffolding elements, particularly of scaffolding rods. The first railing element fastening device 33.1 has a spacing 118, which is approximately 95 centimeters, from the lower end 101.1 of the first post 21.1 and the second railing element fastening device 33.2 has a spacing 119, which is approximately 45 centimeters, from the lower end 101.1. Consequently, the spacing 117 between the two railing element fastening devices 33.1 and 33.2 is approximately 50 centimeters.

The arrangement and design of the first connecting head 45.1, which is formed integrally, and of the same material, at the transverse arm 123 here designed with a round tube 86, is apparent particularly from FIGS. 8 to 12. The connecting head designated there generally by the reference numeral 45 has an upper head part 52 and a lower head part 53, which are integrally connected together. The upper part 52 has upper side wall parts 46.1 and 46.2 and the lower head part 53 has lower side wall parts 47.1 and 47.2. The vertical outer surfaces 48.1, 48.2, 49.1, 49.2 of the side wall parts 46.1, 46.2, 47.1, 47.2 include a wedge angle 51, which is here approximately 44 degrees.

Provided between the upper head part 52 and the lower head part 53 is a horizontal slot 54 which is open towards the post 21.1 and towards the vertical outer surfaces 48.1, 48.2, 49.1, 49.2. The slot 54 is bounded by horizontal upper and lower slot surfaces, which are arranged parallel to one another and parallel to the longitudinal axis 38 of the transverse arm 123. The first connecting head 45.1 is welded to the post 21.1 in such a manner that the horizontal plane 71 intersecting the slot 54 at half the height of the slot width 70 lies approximately in the centre plane 72 intersecting the apertured disc 30.1 at the height of its centre.

The connecting head 45 is formed symmetrically with respect to the horizontal plane 71 and also symmetrically with respect to a vertical plane 82 arranged perpendicularly thereto and similarly containing the longitudinal axis 38 of the transverse arm 123.

The upper head part 52 has upper vertical support surfaces 80.1.1, 80.1.2 and the lower head part 53 has lower vertical support surfaces 80.2.1, 80.2.2, by which the connecting head 45.1 bears against the outer surface of the post 21.1. The upper end 81.1 of the upper head part 52 and the lower end 81.2 of the lower head part 53 project beyond the transverse arm 123, or the outer diameter 29 thereof, respectively in the region of the support surfaces 80.1.1, 80.1.1; 80.2.1, 80.2.2 considered in a direction perpendicular to the longitudinal axis 38 of the transverse arm 123.

The height 76.1 of the upper head part 52 and the height 76.2 of the lower head part 53 reduce in downward direction, thus in direction towards the transverse arm 123, here continuously and without break, to the outer diameter 29 of the transverse arm 123. The upper outer surface 77.1 and the lower outer surface 77.2 of the connecting head 45.1 are thus each inclined towards the transverse arm 123 and, in particular, here at an angle 78.1, 78.2 with respect to a notional line extending parallel to the longitudinal axis 38 of the transverse arm 123, which angle is approximately 45 degrees.

The support wall parts 80.1.1, 80.1.2; 80.2.1, 80.2.2 of the wedge head 45 have a part-cylindrical form and, considered in a cross-section perpendicular to the longitudinal axis 37 of the associated post 21, are formed with a radius of preferably 24.15 millimeters corresponding with the outer radius of the post 21.

The spacings 76.1 of the upper end 81.1 of the upper support surfaces 80.1.1, 80.1.2 and the spacings 76.2 of the lower end 81.2 of the lower support surfaces 80.2.1, 80.2.2 from the horizontal plane 71 intersecting the slot 54 at half the height of the slot width 70 are the same size. The slot of the connecting head 45 has a slot width 70 which is approximately 10 millimeters, wherein this slot width is only slightly greater than the apertured disc thickness of the apertured disc 30, which is approximately 9 millimeters.

A toeboard fastening element 84, which is formed as a rod or a pin, is welded onto the rearwardly inclined upper outer surface 77.1 of the connecting head 45 at a spacing 85 from the post, wherein the spacing is approximately 15 millimeters. This makes possible the fastening of a toeboard between the toeboard fastening element 84 and the oppositely disposed post 21 in such a manner that no horizontal gap is formed between the associated cladding unit 26 and the toeboard, whereby the risk of accident, particularly due to objects falling down, is minimised.

The connecting head 45 is, as shown particularly in FIGS. 10 and 11, welded not only to the post 21, but also the apertured disc 30. In that case it is provided in accordance with the invention that the connecting head 45 is welded, in the region of all its outer surfaces, which are connected towards the outside with its surfaces directly opposite the associated post 21 and the associated apertured disc 30, to the associated post 21 and to the associated apertured disc 30, in a given case with exception of at least one liquid outlet opening 69.1, by way of a continuous weld seam 61.1, 62.1, 61.2, 62.2, 63.1, 63.2, 65.1.

Consequently, the upper head part 52 and also the lower head part 53 of the connecting head 45 in regions of the vertical outer surfaces 48.1, 48.2; 49.1, 49.2 of the side wall parts 46.1, 46.2; 47.1, 47.2 thereof and also in the regions of the horizontal outer surfaces, which are respectively connected towards the outside with the vertical support wall parts 80.1.1, 80.1.2; 80.2.1, 80.2.2 upwardly and downwardly, are thus welded to the associated post 21, in a given case with exception of an optionally provided liquid outlet opening 69.1, by way of a respective continuous weld seam 61.1, 62.1 as well as 61.2, 62.2.

In addition, the upper head part 52 and also the lower head part 53 of the connecting head 45 are welded, in regions of the vertical outer surfaces 48.1, 48.2; 49.1, 49.2 of the side wall parts 46.1, 46.2; 47.1, 47.2 thereof, which are connected towards the outside with the horizontal slot surfaces of the slot 54, respectively over the entire width of the part of the associated apertured disc 30, which projects into the slot 54 of the connecting head 45, by way of a respective continuous weld seam 63.1 and 63.2.

Moreover, the upper head part 52 and the lower head part 53 of the connecting head 45 are welded, in regions of the vertical outer surfaces 48.1, 48.2; 49.1, 49.2 of the side wall parts 46.1, 46.2; 47.1, 47.2 thereof, which are connected towards the outside with the vertical slot surfaces 67 of the slot 54, by way of a respective continuous weld seam 65.1 to the outwardly facing end surfaces, which are disposed in the region of the slot 54, of the associated apertured disc 30, wherein at least one liquid outlet opening 69,1, 69.2 can be excluded from the welding (see FIGS. 11 and 12).

As apparent from the figures, the first connecting head 45 is formed in such a manner and arranged at the associated apertured disc 30 with its slot 54 to at least partly engage over this in such a manner that with the exception of a single passage 36.1, which is the smaller passage 36.1 of the passages 36.1, 36.2 of the associated apertured disc 30, all other passages 36.1 and 36.2 of this apertured disc 30 are usable for a connection of holding devices, particularly for hanging in conventional connecting heads, particularly those of the applicant, thus particularly the connecting heads 45 which are shown in FIGS. 59*a*) to *g*) and which are basically designed like the connecting heads 445, but provided with a captive plug-through wedge 74, preferably of horizontally and/or diagonally extending scaffolding elements.

The connecting heads 45 formed at the transverse arm 123, 223 integrally and of the same material can be produced by deforming, particularly by pressing together or compressing one of the ends 43.1, 43.2 of the transverse arm 123 here constructed with a round tube 86.

The vertical frame element 25.1 shown in FIGS. 3 and 4 and formed to be L-shaped is provided at the second end 43.2 of the transverse arm 123 facing away from the first post 21.1 with a second connecting head 445 which by comparison with the connecting head 45.1 provided at the first end 43.1 of the transverse arm 123 is formed to be of a different kind and as a separate component. The connecting head 445 is a mass-production connecting head of the applicant, as illustrated in FIGS. 59*a*) to *g*) by way of the example of the connecting head 445 provided there, but without plug-through wedge 74. This mass-production head 445 is thus provided in its upper head part 652 with a first wedge opening 673.1 and in its lower head part 652 with a lower wedge opening 673.2, through which a plug-through wedge 74, which is preferably captively connected with this connecting head 445, can be plugged, by which wedge the connecting head 445 is fixable and tightenable to an apertured disc 30, here the second apertured disc 30.2 of the second post 21.2, thus as illustrated by way of example in FIG. 3.

This second connecting head 445 of the transverse arm 123 of the vertical frame element 25.1 is, as conventional with mass-production connecting heads, welded to a rod element 44, which is formed as a round tube 86, of the transverse arm 123. The vertical frame element 25.1 shown in FIG. 3 is thus connected with the second post 21.2 by way of or with the help of the second connecting head 445 to be detachable again (cf. FIG. 4).

It will be obvious that the transverse arm of a vertical frame element of that kind of L-shaped form can also be constructed with a rod element formed as a U-profile, particularly as a U-profile tube, instead of with a rod element formed as a round tube. The cross-section of this rod element can preferably correspond with the cross-section shown in FIG. 18. A transverse arm of that kind can equally be formed, such as the exemplifying embodiment shown by way of example in FIG. 13, with a first connecting head, which is formed on integrally and of the same material and the design of which can correspond with the design of the connecting head 145. The rod element of a transverse arm of that kind can be welded at its other end to a second connecting head, which can preferably be the mass-production U-shaped connecting head 545 shown in FIGS. 57*a*) to *g*).

The second post 21.2 has, just like the first post 21.1, only a single apertured disc 30.2 as well as two railing element fastening devices 33.1 and 33.2 for safety means 27 against falling, in which the railing elements can be, in particular, railing rods. However, in the case of the second post 21.2 the apertured disc 30.2 is mounted, by comparison with the first post 21.1, at a significantly shorter spacing 103.2 from the lower end 101.2 of the second post 21.2, which is here approximately 90 centimeters. Moreover, in the case of this second post 21.2 the first railing element fastening device 33.1 and the second railing element fastening device 33.2 are arranged at a significantly greater spacing from the lower end 101.2 of the second post 21.2. Accordingly, in the case of the second post 21.2 the first railing element fastening device 33.1 is arranged at a spacing 120 from the lower end 101.2, which here is approximately 190 centimeters, whilst the second railing element fastening device 33.2 is arranged at a space 126 from the lower end 101.2, which here is approximately 140 centimeters. In the same manner as in the case of the first post 21.1, the railing element fastening device 33.1 and the railing element fastening device 33.2 of the second post 21.2 are thus arranged at a spacing 117 from one another which is approximately 50 centimeters. The second post 21.2 is otherwise of the same design as the post 21.1, so that for the sake of simplicity reference can be made, with respect thereto, to the foregoing explanations.

When the vertical frame element 25.1 shown in FIG. 4 is wedge-fastened by way of its second connecting head 445 to the apertured disc 30.2 of the second post 21.2 with the help of the wedge 74, as shown in FIG. 3, there is obtained an S-shaped vertical frame 35.1 stiff in bending and torsion. By virtue of the part of the post 21.2 projecting above the transverse arm 123 and the railing element fastening devices 33.1 and 33.2 provided thereat, it is possible to suggest already during construction of a storey, i.e. the lowermost storey 127.1 in FIG. 3, fall safety means 27, which, however, are not shown in FIG. 3, in the second storey 127.2 provided thereabove. As shown in FIG. 3, the vertical frame 35.1 can be completed with the help of a short post 107 to form a standing frame. This short post, which is shown separately in FIG. 6, has a length 108 of 100 centimeters.

This short post 107 has neither an apertured disc nor fastening devices for safety means against falling. It is thus a pure extension post. However, with respect to the rest of its construction and size it is of the same design as the other posts 21.1 and 21.2.

A further vertical frame element 25.2 is shown in the example of embodiment according to FIG. 7. This vertical frame element 25.2 differs from the vertical frame element 25.1 shown in FIGS. 3 and 4 in that a second connecting head 45.2 is formed integrally and of the same material at the second end 43.2 of the transverse arm 223, which is formed with a round tube 86. This second connecting head 45.2 is designed to be constructionally the same and substantially identical to the connecting head 45.1, but in the example of embodiment shown in FIG. 7 does not have a toeboard fastening element 84. In the same mode and manner as the connecting head 45.1 the second connecting head 45.2 is also welded to a post 21.2 and an apertured disc 40.2 welded to the post in the region of the upper end 100.2 thereof, thus as is shown in the example of the connecting head 45 particularly in FIGS. 10 and 11. The second post 21.2 is designed to be constructionally the same and substantially identical as the first post 21.1, so that with respect to the construction and dimensions thereof reference can be made to the foregoing explanations.

As apparent from FIG. 7, the vertical frame element 25.2 is welded to the second post 21.2 to form a U-shaped vertical frame 35.2 which is stiff in bending and torsion and which is designed to be open downwardly, i.e. towards its lower ends 101.1 and 101.2. In that case the second post 21.2 is similarly welded in the region of the one of the small passages 36.1 of the second apertured disc 30.2 to the second connecting head 45.2 in such a manner that the railing element fastening devices 33.1 and 33.2 of the second post are arranged on an inner side of the second post 21.2 disposed opposite the railing element fastening devices 33.1 and 33.2 of the first post 21.1. The vertical U-frame 35.2 thus formed with a single transverse arm 223 and stiff in bending and torsion forms a simple and easily managed vertical frame 35.2 which consequently has a capability of being simply and easily mounted and demounted again. The connecting elements and/or support elements provided for a matching modular scaffolding system can be connected with the two aperture discs 30.1 and 30.2 thereof, in each instance from a single one of the smaller passages 36.1 to all other seven passages 36.2 and 36.1.

Since in the exemplifying embodiment shown in FIG. 7 the connecting head 45.2 is designed to be constructionally the same and substantially identical up to the toeboard fastening element 84 and fastened like the connecting head 45.1, the respective connecting head is denoted in FIGS. 8 to 12 by the superordinate reference numeral 45.

A further example of embodiment of a vertical frame element 125.2 is shown in FIG. 13, which differs from the afore-described vertical frame element 25.2 shown in, in particular, FIG. 7 merely by the construction of its transverse arm 323 and the connection or fastening thereof to the posts 21.1, 21.2 and the apertured discs 30.1, 30.1 thereof. With respect to constructional details concerning the posts 21.1 and 21.2 as well as the apertured discs 30.1 and 30.2 mounted thereon reference can thus made to the foregoing explanations.

The transverse arm 323 of the vertical frame element 125.2 is formed with a U-profile tube 87 which is closed in cross-section and the cross-section of which is illustrated in FIG. 18. This U-profile tube 87 has two lateral U-limbs 89.1, 89.2 which are each formed by double wall regions 88.1, 88.2 and which extend parallel to one another in an upward direction going out from a hollow profile part 90 which is here of C-shaped form. The hollow profile part 90 is formed with an outwardly disposed lower horizontal wall part 91.1 and an inwardly disposed upper horizontal wall part 91.2, which are arranged parallel to one another and which extend substantially over the entire length of the transverse arm 323, thus as far as the two connection heads 145.1 and 145.2 thereof. The outwardly disposed lower horizontal wall part 91.1 extends, with the exception of rounded transition regions in the region of the lower corners of the hollow profile part 90, substantially over the entire width 96 of the hollow profile part 90. By contrast thereto, the inner upper horizontal wall part 91.2 extends only over a certain width 100 of the hollow profile part 90, which here is approximately a third of the total width 96 of the hollow profile part 90. The horizontal wall part 91 extends, going out from the vertical axis of symmetry or centre vertical plane 182 with respect of which the hollow profile part 90 is symmetrically formed, on either side to approximately half the width 100 to both sides, from where a respective wall part 112.1, 112.2, which adjoins obliquely upwardly at an angle of here approximately 45 degrees extends. These wall parts 112.1, 112.2 respectively go over at a spacing 124.1, 124.2 into the respective double wall region 88.1, 88.2, in which these have approximately parallelly extending wall parts. This spacing is here approximately 12 millimeters, thus approximately a third of the width 96 of the hollow profile part 90.

The double wall regions 88.1, 88.2 can be formed with wall parts 129.1, 130.1; 129.2, 130.2, which can be arranged preferably parallel to one another, preferably at a small spacing 131.1, 131.2, with formation of a slot 122.1, 122.2. The spacing 131.1, 131.2 or the slot width is preferably selected to be of such a size that even in the case of the mutually opposite inner surfaces of the wall parts 130.1, 130.2 arranged at the inner side a sufficiently good surface protection is possible, particularly during plating in a plating bath. The spacing 132.1, 132.2 of the free ends 93.1, 93.2 of the U-limbs 89.1, 89.2, which are formed with the double wall regions 88.1, 88.2, up to a transition 133.1, 133.2, at which the wall parts 130.1, 130.2 of the double wall regions 88.1, 88.2 arranged at the inner side go over into the obliquely inwardly extending wall parts 112.1, 112.2 is preferably 10 millimeters to 30 millimeters, particularly approximately 21 millimeters. Moreover, the length or height 134.1, 134.2 of the slot 122.1, 122.2 is preferably 7 millimeters to 27 millimeters, particularly approximately 18.5 millimeters.

The horizontal wall parts 91.1 and 91.2 have a mutual spacing 92 which is here approximately 20 millimeters. The two U-limbs 89.1 and 89.2 extend by the free ends 93.1, 93.2 thereof respectively at the same spacings 94.1, 94.2 above the inner upper horizontal wall part 91.2, the spacing here being approximately 33 millimeters. The free ends 93.1 and 93.2 are formed as longitudinal edges which extend in longitudinal direction of the transverse arm 323 and which form support edges for suspension aids, which can be hung in the U-profile of the U-profile tube 87, of cladding elements 26, particularly of scaffolding floors provided with claws. The hollow profile part 90 in the exemplifying embodiment has a height which is approximately 53 millimeters and has a width which is approximately 49 millimeters. As apparent in FIG. 18, the hollow profile part 90 is designed as or with a cross-sectional closed U-profile tube 87. The desired U-profile form of the U-profile tube 87, with its corresponding double wall regions 88.1, 88.2 and its hollow profile part 90, can be produced by, for example, deforming, particularly by bending over or flanging a metal plate, particularly on a rolling train. In that case, an overlap-free connection of the two plate edges of the metal plate can be produced over the entire length of the metal plate or the transverse arm in advantageous manner particularly by means of laser welding. Alternatively, the transverse arm 323 can be produced by deforming, particularly by stretch-reduction of a cross-sectionally closed tube, particularly a round, square or rectangular tube.

Not only the transverse arm 323, but also all other transverse arms 23, 123, 223, 423, 523 disclosed in this protective right as well as posts, 21; 21.1, 21.2; 121.1, 121.2; 221.2 preferably consist, together with the apertured discs 30; 30.1, 30.2, of steel, wherein these elements are preferably, for reasons of surface protection, plated. However, it is also possible to produce the transverse arms, particularly the transverse arm 323, from light metal, especially from aluminium. In a case of that kind the U-profile tube 87 can, for example, be produced by extruding.

The connecting heads 145.1 and 145.2 which are formed to be constructionally the same and substantially identical are formed integrally and of the same material at the ends 43.1, 43.2 of the transverse arm 323 facing away from one another. The exact design of these connecting heads 145.1 and 145.2 is evident particularly from FIGS. 14 and 15 as well as 19 to 21, where for the sake of simplicity they are denoted by the superordinate reference numeral 145.

Each connecting head 145 has an upper head part 152 and a lower head part 153, which are integrally connected together. The upper head part 152 has upper side wall parts 146.1 and 146.2 and the lower head part 153 has lower side wall parts 147.1 and 147.2. The vertical outer surfaces 148.1, 148.2, 149.1, 149.2 of the side wall parts 1461., 146.2, 147.1, 147.2 include a wedge angle 51 which is here approximately 44 degrees. Provided between the upper head part 152 and the lower head part 153 is a horizontal slot 154 which is open towards the associated post 21.1, 21.2 and towards the associated vertical outer surfaces 148.1, 148.2, 149.1, 149.2.

The slot 154 is bounded by horizontal upper and lower slot surfaces, which are arranged parallel to one another and parallel to the longitudinal axis 38 of the transverse arm 323. The connecting heads 145 are welded to the respective post 21.1, 21.2 in such a manner that the horizontal plane 171 intersecting the slot 154 at half the height of the slot width 170 lies approximately in the centre plane 72 intersecting the respective apertured disc 30.1, 30.2 at the level of its centre. The respective connecting heads 145.1 are formed symmetrically with respect to a vertical plane 182 containing the longitudinal axis 138 of the transverse arm 323 and preferably also the post axes 37.1 and 37.2 (FIG. 19).

The upper head part 152 has upper vertical support surfaces 180.1.1, 180.1.2 and the lower head part 153 has lower vertical support surfaces 180.2.1, 180.2.2, which bear against the outer surface of the associated post 21.1, 21.2.

The connecting heads 145 are also welded to the associated post 21.1, 21.2 in such a manner that the horizontal plane 371 intersecting the slot 154 at half the height of the slot width 170 coincides with the centre plane 72 of the associated apertured disc 30.1, 30.2. The connecting heads 145 are also permanently connected with the associated post 21, without clamping means, by a separate wedge. Moreover, the two connecting heads 145 are also designed in such a manner, and the associated apertured disc arranged to at least partly engage over by its slot 154 in such a manner, that with the exception of the single passage 36.1 of the passages 36; 36.1, 36.2 of the associated apertured disc 30 all other passages 36.1, 36.2 of the associated apertured disc 30 are usable for connection of holding devices, particularly for suspension of conventional connecting heads 445, 545 of support and/or connecting elements, preferably of horizontally and/or diagonally extending scaffolding elements, such as are used in modular scaffoldings.

The connecting heads 145 are preferably also produced by deforming, particularly by pressing together or compressing the respective end 43.1, 43.2 of the transverse arm 323 formed with a U-profile tube.

As apparent from FIG. 21, in the case of the connecting heads 145 the wall parts directly opposite the associated post 21, here the support surfaces 180.1.1, 180.1.2 as well as 180.2.1, 180.2.2 of the upper support wall parts 159.1 and the lower support wall parts 159.2, have a part-cylindrical form and are formed in the cross-section shown in FIG. 21, considered perpendicularly to the longitudinal axis 37 of the associated post 21, with a radius 179.1.1, 179.1.2 of preferably 24.15 millimeters corresponding with the outer radius of the post.

At this point it may be mentioned that the posts 21 preferably formed with round tubes and the transverse arms 123 and 223 preferably formed with round tubes have an outer diameter which corresponds with an outer diameter of 48.3 millimeters usual for modular scaffolding systems. The wall thickness of the posts 21 and the transverse arms 123 and 223 designed with round tubes is preferably 2.7 millimeters. By contrast thereto, the wall thickness 116 of the transverse arm 323 formed with a U-profile tube 87 is preferably 3.2 millimeters.

In the case of the connecting heads 145 as well, the spacings of the upper end 181.1 of the upper support surfaces 180.1.1. 180.1.2 and the spacings of the lower end 181.2 of the lower support surfaces 180.2.1 and 180.2.2 from the horizontal plane 371 intersecting the slot 154 at half the height of the slot width 170 are of the same size. Here, too, the respective slot 154 preferably has a slot width 170 of approximately 10 millimeters, which is slightly greater than the height or the apertured disc thickness of the associated apertured discs 30, which is approximately 9 millimeters.

The connecting heads 145 have at the lower head parts 153 thereof a liquid outlet opening 169.2 which extends up to the lower support surfaces 180.2.1 and 180.2.2.

As apparent particularly from FIG. 15 the length of the vertical outer surfaces 148.1, 148.2; 149.1, 149.2, which run together in the wedge shape, of the side wall parts 146.1, 146.2; 147.1, 147.2 of the connecting heads 145 considered in a direction of projection perpendicular to the longitudinal axis 138 of the transverse arm 323 is approximately 38 millimeters, whereas in contrast thereto the corresponding length 98 of those similarly integral and of the same material at the transverse arms 123, 223 designed with a round tube 86 is only approximately 35 millimeters (FIG. 9).

In addition, the connecting heads 145 are, as shown particularly in FIGS. 16 and 17, welded to the associated post 21 and to the associated apertured disc 30 in the region of all its outer surfaces, which are connected towards the outside to its surfaces disposed directly opposite the associated post 21 and the associated apertured disc 30, by way of a continuous weld seam 162.1, 161.1, 168.1, 165.1, 168.2, 162.1, 162.2, with the exception of the liquid outlet opening 169.2. An optimum connection between the transverse arm 323, or the two connecting heads 145 thereof formed integrally and of the same material, and the posts and also apertured discs 30 associated therewith is thereby made possible so that this connection is formed, in particular manner, to be stiff in bending and torsion.

Thus, also in the case of the connecting heads 145 in each instance the upper connecting head 152 and also the lower connecting head 153 are welded, in regions of the vertical outer surfaces thereof, here the support surfaces 180.1.1, 180.1.2 and 180.2.1, 180.2.2 thereof, and also in the region of the upper and lower horizontal outer surfaces thereof, which are connected towards the outside with the vertical wall parts thereof bearing against the associated post 21, to the associated post 21 by way of a respective continuous weld seam 162.1, 161.1 as well as 162.2 and 161.1, but preferably with the exception of the lower liquid outlet opening 169.2. Moreover, in each instance the upper head part 152 and the lower head part 153 are welded, in regions of the vertical outer surfaces 148.1, 148.2; 149.1, 149.2 thereof, which are connected towards the outside with the horizontal support surfaces of the slot 154, to the associated apertured disc 30 over the entire width of the part of the associated apertured disc 30 protruding into the slot 154 by way of a respective continuous weld seam 168.1 and or 168.2. Finally, these connecting heads 145 are also welded, in regions of vertical outer surfaces 148.1, 148.2; 149.1, 149.2, which are connected towards the outside with the vertical slot surfaces 167 of the slot 154, to the end surfaces, which are disposed in the region of the slot 154, of the associated apertured disc 30 by way of a respective continuous weld seam 165.1.

A further exemplifying embodiment of a vertical frame element 25.3 is shown in FIGS. 22 and 23, the transverse arm 223 of which, which here is designed as or with a round tube 86, is welded by way of a connecting head 451, which is formed thereat integrally and of the same material, to a post 121.1 and the single apertured disc 30.1 thereof again in such a manner that the transverse arm 223 extends perpendicularly to the post 121.1. This post 121.1 is a post of the same construction and substantially identical to the post 21.2 shown in FIG. 5, in which the apertured disc 30 is thus not arranged in the region of the upper end 101.1 of the post 21, but in another region, here below the centre thereof, and in particular at a spacing 103.1 which is approximately 90 centimeters. Consequently, the vertical frame element 35.3 is formed to be h-shaped.

By contrast to the exemplifying embodiment illustrated in FIG. 7 the vertical frame element 25.3 is welded by way of its transverse arm 223, or the second connecting head 45.2 formed thereat integrally and of the same material, to a short second post 221.2 and the apertured disc 30.2, which is welded to this in the region of the upper end 100.2 thereof, in such a manner that the second post 221.2 extends parallel to the first post 121.1 and the two posts 121.1 and 221.2 together with the transverse arm 223 are arranged in a common vertical plane. Consequently, a vertical frame 35.3 of h-shaped form is now formed by the vertical frame element 125. The short post 221.2 has a total length, extending from its lower end 101.2 to its upper end 100.2, of approximately 116.5 centimeters. With respect to its upper end region, which is formed as a tube connector 42.1, this short post 221.2 is formed to be constructionally the same and substantially identical to the remaining posts. The same applies overall to the lower end region thereof and the tube design thereof and other dimensions.

By contrast to the post 21.2 shown in FIG. 7 the short post 221.2 has a length 106.2, from its lower end 101.2 to its upper end region 41.2.1, of only approximately 100 centimeters. The apertured disc 30.2 of the short post 221.2 has from the lower end 101.2 thereof a spacing 103.2 which, as in the case of the first post 121.1 which there is denoted by the reference numeral 103.1, is approximately 90 centimeters. Consequently, an h-shaped vertical standing frame 35.3 is formed by the vertical frame element 25.3. This construction can, as an alternative to the construction shown in FIG. 3, similarly be used for constructing a leading railing. For this purpose the vertical frame 35.3 or the posts 121.1 and 221.2 thereof can be respectively plugged onto a further short post 207 as is illustrated in FIG. 22. This short post 207 has from its lower end to its upper end region a respective length which is approximately 100 centimeters. Two fastening devices 33.1 and 33.2 are respectively provided at this short post 207 at a spacing from one another in longitudinal direction. In that case the fastening device 33.1 is arranged at a spacing 118, which is here approximately 90 centimeters, from the lower end, of the post 207 (FIG. 30). By contrast thereto the second fastening device 33.2 is arranged at a spacing 119, which is here approximately 40 centimeters, from the lower end of the post 207. Accordingly, the two fastening devices 33.1 and 33.2 of the short post 207 again have a spacing 117 from one another which is approximately 50 centimeters.

As a result, a lateral scaffolding frame construction can be realised from these elements, i.e. from the h-shaped vertical frame 35.3 and from the two short posts 207, just as is possible in the same manner by a combination of, for example, the elements shown in FIG. 3, i.e. the vertical frame element 25.1 with the second post 21.2, which is wedge-fastened thereto to be detachable again, and the short post 107.

A further exemplifying embodiment of a vertical frame element 125.3 as shown in FIGS. 24 and 25, which differs from the vertical frame element 125.3 shown in FIGS. 22 and 23 only by the construction and fastening of its transverse arm 323 formed as or with the U-profile tube 87. This transverse arm is formed to be constructionally the same and substantially identical to the transverse arm 323 evident from FIGS. 13 to 21, so that to this extent and also with respect to the arrangement and fastening thereof by welding to the two posts reference can be made to the foregoing explanations.

A further exemplifying embodiment of a vertical frame element 25.4, which is welded to a second post 121.2 to form an H-shaped vertical frame 35.4, is shown in FIGS. 26 and 27. This vertical frame element 25.4 or this vertical frame 35.4 comprises a transverse arm 223, which corresponds, with same construction and substantially identically, with the transverse arm 223 shown in the exemplifying embodiment according to FIG. 7, so that to that extent and with respect to the fastening or welding thereof to the two posts and the apertured discs 30.1, 30.2 mounted thereat reference can be made to the preceding text passages. In the same manner as in the exemplifying embodiment shown in FIGS. 22 and 23 the vertical frame element 25.4 is formed from a long post 121.1 and a transverse arm 323. The transverse arm 323 is designed with a first connecting head which is formed thereat integrally and of the same material and which is welded to the first post 121.1 and the apertured disc 30.1 welded thereto at a height 103.1.

The transverse arm 223 is welded by way of a second connecting head 45.2, which is formed to be constructionally the same and substantially identical and which here is similarly not provided with a toeboard fastening element 84, to a second post 121.2 and the apertured disc 30.2 thereof, which is arranged at a spacing 103.2 from the lower end 101.2 thereof, the spacing corresponding with the spacing 103.1 of the apertured disc 30.1 welded to the post 121.1.

By contrast to the exemplifying embodiment shown in FIGS. 22 and 23 the second post 121.2 now has the same length and form as the first post 121.1. In this manner the vertical frame element 25.4 is constructed as an H-shaped vertical frame 35.4, the posts 121.1 and 121.2 of which together with the transverse arm 223 are again arranged in a common frame plane.

In the same manner as in the exemplifying embodiment according to FIG. 22 the vertical frame 35.4 or the two posts 121.1 and 121.2 thereof can advantageously be plugged onto a short post 207 so that in this manner a leading railing can also be realised. However, in the illustrated exemplifying embodiment this is then not only on one frame inner side, but also on both frame inner sides, so that fall safety means 27 designed as railing elements, particularly railing rods, for security against falling can be mounted not only on the railing element fastening devices 33.1 and 33.2 of the first post 121.1, but also on the railing element fastening devices 33.1 and 33.2 of the second post 121.2 before walking upon the second storey.

A further exemplifying embodiment of a vertical frame element 125.4 and an H-shaped vertical frame 135.4 formed therefrom are shown in FIGS. 28 and 29. This further exemplifying embodiment differs from the exemplifying embodiment shown in FIGS. 26 and 27 exclusively by the form and fastening of the transverse arm 323 constructed as a U-profile tube 87. This transverse arm 323 and the fastening thereof by welding to the respective post and the respective apertured disc were already described in detail in the foregoing in conjunction with the other exemplifying embodiments, so that to that extent reference can be made thereto (cf. FIGS. 13 to 20).

A further exemplifying embodiment of a vertical frame element 25.5 is illustrated in FIGS. 32 to 39. In this, by contrast to the afore-described exemplifying embodiments the first connecting head 245 is designed as a separate component. Consequently, the transverse arm 523 is now of multi--part construction. The connecting head 245 is welded in usual mode and manner to the rod element 244, which is designed as a round tube, of the transverse arm 523. This new connecting head 245 is the new connecting head which is illustrated in FIGS. 58*a*) to *g*) and which by comparison with the mass-production connecting head, which is illustrated in FIGS. 59*a*) to *g*), of the applicant is free of wedge openings, i.e. is constructed without one or several wedge openings for a plug-through wedge. This connecting head 245 is also welded not only to the post 21, but also to the apertured disc mounted thereon, as apparent particularly from FIGS. 36 to 39, and, in particular, now with formation of a weld seam 262.1, 261.1, 263.1, 365.1, 263.2, 261.2, 262.2 continuous at the full circumference. With respect to further constructional details concerning this connecting head 245 and the permanent fastening thereof to the post 21 reference can be made on the one hand to the foregoing explanations and on the other hand to the explanations at the end of the description of the figures.

A further exemplifying embodiment of a vertical frame element 25.6 is shown in FIGS. 40 to 43. This exemplifying embodiment differs from the exemplifying embodiment shown in FIGS. 32 to 39 exclusively by the fact that a conventional mass-production connecting head of the applicant is now used as first connecting head 445 for the vertical frame element 25.6, as this is illustrated in particular in FIGS. 59*a*) to *g*).

A further exemplifying embodiment of a vertical frame element 125.5 is shown in FIGS. 44 to 51. This is characterised by a transverse arm 323 designed with a U-profile tube 87 and a connecting head 345 which is connected with this in multi-part manner by welding and which is again a separate component. However, this connecting head 345 is designed in its connecting region, which is associated with the rod element 444—designed as a U-profile tube 87—of the transverse arm 323, to be appropriately matched to the form of this U-profile tube 87. By contrast to the mass-production connecting head 545, which is shown in FIGS. 57*a*) to *g*), of the applicant the new connecting head 345 is designed to be free of wedge openings for a separate plug-through wedge. This new connecting head 345 is illustrated particularly in FIGS. 56*a*) to *g*). This connecting head 345 can also, as shown in FIGS. 48 to 51, be welded in the region of its outer surfaces to the post 21 and to the apertured disc 30, which is mounted thereon, by way of a continuous weld seam 362.1, 361.1, 363.1, 365.1, 363.2, 361.2 and 362.2. With respect to further details concerning this connecting head 345 reference is also made to FIGS. 44 to 51 as well as to the introduction to the description.

Finally, once again a further exemplifying embodiment of a vertical frame element 125.6 is shown in FIGS. 52 to 55. This exemplifying embodiment differs from the exemplifying embodiment illustrated in FIGS. 44 to 51 only in that the connecting head 545 is a mass-production connecting head of the applicant, which is illustrated, in particular, FIGS. 57*a*) to *g*).

It will be obvious that the invention or the inventions is or are not restricted merely to the exemplifying embodiments shown in the figures.

REFERENCE NUMERAL LIST

| | |
|---|---|
| 20 | three-dimensional framework (scaffolding) |
| 21 | post |
| 21.1 | first post (long, with apertured disc at the top) |
| 21.2 | second post (long, with apertured disc at the top) |
| 22 | longitudinal bar |
| 23 | transverse arm (crossbar) |
| 24 | diagonal element (diagonal rod) |
| 25 | vertical frame element |
| 25.1 | vertical frame element |
| 25.2 | vertical frame element |
| 25.3 | vertical frame element |
| 25.4 | vertical frame element |
| 25.5 | vertical frame element |
| 25.6 | vertical frame element |
| 26 | cladding unit (scaffolding floor or plank) |
| 27 | safety means against falling (railing element, railing rod) |
| 28 | connecting nodes |
| 29 | outer diameter |

-continued

REFERENCE NUMERAL LIST

| | |
|---|---|
| 30 | apertured disc |
| 30.1 | first apertured disc |
| 30.2 | second apertured disc |
| 31 | outer end surface of 30 |
| 32 | outer diameter |
| 33 | railing element fastening device |
| 33.1 | first railing element fastening device |
| 33.2 | second railing element fastening device |
| 34 | outer diameter of 21 |
| 35 | vertical frame (scaffolding frame) |
| 35.1 | vertical frame (scaffolding frame) |
| 35.2 | vertical frame (scaffolding frame) |
| 35.3 | vertical frame (scaffolding frame) |
| 35.4 | vertical frame (scaffolding frame) |
| 36 | passage |
| 36.1 | small passage |
| 36.2 | large passage |
| 37 | longitudinal axis of 21 |
| 37.1 | longitudinal axis of 21.2 |
| 37.2 | longitudinal axis of 21.2 |
| 38 | longitudinal axis of 23 |
| 39 | apertured disc thickness |
| 40 | upper longitudinal outer edge (support edge) |
| 41.1.1 | upper end region |
| 41.1.2 | lower end region |
| 41.2.1 | upper end region |
| 41.2.2 | lower end region |
| 42 | tube connector |
| 42.1 | tube connector |
| 42.2 | tube connector |
| 43.1 | first end |
| 43.2 | second end |
| 44 | rod element |
| 45 | connecting head |
| 45.1 | first connecting head |
| 45.2 | second connecting head |
| 46.1 | upper side wall part |
| 46.2 | upper side wall part |
| 47.1 | lower side wall part |
| 47.2 | lower side wall part |
| 48.1 | upper vertical outer surface of 46.1 |
| 48.2 | upper vertical outer surface of 46.2 |
| 49.1 | lower vertical outer surface of 47.1 |
| 49.2 | lower vertical outer surface of 47.2 |
| 50 | post and disc centre (centre) |
| 51 | wedge angle |
| 52 | upper head part |
| 53 | lower head part |
| 54 | slot |
| 55 | L-frame element |
| 56 | U-frame |
| 57 | H-frame |
| 58 | h-frame |
| 59.1 | upper support wall part |
| 59.2 | lower support wall part |
| 60.1 | upper horizontal outer surface |
| 60.2 | lower horizontal outer surface |
| 61.1 | upper vertical weld seam |
| 61.2 | lower vertical weld seam |
| 62.1 | upper horizontal weld seam |
| 62.2 | lower horizontal weld seam |
| 63.1 | upper horizontal weld seam |
| 63.2 | lower horizontal weld seam |
| 65.1 | vertical weld seam |
| 65.2 | vertical weld seam |
| 66.1 | upper horizontal slot surface |
| 66.2 | lower horizontal slot surface |
| 67 | vertical slot surface |
| 68.1 | upper weld seam |
| 68.2 | lower weld seam |
| 69.1 | liquid outlet opening |
| 69.2 | liquid outlet opening |

-continued

REFERENCE NUMERAL LIST

| | |
|---|---|
| 70 | slot width |
| 71 | horizontal plane |
| 72 | centre plane of 30 |
| 74 | wedge |
| 75 | height |
| 76.1 | height of 52 |
| 76.2 | height of 53 |
| 77.1 | upper outer surface |
| 77.2 | lower outer surface |
| 77.2.1 | lower outer surface |
| 77.2.2 | lower outer surface |
| 78.1 | angle |
| 78.2 | angle |
| 78.2.1 | angle |
| 78.2.2 | angle |
| 79.1.1 | radius |
| 79.1.2 | radius |
| 79.2.1 | radius |
| 79.2.2 | radius |
| 80.1 | upper support surface |
| 80.1.1 | upper support surface |
| 80.1.2 | upper support surface |
| 80.2 | lower support surface |
| 80.2.1 | lower support surface |
| 80.2.2 | lower support surface |
| 81.1 | upper end |
| 81.2 | lower end |
| 82 | vertical plane |
| 83.1 | upper wall part |
| 83.2 | lower wall part |
| 84 | toeboard fastening element (pin) |
| 85 | spacing |
| 86 | round rube |
| 87 | U-profile tube (U-profile) |
| 88.1 | double wall region |
| 88.2 | double wall region |
| 89.1 | U-limb |
| 89.2 | U-limb |
| 90 | box-shaped hollow profile part |
| 91.1 | lower horizontal wall part |
| 91.2 | upper horizontal wall part |
| 92 | spacing |
| 93 | free end |
| 93.1 | free end |
| 93.2 | free end |
| 94.1 | spacing |
| 94.2 | spacing |
| 95 | height of 90 |
| 96 | width of 90 |
| 97 | spacing |
| 98 | length |
| 99 | circumferential angle |
| 100 | width of 91.2 |
| 100.1 | upper end |
| 100.2 | upper end |
| 101.1 | lower end |
| 101.2 | lower end |
| 102.1 | spacing |
| 102.2 | spacing |
| 103.1 | spacing |
| 103.2 | spacing |
| 104.1 | length |
| 104.2 | length |
| 105.1 | length |
| 105.2 | length |
| 106.1 | length |
| 106.2 | length |
| 107 | post (short, without apertured disc and without fastening devices) |
| 108 | length |
| 110.1 | round tube |
| 110.2 | round tube |
| 111.1 | outer diameter |
| 111.2 | outer diameter |
| 112.1 | wall part |
| 112.2 | wall part |

-continued

REFERENCE NUMERAL LIST

| | |
|---|---|
| 113 | frame plane |
| 114 | wall thickness |
| 114.1 | wall thickness |
| 114.2 | wall thickness |
| 115 | wall thickness |
| 116 | wall thickness |
| 117 | spacing |
| 118 | spacing |
| 119 | spacing |
| 120 | spacing |
| 121.1 | first post (long, with apertured disc below centre) |
| 121.1 | second post (long, with apertured disc below centre) |
| 123 | transverse arm (crossbar) |
| 124.1 | spacing |
| 124.2 | spacing |
| 125.2 | vertical frame element |
| 125.3 | vertical frame element |
| 125.4 | vertical frame element |
| 125.5 | vertical frame element |
| 125.6 | vertical frame element |
| 126 | spacing |
| 127.1 | first storey |
| 127.2 | second storey |
| 127.3 | third storey |
| 128 | starting member |
| 129.1 | wall part (outer) |
| 129.2 | wall part (inner) |
| 130.1 | wall part (outer) |
| 130.2 | wall part (inner) |
| 131.1 | spacing (slot width) |
| 131.2 | spacing (slot width) |
| 132.1 | spacing |
| 132.2 | spacing |
| 133.1 | transition |
| 133.2 | transition |
| 134.1 | height (slot length) |
| 134.2 | height (slot length) |
| 135.2 | vertical frame |
| 135.3 | vertical frame |
| 135.4 | vertical frame |
| 145 | connecting head |
| 145.1 | connecting head |
| 145.2 | connecting head |
| 146.1 | upper side wall part |
| 146.2 | upper side wall part |
| 147.1 | lower side wall part |
| 147.2 | lower side wall part |
| 148.1 | upper vertical outer surface of 146.1 |
| 148.2 | upper vertical outer surface of 146.2 |
| 149.1 | lower vertical outer surface of 147.1 |
| 149.2 | lower vertical outer surface of 147.2 |
| 1501 | wedge angle |
| 152 | upper head part |
| 153 | lower head part |
| 154 | slot |
| 159.1 | upper support wall part |
| 159.2 | lower support wall part |
| 160.1 | upper horizontal outer surface |
| 160.2 | lower horizontal outer surface |
| 161.1 | upper vertical weld seam |
| 161.2 | lower vertical weld seam |
| 162.1 | upper horizontal weld seam |
| 162.2 | lower horizontal weld seam |
| 163.1 | upper horizontal weld seam |
| 163.2 | lower horizontal weld seam |
| 165.1 | vertical weld seam |
| 165.2 | vertical weld seam |
| 166.1 | upper horizontal slot surface |
| 166.2 | lower horizontal slot surface |
| 167 | vertical slot surface |
| 169.1 | liquid outlet opening |

-continued

| REFERENCE NUMERAL LIST | |
|---|---|
| 169.2 | liquid outlet opening |
| 170 | slot width |
| 171 | horizontal plane |
| 173.1 | upper wedge opening |
| 173.2 | lower wedge opening |
| 175 | height |
| 176.1 | height of 152 |
| 176.2 | height of 153 |
| 177.1 | upper outer surface |
| 177.2 | lower outer surface |
| 177.2.1 | lower outer surface |
| 177.2.2 | lower outer surface |
| 178.1 | angle |
| 178.2 | angle |
| 178.2.1 | angle |
| 178.2.2 | angle |
| 179.1.1 | radius |
| 179.1.2 | radius |
| 179.2.1 | radius |
| 179.2.2 | radius |
| 180.1 | upper support surface |
| 180.1.1 | upper support surface |
| 180.1.2 | upper support surface |
| 180.2 | lower support surface |
| 180.2.1 | lower support surface |
| 180.2.2 | lower support surface |
| 181.1 | upper end |
| 181.2 | lower end |
| 182 | vertical plane |
| 183.1 | upper wall part |
| 183.2 | lower wall part |
| 197 | spacing |
| 198 | length |
| 207 | short post (without apertured disc, with fastening devices) |
| 209 | weld seam |
| 221.2 | second post (short, apertured disc at top) |
| 223 | transverse arm (crossbar) |
| 244 | rod element |
| 245 | connecting head |
| 246.1 | upper side wall part |
| 246.2 | upper side wall part |
| 247.1 | lower side wall part |
| 247.2 | lower side wall part |
| 248.1 | upper vertical outer surface of 246.1 |
| 248.2 | upper vertical outer surface of 246.2 |
| 249.1 | lower vertical outer surface of 247.1 |
| 249.3 | lower vertical outer surface of 247.2 |
| 251 | wedge angle |
| 252 | upper head part |
| 253 | lower head part |
| 254 | slot |
| 259.1 | upper support wall part |
| 259.2 | lower support wall part |
| 260.1 | upper horizontal outer surface |
| 260.2 | lower horizontal outer surface |
| 261.1 | upper vertical weld seam |
| 261.2 | lower vertical weld seam |
| 262.1 | upper horizontal weld seam |
| 262.2 | lower horizontal weld seam |
| 263.1 | upper horizontal weld seam |
| 263.2 | lower horizontal weld seam |
| 265.1 | vertical weld seam |
| 265.2 | vertical weld seam |
| 266.1 | upper horizontal slot surface |
| 266.2 | lower horizontal slot surface |
| 267 | vertical slot surface |
| 269.1 | liquid outlet opening |
| 269.2 | liquid outlet opening |
| 270 | slot width |
| 271 | horizontal plane |
| 273.1 | upper wedge opening |

-continued

| REFERENCE NUMERAL LIST | |
|---|---|
| 273.2 | lower wedge opening |
| 275 | height |
| 276.1 | height of 252 |
| 276.2 | height of 253 |
| 277.1 | upper outer surface |
| 277.2 | lower outer surface |
| 277.2.1 | lower outer surface |
| 277.2.2 | lower outer surface |
| 278.1 | angle |
| 278.2 | angle |
| 278.2.1 | angle |
| 278.2.2 | angle |
| 279.1.1 | radius |
| 279.1.2 | radius |
| 279.2.1 | radius |
| 279.2.2 | radius |
| 280.1 | upper support surface |
| 280.1.1 | upper support surface |
| 280.1.2 | upper support surface |
| 280.2 | lower support surface |
| 280.2.1 | lower support surface |
| 280.2.2 | lower support surface |
| 281.1 | upper end |
| 281.2 | lower end |
| 282 | vertical plane |
| 283.1 | upper wall part |
| 283.2 | lower wall part |
| 297 | spacing |
| 298 | length |
| 309 | weld seam |
| 323 | transverse arm (crossbar) |
| 345 | connecting head |
| 346.1 | upper side wall part |
| 346.2 | upper side wall part |
| 347.1 | lower side wall part |
| 347.2 | lower side wall part |
| 348.1 | upper vertical outer surface of 346.1 |
| 348.2 | upper vertical outer surface of 346.2 |
| 349.1 | lower vertical surface of 347.1 |
| 349.2 | lower vertical surface of 347.2 |
| 351 | wedge angle |
| 352 | upper head part |
| 353 | lower head part |
| 354 | slot |
| 359.1 | upper support wall part |
| 359.2 | lower support wall part |
| 360.1 | upper horizontal outer surface |
| 360.2 | lower horizontal outer surface |
| 361.1 | upper vertical weld seam |
| 361.2 | lower vertical weld seam |
| 362.1 | upper horizontal weld seam |
| 362.2 | lower horizontal weld seam |
| 363.1 | upper horizontal weld seam |
| 363.2 | lower horizontal weld seam |
| 365.1 | vertical weld seam |
| 365.2 | vertical weld seam |
| 366.1 | upper horizontal slot surface |
| 366.2 | lower horizontal slot surface |
| 367 | vertical slot surface |
| 369.1 | liquid outlet opening |
| 369.2 | liquid outlet opening |
| 370 | slot width |
| 371 | horizontal plane |
| 373.1 | upper wedge opening |
| 373.2 | lower edge opening |
| 375 | height |
| 376.1 | height of 352 |
| 376.2 | height of 353 |
| 377.1 | upper outer surface |
| 377.2 | lower outer surface |
| 377.2.1 | lower outer surface |
| 377.2.2 | lower outer surface |
| 378.1 | angle |
| 378.2 | angle |
| 378.2.1 | angle |

-continued

| REFERENCE NUMERAL LIST | |
|---|---|
| 378.2.2 | angle |
| 379.1.1 | radius |
| 379.1.2 | radius |
| 379.2.1 | radius |
| 379.2.2 | radius |
| 380.1 | upper support surface |
| 380.1.1 | upper support surface |
| 380.1.2 | upper support surface |
| 380.2 | lower support surface |
| 380.2.1 | lower support surface |
| 380.2.2 | lower support surface |
| 381.1 | upper end |
| 381.2 | lower end |
| 382 | vertical plane |
| 383.1 | upper wall part |
| 383.2 | lower wall part |
| 397 | spacing |
| 398 | length |
| 423 | transverse arm (crossbar) |
| 444 | rod element |
| 445 | connecting head |
| 446.1 | upper side wall part |
| 446.2 | upper side wall part |
| 447.1 | lower side wall part |
| 447.2 | lower side wall part |
| 448.1 | upper vertical outer surface of 446.1 |
| 448.2 | upper vertical outer surface of 446.2 |
| 449.1 | lower vertical outer surface of 447.1 |
| 449.2 | lower vertical outer surface of 447.2 |
| 451 | wedge angle |
| 452 | upper head part |
| 453 | lower head part |
| 454 | slot |
| 459.1 | upper support wall part |
| 459.2 | lower support wall part |
| 460.1 | upper horizontal outer surface |
| 460.2 | lower horizontal outer surface |
| 461.1 | upper vertical weld seam |
| 461.2 | lower vertical weld seam |
| 462.1 | upper horizontal weld seam |
| 462.2 | lower horizontal weld seam |
| 463.1 | upper horizontal weld seam |
| 463.2 | lower horizontal weld seam |
| 465.1 | vertical weld seam |
| 465.2 | vertical weld seam |
| 466.1 | upper horizontal slot surface |
| 466.2 | lower horizontal slot surface |
| 467 | vertical slot surface |
| 469.1 | liquid outlet opening |
| 469.2 | liquid outlet opening |
| 470 | slot width |
| 471 | horizontal plane |
| 473.1 | upper wedge opening |
| 473.2 | lower wedge opening |
| 475 | height |
| 476.1 | height of 452 |
| 476.2 | height of 453 |
| 477.1 | upper outer surface |
| 477.2 | lower outer surface |
| 477.2.1 | lower outer surface |
| 477.2.2 | lower outer surface |
| 478.1 | angle |
| 478.2 | angle |
| 478.2.1 | angle |
| 478.2.2 | angle |
| 479.1.1 | radius |
| 479.1.2 | radius |
| 479.2.1 | radius |
| 479.2.2 | radius |
| 480.1 | upper support surface |
| 480.1.1 | upper support surface |
| 480.1.2 | upper support surface |
| 480.2 | lower support surface |

-continued

| REFERENCE NUMERAL LIST | |
|---|---|
| 480.2.1 | lower support surface |
| 480.2.2 | lower support surface |
| 481.1 | upper end |
| 481.2 | lower end |
| 482 | vertical plane |
| 483.1 | upper wall part |
| 483.2 | lower wall part |
| 497 | spacing |
| 498 | length |
| 523 | transverse arm (crossbar) |
| 545 | connecting head |
| 546.1 | upper side wall part |
| 546.2 | upper side wall part |
| 547.1 | lower side wall part |
| 547.2 | lower side wall part |
| 548.1 | upper vertical outer surface of 546.1 |
| 548.2 | upper vertical outer surface of 546.2 |
| 549.1 | lower vertical outer surface of 547.1 |
| 549.2 | lower vertical outer surface of 547.2 |
| 551 | wedge angle |
| 552 | upper head part |
| 553 | lower head part |
| 554 | slot |
| 559.1 | upper support wall part |
| 559.2 | lower support wall part |
| 560.1 | upper horizontal outer surface |
| 560.2 | lower horizontal outer surface |
| 561.1 | upper vertical weld seam |
| 561.2 | lower vertical weld seam |
| 562.1 | upper horizontal weld seam |
| 562.2 | lower horizontal weld seam |
| 563.1 | upper horizontal weld seam |
| 563.2 | lower horizontal weld seam |
| 565.1 | vertical weld seam |
| 565.2 | vertical weld seam |
| 566.1 | upper horizontal slot surface |
| 566.2 | lower horizontal slot surface |
| 567 | vertical slot surface |
| 569.1 | liquid outlet opening |
| 569.2 | liquid outlet opening |
| 570 | slot width |
| 571 | horizontal plane |
| 573.1 | upper wedge opening |
| 573.2 | lower wedge opening |
| 575 | height |
| 576.1 | height of 552 |
| 576.2 | height of 553 |
| 577.1 | upper outer surface |
| 577.2 | lower outer surface |
| 577.2.1 | lower outer surface |
| 577.2.2 | lower outer surface |
| 578.1 | angle |
| 578.2 | angle |
| 578.2.1 | angle |
| 578.2.2 | angle |
| 579.1.1 | radius |
| 579.1.2 | radius |
| 579.2.1 | radius |
| 579.2.2 | radius |
| 580.1 | upper support surface |
| 580.1.1 | upper support surface |
| 580.1.2 | upper support surface |
| 580.2 | lower support surface |
| 580.2.1 | lower support surface |
| 580.2.2 | lower support surface |
| 581.1 | upper end |
| 581.2 | lower end |
| 582 | vertical plane |
| 583.1 | upper wall part |
| 583.2 | lower wall part |
| 597 | spacing |
| 598 | length |

The invention claimed is:

1. A vertical scaffolding frame of metal comprising:

a first vertical post having:

an upper end region formed as a tube connector and having a first cross section; and a lower end region having a second cross section different from the first cross section;

a first apertured disc having several passages, arranged concentrically with respect to the first vertical post, surrounding the first vertical post to form a flange, and permanently fastened to the first vertical post, the first apertured disc being a sole apertured disc fastened to the first vertical post;

a first railing element fastening device at the first vertical post at a spacing from the first apertured disc and being able to fasten a railing element serving as a safety device against falling;

a second vertical post having:

an upper end region forming a tube connector and having a first cross section; and a lower end region having a second cross section different from the first cross section; and a second apertured disc having several passages, arranged concentrically with respect to the second vertical post, surrounding the second vertical post to form a flange, and permanently connected with the second vertical post, the second apertured disc being a sole apertured disc fastened to the second vertical post;

wherein the first railing element fastening device is constructed differently from the first apertured disc and differently from the second apertured disc;

wherein the first vertical post and the second vertical post are connected by one single rod-shaped horizontal transverse arm extending transversely away from both the first vertical post and the second vertical post, permanently connected to both the first vertical post and the second vertical post by welding to be stiff in bending and torsion, and forming one single crossbar having:

a first end;

a first connecting head at the first end, bounded by side wall parts having vertical outer surfaces, and having an upper head part, a lower head part, and a slot between the upper head part and the lower head part, the vertical outer surfaces of the side wall parts of the first connecting head running together to form a wedge and having a wedge angle;

a second end facing away from the first end; and a second connecting head at the second end, bounded by side wall parts having vertical outer surfaces, and having an upper head part, a lower head part, and a slot between the upper head part and the lower head part, the vertical outer surfaces of the side wall parts of the second connecting head running together to form a wedge and having a wedge angle;

wherein the crossbar is formed with a rod element extending straight between the first connecting head and the second connecting head;

wherein a permanent connection of the first vertical post and the second vertical post is formed by the one single crossbar;

wherein the first connecting head is plugged by a slot of the first connecting head, which is open towards the first vertical post and towards the vertical outer surfaces of the first connecting head, onto the first apertured disc such that the first apertured disc at least partly projects into the slot of the first connecting head and such that the wedge of the first connecting head is formed by the vertical outer surfaces of the side wall parts of the first connecting head running together towards a center of the first vertical post and towards a center of the first apertured disc;

wherein the first connecting head is permanently connected with the first vertical post by welding;

wherein the second connecting head is plugged by a slot of the second connecting head, which is open towards the second vertical post and towards the vertical outer surfaces of the second connecting head, onto the second apertured disc such that the second apertured disc at least partly projects into the slot of the second connecting head, and such that the wedge of the second connecting head is formed by the vertical outer surfaces of the side wall parts of the second connecting head running together towards a center of the second vertical post and towards a center of the second apertured disc; and wherein the second connecting head is permanently connected with the second vertical post by welding.

2. The vertical scaffolding frame according to claim 1, wherein the upper head part and the lower head part of the first connecting head, the upper head part and the lower head part of the second connecting head, or the upper head part and the lower head part of the first connecting head and the upper head part and the lower head part of the second connecting head are, in regions of the vertical outer surfaces of the side wall parts, welded to the first vertical post, to the second vertical post, or to the first vertical post and to the second vertical post, respectively, by a respective continuous weld seam.

3. The vertical scaffolding frame according to claim 1, wherein the slots of the first connecting head and of the second connecting head have respective horizontal slot surfaces, wherein the vertical outer surfaces of the side wall parts of the first connecting head and of the second connecting head are connected towards an outside of the first connecting head and of the second connecting head with the respective horizontal slot surfaces of the slots of the first connecting head and of the second connecting head, wherein the first apertured disc projects into the slot of the first connecting head via a first-apertured-disc-projecting part of the first apertured disc, wherein the second apertured disc projects into the slot of the second connecting head via a second-apertured-disc-projectinq part of the second apertured disc, and wherein the upper head part and the lower head part of the first connecting head, the upper head part and the lower head part of the second connecting head, or the upper head part and the lower head part of the first connecting head and the upper head part and the lower head part of the second connecting head are, in regions of the vertical outer surfaces, welded over the entire width of:

the first-apertured-disc-projectinq part of the first apertured disc, the second-apertured-disc-projecting part of the second apertured disc, or the first-apertured-disc-projecting part and the second-aperture-disc-projecting part, respectively, to:

the first apertured disc, the second apertured disc, or the first apertured disc and the second apertured disc, respectively, by way of a respective continuous weld seam.

4. The vertical scaffolding frame according to claim 1, wherein the slots of the first connecting head and of the second connecting head have respective horizontal slot surfaces and respective vertical slot surfaces, wherein the vertical outer surfaces of the side wall parts of the first connecting head and of the second connecting head are connected towards an outside of the first connecting head and of the second connecting head with the respective horizontal slot surfaces of the slots of the first connecting head and of the second connecting head, wherein the first apertured disc projects into the slot of the first connecting head via a part of the first apertured disc and has an end surface disposed in a region of the slot of the first connecting head, wherein the second apertured disc projects into the slot of the second connecting head via a part of the second apertured disc and has an end surface disposed in a region of the slot of the second connecting head, wherein the upper head part and the lower head part of the first connecting head, the upper head part and the lower head part of the second connecting head, or the upper head part and the lower head part of the first connecting head and the upper head part and the lower head part of the second connecting head are:

in regions of the vertical outer surfaces of the side wall parts, welded to the first vertical post, to the second vertical post, or to the first vertical post and to the second vertical post, respectively, by way of a first respective continuous weld seam, and in regions of the vertical outer surfaces connected towards the outside with the horizontal slot surfaces of the slots, welded each time over an entire width of the part of the first apertured disc, an entire width of the part of the second apertured disc, or entire widths, respectively, of the part of the first apertured disc and of the part of the second apertured disc by way of the first respective continuous weld seam to the first apertured disc, to the second apertured disc, or to the first and to the second apertured discs, respectively, and in regions of vertical outer surfaces connected towards the outside with the vertical slot surfaces of the slot, welded to the end surfaces of the first apertured disc, to the end surfaces of the second apertured disc, or to the end surfaces of the first and of the second apertured discs, respectively, by way of a second respective continuous weld seam.

5. The vertical scaffolding frame according to claim 1, wherein the first connecting head and the second connecting head have outer surfaces connected towards an outside of the first connecting head and of the second connecting head, wherein the first connecting head has a further surface directly opposite the first vertical post and the first apertured disc, wherein the second connecting head has a further surface directly opposite the second vertical post and the second apertured disc, wherein the outer surface of the first connecting head is connected to the further surface of the first connecting head, wherein the outer surface of the second connecting head is connected to the further surface of the second connecting head, wherein the first connecting head, the second connecting head, or both the first connecting head and the second connecting head is or are, in a region or regions of the outer surface or the outer surfaces welded to the first vertical post and to the first apertured disc, to the second vertical post and to the second apertured disc, or respectively to the first vertical post and the first apertured disc and the second vertical post and the second apertured disc with a respective weld seam, wherein each respective weld seam is continuous except for a respective liquid outlet opening, and wherein each respective liquid outlet opening is a sole interruption of the respective weld seam.

6. The vertical scaffolding frame according to claim 1, wherein the several passages of the first apertured disc, the several passages of the second apertured disc, or the several passages of the first apertured disc and of the second apertured disc, respectively, comprise at least three passages for connection of at least one member selected from the group consisting of suspension elements, supporting elements and connecting elements, and wherein each passage of the at least three passages is arranged relative to an adjacent passage of the at least three passages at the same circumferential angle.

7. The vertical scaffolding frame according to claim 6, wherein the at least three passages are of different size at least in a part of at least one of the first and second apertured discs, the part not being covered by the first connecting head, by the second connecting head, or by the first connecting head and the second connecting head, respectively, and wherein at least two first passages of the at least three passages are larger than a respective second passage of the at least three passages, the respective second passage being arranged between the at least two first passages.

8. The vertical scaffolding frame according to claim 6, wherein an apertured disc part of the first apertured disc, of the second apertured disc, or, respectively, of the first apertured disc and of the second apertured disc, has a passage of the at least three passages, and wherein the apertured disc part projects into the slot of the first connecting head, of the second connecting head, or of the first connecting head and of the second connecting head, respectively.

9. The vertical scaffolding frame according to claim 8, wherein the at least three passages are of different size at least in a part of at least one of the first and second apertured discs, the part not being covered by the first connecting head, by the second connecting head, or by the first connecting head and the second connecting head, respectively, and wherein the passage projecting into the slot is a smaller passage of the passages of different size.

10. The vertical scaffolding frame according to claim 1, wherein at least one of the first and second apertured discs has at least one spacing from at least one of a lower end of the first vertical post a lower end of the second vertical post, and wherein the at least one spacing is between 170 and 210centimeters.

11. The vertical scaffolding frame according to claim 1, further comprising a second railing element fastening device at the second vertical post at a spacing from the second apertured disc and for fastening a railing element serving as a safety device against falling.

12. The vertical scaffolding frame according to claim 11, wherein the second railing element fastening device is constructed differently from the first apertured disc and differently from the second apertured disc.

13. The vertical scaffolding frame according to claim 11, wherein the second railing element fastening device has a spacing between 75 centimeters and 125 centimeters or between 25 centimeters and 65 centimeters from a lower end of the second vertical post.

14. The vertical scaffolding frame according to claim 1, wherein the first railing element fastening device has a spacing between 75 centimeters and 125 centimeters or between 25 centimeters and 65 centimeters from a lower end of the first vertical post.

15. The vertical scaffolding frame according to claim 1, wherein the first connecting head and the second connecting head have a respective upper wall part between the respective side wall parts, wherein a toeboard fastening element is permanently fastened to at least one of the first connecting head and the second connecting head on at least one of the respective upper wall parts, and wherein the toeboard fastening element extends upwardly away from the at least one of the first connecting head and the second connecting head.

16. The vertical scaffolding frame according to claim 15, wherein the toeboard fastening element is arranged parallel to a longitudinal axis of at least one of the first vertical post and the second vertical post.

17. The vertical scaffolding frame according to claim 15, wherein the toeboard fastening element has a spacing of 10 millimeters to 20 millimeters from at least one of the first vertical post and the second vertical post, and wherein the at least one of the first vertical post and the second vertical post is disposed opposite to the toeboard fastening element.

18. The vertical scaffolding frame according to claim 1, wherein the crossbar includes a rod element, wherein at least one of the crossbar and the rod element is formed by a U-profile tube closed in cross-section and having two lateral U-limbs, and wherein the two lateral U-limbs are each formed by double wall regions and extend at least in part regions in an upward direction going out from a hollow profile part.

19. The vertical scaffolding frame according to claim 18, wherein the hollow profile part is formed with an outwardly disposed lower horizontal wall part and with an inwardly disposed upper horizontal wall part, and wherein the outwardly disposed lower horizontal wall part and the inwardly disposed upper horizontal wall part extend substantially over an entire length of the crossbar.

20. The vertical scaffolding frame according to claim 18, wherein the U-profile tube is produced by deforming, particularly by bending over or flanging a metal plate, particularly on a rolling train, wherein preferably a connection of two plate edges of the metal plate free of overlap is produced over the entire length of the U-profile tube, particularly by means of laser welding.

21. The vertical scaffolding frame according to claim 18, wherein the U-profile tube is produced by deforming, particularly by stretch-reduction of a cross-sectionally closed tube, particularly a round, square or rectangular tube.

22. The vertical scaffolding frame according to claim 18, wherein the U-profile tube is produced by extruding.

23. The vertical scaffolding frame according to claim 1, wherein the crossbar has an upper longitudinal outer edge forming a support edge for scaffolding floors able to be laid on the crossbar, able to be suspended at the crossbar, or able to be both laid and suspended on the crossbar with the help of suspension aids, and wherein the upper longitudinal outer edge is arranged above the first apertured disc and above the second apertured disc and at a spacing above a center plane of each of the first and second apertured discs, and wherein the spacing is smaller than a thickness, a height, or an outer diameter of the crossbar.

24. The vertical scaffolding frame according to claim 23, wherein the spacing corresponds with approximately half the thickness, half the height or the half the outer diameter of the crossbar.

25. The vertical scaffolding frame according to claim 23, wherein the spacing is 18 millimeters to 30 millimeters.

26. A three-dimensional scaffolding, with at least one vertical frame, the at least one vertical frame comprising:

a first vertical post having:

an upper end region formed as a tube connector and having a first cross section; and a lower end region having a second cross section different from the first cross section;

a first apertured disc having several passages, arranged concentrically with respect to the first vertical post, surrounding the first vertical post to form a flange, and permanently fastened to the first vertical post, the first apertured disc being a sole apertured disc fastened to the first vertical post;

a first railing element fastening device at the first vertical post at a spacing from the first apertured disc and being able to fasten a railing element serving as a safety device against falling;

a second vertical post having:

an upper end region forming a tube connector and having a first cross section; and a lower end region having a second cross section different from the first cross section; and a second apertured disc having several passages, arranged concentrically with respect to the second vertical post, surrounding the second vertical post to form a flange, and permanently connected with the second vertical post, the second apertured disc being a sole apertured disc fastened to the second vertical post;

wherein the first railing element fastening device is constructed differently from the first apertured disc and differently from the second apertured disc;

wherein the first vertical post and the second vertical post are connected by one single rod-shaped horizontal transverse arm extending transversely away from both the first vertical post and the second vertical post, permanently connected to both the first vertical post and the second vertical post by welding to be stiff in bending and torsion, and forming one single crossbar having:

a first end;

a first connecting head at the first end, bounded by side wall parts having vertical outer surfaces, and having an upper head part, a lower head part, and a slot between the upper head part and the lower head part, the vertical outer surfaces of the side wall parts of the first connecting head running together to form a wedge and having a wedge angle;

a second end facing away from the first end; and a second connecting head at the second end, bounded by side wall parts having vertical outer surfaces, and having an upper head part, a lower head part, and a slot between the upper head part and the lower head part, the vertical outer surfaces of the side wall parts of the second connecting head running together to form a wedge and having a wedge angle;

wherein the crossbar is formed with a rod element extending straight between the first connecting head and the second connecting head;

wherein a permanent connection of the first vertical post and the second vertical post is formed by the one single crossbar;

wherein the first connecting head is plugged by a slot of the first connecting head, which is open towards the first vertical post and towards the vertical outer surfaces of the first connecting head, onto the first apertured disc such that the first apertured disc at least partly projects into the slot of the first connecting head and such that the wedge of the first connecting head is formed by the vertical outer surfaces of the side wall parts of the first connecting head running together towards a center of the first vertical post and towards a center of the first apertured disc;

wherein the first connecting head is permanently connected with the first vertical post by welding;

wherein the second connecting head is plugged by a slot of the second connecting head, which is open towards the second vertical post and towards the vertical outer surfaces of the second connecting head, onto the second apertured disc such that the second apertured disc at least partly projects into the slot of the second connecting head, and such that the wedge of the second connecting head is formed by the vertical outer surfaces of the side wall parts of the second connecting head running together towards a center of the second vertical post and towards a center of the second apertured disc; and wherein the second connecting head is permanently connected with the second post by welding.

27. The three-dimensional scaffolding according to claim 26, further comprising:

a third vertical post and a fourth vertical post, at least one scaffolding floor mounted on the first vertical post, on the second vertical post, on the third vertical post, and on the fourth vertical post, and at least one railing element forming a safety device against falling.

* * * * *

UNITED STATES PATENT AND TRADEMARK OFFICE

CERTIFICATE OF CORRECTION

PATENT NO. : 8,978,822 B2
APPLICATION NO. : 12/311628
DATED : March 17, 2015
INVENTOR(S) : Kreller It is certified that error appears in the above-identified patent and that said Letters Patent is hereby corrected as shown below:

In the Claims

In Column 38, line 47 (Line 16 in Claim 3), please change "projectinq" to correctly read:
--projecting--.

In Column 38, line 55 (Line 24 in Claim 3), please change "first-apertured-disc-projectinq" to correctly read:
--first-apertured-disc-projecting--.

In Column 40, line 51 (Line 6 of Claim 10), please change "210centimeters" to correctly read:
--210 centimeters--.

Signed and Sealed this
Thirtieth Day of June, 2015

Michelle K. Lee

Michelle K. Lee
*Director of the United States Patent and Trademark Office*